US012214251B2

(12) United States Patent
Hopperstad et al.

(10) Patent No.: US 12,214,251 B2
(45) Date of Patent: Feb. 4, 2025

(54) RETRACTABLE EXERCISE RACK SYSTEM

(71) Applicant: PRx Performance, LLC, Fargo, ND (US)

(72) Inventors: Erik S. Hopperstad, Fargo, ND (US); Spencer R. Sweeney, West Fargo, ND (US); Garrett A. Iverson, Fargo, ND (US)

(73) Assignee: PRx Performance, LLC, Fargo, ND (US)

( * ) Notice: Subject to any disclaimer, the term of this patent is extended or adjusted under 35 U.S.C. 154(b) by 194 days.

(21) Appl. No.: 17/888,067

(22) Filed: Aug. 15, 2022

(65) Prior Publication Data

US 2023/0045795 A1 Feb. 16, 2023

Related U.S. Application Data

(60) Provisional application No. 63/233,480, filed on Aug. 16, 2021.

(51) Int. Cl.
*A63B 23/12* (2006.01)
*A63B 21/078* (2006.01)

(52) U.S. Cl.
CPC ..... *A63B 23/1218* (2013.01); *A63B 21/078* (2013.01); *A63B 2210/50* (2013.01)

(58) Field of Classification Search
CPC ..... A63B 23/1218; A63B 21/078; A63B 2210/50; A63B 21/16; A63B 21/169;
(Continued)

(56) References Cited

U.S. PATENT DOCUMENTS 332,989 A 12/1885 Benedict
618,990 A 2/1899 Lubben
(Continued)

FOREIGN PATENT DOCUMENTS

CN 103598759 A 2/2014
DE 4307632 A1 9/1993
(Continued)

OTHER PUBLICATIONS

U.S. Appl. No. 17/944,459, filed Sep. 14, 2022, Garrett A. Iverson.
(Continued)

*Primary Examiner* — Andrew S Lo
(74) *Attorney, Agent, or Firm* — Neustel Law Offices

(57) ABSTRACT

A retractable exercise rack system for efficiently securing an exercise rack against or near a wall when the exercise rack is not in use. The retractable exercise rack system may thus be adjustable between a retracted position against or near the wall, and an extended position which is distally-positioned with respect to the wall. The retractable exercise rack system generally includes a first support member a second support member, with an exercise bar connected between the support members. Wall mounts may be secured to the wall, with the first and second support members being adjustably connected to the wall mounts by linkages, scissor connectors, or arms. Latches and strikers may be utilized to releasably lock the support members in the extended and/or retracted positions. One or both of the support members may include a button for releasing the latches from the strikers.

20 Claims, 53 Drawing Sheets

(58) Field of Classification Search
CPC . A63B 1/00; A63B 2071/025; A63B 2225/09; A63B 2225/093
See application file for complete search history.

(56) References Cited

U.S. PATENT DOCUMENTS

| | | | | |
|---|---|---|---|---|
| 1,104,505 | A | 7/1914 | Holworthy | |
| 1,696,145 | A | 12/1928 | Wagoner | |
| 2,219,219 | A | 10/1940 | Boger | |
| 2,632,645 | A | 3/1953 | Barkschat | |
| 2,855,200 | A | 10/1958 | Blickman | |
| 3,414,262 | A | 12/1968 | Lavergne | |
| 3,614,097 | A | 10/1971 | Blickman | |
| 3,874,657 | A | 4/1975 | Niebojewski | |
| 3,918,710 | A | 11/1975 | Niebojewski | |
| 4,249,726 | A | 2/1981 | Faust | |
| 4,257,590 | A | 3/1981 | Sullivan | |
| 4,262,901 | A | 4/1981 | Faust | |
| 4,286,782 | A | 9/1981 | Fuhrhop | |
| 4,300,761 | A | 11/1981 | Howard | |
| 4,306,715 | A | 12/1981 | Sutherland | |
| 4,358,109 | A | 11/1982 | Schrems | |
| 4,368,884 | A | 1/1983 | Colvin | |
| 4,369,966 | A | 1/1983 | Silberman | |
| 4,396,191 | A | 8/1983 | Metler | |
| 4,431,181 | A | 2/1984 | Baswell | |
| 4,527,797 | A | 7/1985 | Slade, Jr. | |
| 4,603,855 | A | 8/1986 | Sebelle | |
| 4,615,524 | A | 10/1986 | Sutherland | |
| 4,621,809 | A | 11/1986 | Pearl | |
| 4,635,934 | A | 1/1987 | Roethke | |
| 4,637,608 | A | 1/1987 | Owens | |
| 4,645,196 | A | 2/1987 | Christie | |
| 4,650,186 | A | 3/1987 | McCreery | |
| 4,729,561 | A | 3/1988 | Desjardins | |
| 4,757,998 | A | 7/1988 | Landin | |
| 4,759,539 | A | 7/1988 | Nieppola | |
| 4,765,616 | A | 8/1988 | Wolff | |
| 4,773,642 | A | 9/1988 | Cruz | |
| 4,781,374 | A | 11/1988 | Lederman | |
| 4,795,149 | A | 1/1989 | Pearson | |
| 4,804,179 | A | 2/1989 | Murphy | |
| 4,826,153 | A | 5/1989 | Schalip | |
| 4,842,270 | A | 6/1989 | Lange | |
| 4,844,448 | A | 7/1989 | Niznik | |
| 4,861,024 | A | 8/1989 | Lee | |
| 4,861,025 | A | 8/1989 | Rockwell | |
| 4,898,381 | A | 2/1990 | Gordon | |
| 4,907,798 | A | 3/1990 | Burchatz | |
| 4,915,377 | A | 4/1990 | Malnke | |
| 4,919,419 | A | 4/1990 | Houston | |
| 4,927,135 | A | 5/1990 | Nieppola | |
| 4,928,961 | A | 5/1990 | Madden | |
| 4,934,693 | A | 6/1990 | Santoro | |
| 4,936,572 | A | 6/1990 | Desiderio | |
| 4,955,604 | A | 9/1990 | Pogue | |
| 4,958,833 | A | 9/1990 | Stater | |
| 4,960,277 | A | 10/1990 | LaRossa | |
| 4,974,837 | A | 12/1990 | Someya | |
| 4,976,428 | A | 12/1990 | Ghazi | |
| 5,011,141 | A | 4/1991 | Towley, III | |
| 5,046,722 | A | 9/1991 | Antoon | |
| 5,082,259 | A | 1/1992 | Gonzalez | |
| 5,082,260 | A | 1/1992 | Dinelli | |
| 5,098,093 | A | 3/1992 | Dupre | |
| 5,098,361 | A | 3/1992 | Danylieko | |
| 5,141,480 | A | 8/1992 | Lennox | |
| 5,151,072 | A | 9/1992 | Cone | |
| 5,184,992 | A | 2/1993 | Banks | |
| 5,242,345 | A | 9/1993 | Mitchell | |
| 5,249,858 | A | 10/1993 | Nusser | |
| 5,281,193 | A | 1/1994 | Colbo, Jr. | |
| 5,306,220 | A | 4/1994 | Kearney | |
| 5,328,428 | A | 7/1994 | Huang | |
| 5,346,448 | A | 9/1994 | Sollo | |
| 5,350,346 | A | 9/1994 | Martinez | |
| D358,623 | S * | 5/1995 | Macasieb | A63B 21/078 D21/691 |
| 5,456,644 | A | 10/1995 | Hecox | |
| 5,466,204 | A | 11/1995 | Nearing | |
| 5,509,876 | A | 4/1996 | Reyes | |
| 5,551,936 | A | 9/1996 | Parisi | |
| 5,669,859 | A | 9/1997 | Liggett | |
| 5,688,216 | A | 11/1997 | Mauriello | |
| D390,287 | S | 2/1998 | Hsieh | |
| 5,755,823 | A | 5/1998 | Cleary | |
| 5,779,601 | A | 7/1998 | Ish, III | |
| 5,813,951 | A | 9/1998 | Einsig | |
| D404,443 | S | 1/1999 | Doyle | |
| 5,882,283 | A | 3/1999 | Stevens | |
| 5,921,897 | A | 7/1999 | Stevens | |
| 5,964,684 | A | 10/1999 | Sokol | |
| 5,971,897 | A | 10/1999 | Olson | |
| 6,027,433 | A | 2/2000 | Flynn | |
| 6,073,624 | A | 6/2000 | Laurent | |
| 6,248,048 | B1 | 6/2001 | Zuckerman | |
| 6,299,568 | B1 | 10/2001 | Prok | |
| 6,328,679 | B1 | 12/2001 | Croft | |
| 6,443,877 | B1 | 9/2002 | Hoecht | |
| 6,579,213 | B1 | 6/2003 | Webber | |
| 6,685,601 | B1 | 2/2004 | Knapp | |
| 7,070,546 | B1 | 7/2006 | Grasso | |
| 7,338,416 | B2 | 3/2008 | Smith | |
| 7,374,516 | B2 | 5/2008 | Lundquist | |
| 7,393,309 | B2 | 7/2008 | Webber | |
| 7,455,621 | B1 | 11/2008 | Anthony | |
| 7,488,277 | B1 | 2/2009 | Knapp | |
| 7,549,950 | B1 | 6/2009 | Lundquist | |
| 7,575,538 | B1 | 8/2009 | Clark | |
| 7,635,322 | B2 | 12/2009 | Parrilla | |
| 7,666,118 | B1 | 2/2010 | Anthony | |
| 7,699,756 | B2 | 4/2010 | Piane, Jr. | |
| 8,047,972 | B1 | 1/2011 | Dean | |
| 8,075,454 | B2 | 12/2011 | Piggins | |
| 8,231,509 | B2 | 7/2012 | Lundquist | |
| 8,491,449 | B2 | 7/2013 | Rogers | |
| 8,506,459 | B2 | 8/2013 | Cassidy | |
| 8,517,900 | B1 | 8/2013 | Britt | |
| 8,651,293 | B2 | 2/2014 | Boyer | |
| 8,727,953 | B2 | 5/2014 | Drechsler | |
| 9,192,799 | B2 | 11/2015 | Alenaddaf | |
| 9,333,387 | B2 | 5/2016 | Hopperstad | |
| 9,409,048 | B1 * | 8/2016 | Hopperstad | A63B 21/4035 |
| 9,498,670 | B1 | 11/2016 | Hopperstad | |
| 9,649,525 | B2 | 5/2017 | Hopperstad | |
| 9,675,510 | B2 | 6/2017 | Moerth-Cross | |
| 9,713,745 | B2 | 7/2017 | Rogers | |
| 9,844,691 | B2 | 12/2017 | Hopperstad | |
| 9,993,678 | B2 | 6/2018 | Hopperstad | |
| 10,124,201 | B2 | 11/2018 | Hopperstad | |
| 10,195,479 | B2 | 2/2019 | Brasch | |
| 10,226,661 | B2 | 3/2019 | Henniger | |
| 10,632,334 | B1 | 4/2020 | Hopperstad | |
| D888,851 | S * | 6/2020 | Dunahay | D8/354 |
| 10,779,645 | B2 | 9/2020 | Siaperas | |
| 10,953,301 | B2 | 3/2021 | Brasch | |
| 11,058,936 | B1 * | 7/2021 | Brasch | A63B 23/1218 |
| D942,561 | S | 2/2022 | Dunahay | |
| D949,265 | S * | 4/2022 | Dunahay | D21/694 |
| 11,446,535 | B1 * | 9/2022 | Iverson | A63B 17/02 |
| 11,992,744 | B2 * | 5/2024 | Brasch | A63B 21/078 |
| 2004/0092369 | A1 | 5/2004 | Slawinski | |
| 2008/0276551 | A1 | 11/2008 | Thomas | |
| 2009/0017997 | A1 | 1/2009 | Piggins | |
| 2009/0143203 | A1 | 6/2009 | Knapp | |
| 2009/0289535 | A1 | 11/2009 | Weber | |
| 2010/0048368 | A1 | 2/2010 | Donofrio | |
| 2011/0195822 | A1 | 8/2011 | Donofrio | |
| 2012/0289384 | A1 | 11/2012 | Staten | |
| 2013/0257242 | A1 | 10/2013 | Bunch | |
| 2014/0018215 | A1 | 1/2014 | Donofrio | |
| 2014/0031182 | A1 | 1/2014 | Donofrio | |
| 2014/0243174 | A1 | 8/2014 | Alenaddaf | |
| 2014/0339184 | A1 | 11/2014 | Couch | |

(56) References Cited

U.S. PATENT DOCUMENTS

| | | | | |
|---|---|---|---|---|
| 2015/0148197 | A1 | 5/2015 | Lentz | |
| 2015/0264823 | A1 | 9/2015 | Shirley | |
| 2015/0290488 | A1* | 10/2015 | Hopperstad | A63B 17/04 482/38 |
| 2015/0352395 | A1 | 12/2015 | Gregory | |
| 2016/0016033 | A1 | 1/2016 | Schrag | |
| 2016/0074698 | A1 | 3/2016 | Figueroa | |
| 2016/0096062 | A1 | 4/2016 | Moerth-Cross | |
| 2017/0065844 | A1 | 3/2017 | Hopperstad | |
| 2017/0146282 | A1 | 3/2017 | Dodge | |
| 2017/0197109 | A1 | 7/2017 | Cole | |
| 2017/0239512 | A1 | 8/2017 | Brasch | |
| 2018/0178051 | A1 | 6/2018 | Shaw, Jr. | |
| 2018/0326250 | A1* | 11/2018 | Henniger | A63B 23/0405 |
| 2019/0126088 | A1* | 5/2019 | Henniger | A63B 23/1218 |
| 2019/0166993 | A1 | 6/2019 | Siaperas | |
| 2019/0240525 | A1 | 8/2019 | Leipheimer | |
| 2020/0131825 | A1 | 4/2020 | Hirtsiefer | |
| 2020/0197737 | A1 | 6/2020 | Kistner | |
| 2020/0384337 | A1* | 12/2020 | Brasch | A63B 23/1218 |
| 2021/0205686 | A1 | 7/2021 | Brasch | |
| 2022/0016466 | A1* | 1/2022 | Henniger | A63B 23/1218 |
| 2022/0023704 | A1* | 1/2022 | Henniger | A63B 21/068 |

FOREIGN PATENT DOCUMENTS

| | | | |
|---|---|---|---|
| GB | 2076299 | A | 12/1981 |
| WO | 2009003280 | A1 | 1/2009 |
| WO | 2019090121 | A1 | 5/2019 |

OTHER PUBLICATIONS https://www.youtube.com/watch?v=f6bPYbS_2Fw; YouTube Video Equipment Demo Rogue Dirty South Bar; Apr. 25, 2012.

https://www.roguefitness.com/rogue-r-3w-fold-back-wall-mount-rack; Rogue Fitness R-3W Fold Back Wall Mount Rack Website Page; Jan. 1, 2014.

2717 Equipment Facebook Posts -W-1 Pull Up and Rack; Nov. 8, 2012.

2717 Equipment Facebook Posts—Wall Mounted Pull Up and Squat Rack; Mar. 27, 2012.

https://www.youtube.com/watch?v=koAzH910474; YouTube Video Matt Chan Talks the Dirty South Bar; Dec. 20, 2012.

Pictures of PRX Performance Pull-Up Bar on Central Rig Display at Granite Games; Oct. 5, 2013.

http://board.crossfit.com/showthread.php?t=86058; Pictures from Website for Crossfit Message Board; Feb. 8, 2014.

http://board.crossfit.com/showthread.php?t=86058; Website for Crossfit Message Board; Feb. 8, 2014.

http://www.roguefitness.com/rogue-4-monster-lite-wall-mount, Monster Lite Wall Mount Webpage from Rogue Fitness; Jan. 1, 2014.

http://www.roguefitness.com:80/x-43m-multi-grip-crossmember.php; Rogue Fitness X-43 Multi-Grip Crossmember Website Page; Jan. 23, 2013.

http://www.roguefitness.com:80/w4-garage-gym.php; Rogue Fitness W-4 Garage Gym Website Page; Jan. 23, 2013.

http://www.roguefitness.com:80/rogue-sm-2-monster-squat-stand.php; Rogue Fitness SM-2 Monster Squat Stand Website Page; Jan. 27, 2013.

http://www.roguefitness.com:80/rogue-r-3-power-rack.php; Rogue Fitness R3 Power Rack Website Page; Jan. 11, 2013.

http://www.roguefitness.com:80/bodyweight-gymnastics/rpg-pullup-system.php; Rogue Fitness Pull Up & RPG Systems Website Page; Jan. 23, 2013.

http://www.roguefitness.com:80/dirty-south-bar.php; Rogue Fitness Dirty South Bar Website Page; Jan. 23, 2013.

https://www.roguefitness.com/monster-lite-rml-390-fullw-fold-back-wall-mount-power-rack; Rogue Fitness Monster Lite RML-390FULLW Fold Back Wall Mount Power Rack Webpage; Oct. 21, 2021.

PCT International Search Report and Written Opinion for PCT/US2021/036713; Sep. 1, 2021.

* cited by examiner

RETRACTABLE EXERCISE RACK SYSTEM

CROSS REFERENCE TO RELATED APPLICATIONS

I hereby claim benefit under Title 35, United States Code, Section 119(e) of U.S. provisional patent application Ser. No. 63/233,480 filed Aug. 16, 2021. The 63/233,480 application is hereby incorporated by reference into this application.

STATEMENT REGARDING FEDERALLY SPONSORED RESEARCH OR DEVELOPMENT

Not applicable to this application.

BACKGROUND

The described example embodiments in general relate to a retractable exercise rack system for efficiently securing an exercise rack against or near a wall when the exercise rack is not in use.

More and more people are looking to stay fit, particularly during times of quarantine and self-isolation. While exercise studios have become ubiquitous in modern life, constraints such as time, distance of travel, and health crises have caused more and more people to seek out exercise equipment to use in their own homes.

Home exercise equipment is widely available, including various exercise racks, exercise bikes, rowing machines, reformers, and the like. However, such exercise equipment can require a lot of space and leave various structures which can create a mess and heighten the risk of injury, such as from a child tripping over weights or an exercise rack. Additionally, such exercise equipment can create a nuisance when not in use by taking up valuable space inside a home gym. For example, an exercise rack installed in a garage can leave little room for a vehicle or storage space.

While such exercise equipment is suitable for performing exercises, it would be far more preferable to utilize exercise equipment which may be easily retracted into a compact state to allow for maximum use of a space when the exercise equipment is not in use.

SUMMARY

Some of the various embodiments of the present disclosure relate to a retractable exercise rack system including a first support member and a second support member that can each adjust between a first, retracted position against a wall and a second, extended position in which the support members are distally-positioned with respect to the wall. In a first exemplary embodiment, a plurality of linkages are pivotably connected at a first end to one of a plurality of brackets secured to the wall and slidably connected at a second end to one of the support members. In a second exemplary embodiment, a plurality of scissor connectors are pivotably connected between the support members and the wall. In a third exemplary embodiment, a pair of first arms are pivotably connected to the first support member and slidably connected to a first wall mount secured to the wall and a pair of second arms are pivotably connected to the second support member and slidably connected to a second wall mount secured to the wall. In a fourth exemplary embodiment, a first upper arm and a first lower arm are each pivotably connected to the first support member and a second upper arm and a second lower arm are each pivotably connected to the second support member, with the first and second upper arms being slidably connected to an upper wall mount and the first and second lower arms being slidably connected to a lower wall mount. Latches and strikers may be utilized to releasably lock the first and second support members in the extended and/or retracted positions.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Figure 1:
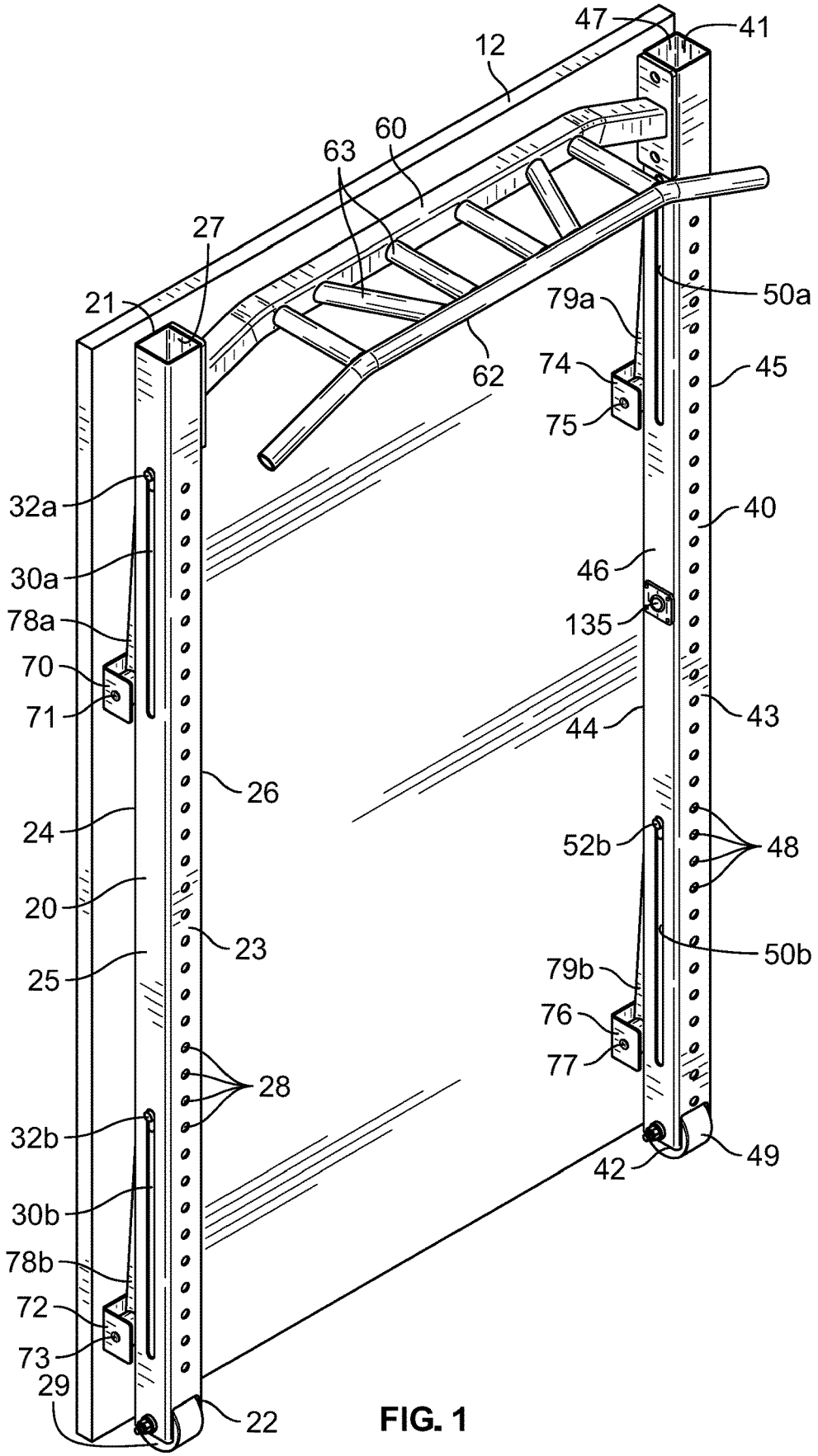
FIG. 1 is a perspective view of a retractable exercise rack system in a retracted position in accordance with an example embodiment.
Figure 2:
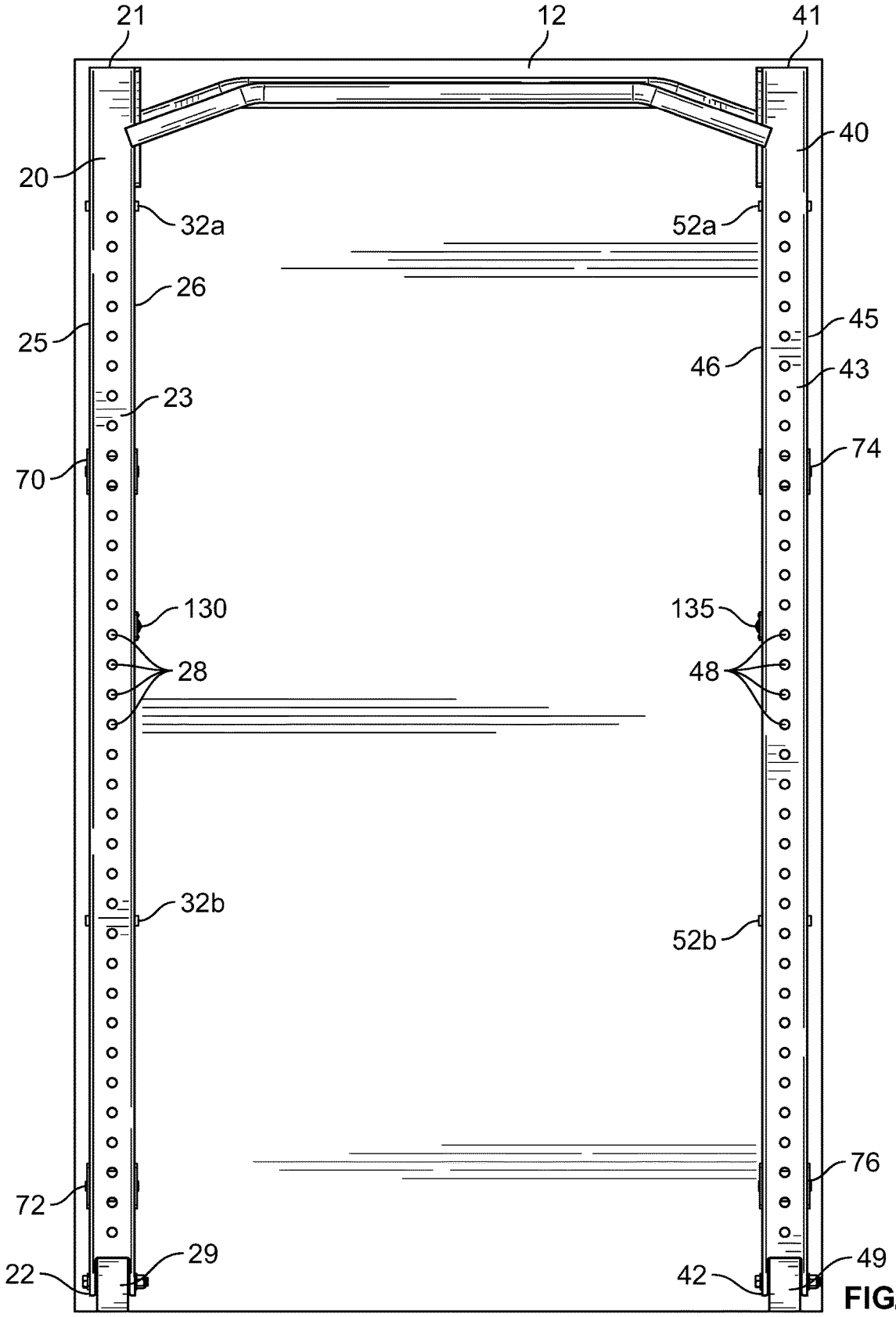
FIG. 2 is a front view of a retractable exercise rack system in a retracted position in accordance with an example embodiment.

Some of the various embodiments of the present disclosure relate to a retractable exercise rack system including a first support member 20 and a second support member 40 that can each adjust between a first, retracted position against a wall and a second, extended position in which the support members 20, 40 are distally-positioned with respect to the wall 12. In a first exemplary embodiment shown in FIGS. 1-12, a plurality of linkages 78*a*, 78*b*, 79*a*, 79*b* are pivotably connected at a first end to one of a plurality of wall mounts 70, 72, 74, 76 secured to the wall 12 and slidably connected at a second end to one of the support members 20, 40. In a second exemplary embodiment shown in FIGS. 13-25, a plurality of scissor connectors 80*a*, 80*b*, 85*a*, 85*b* are pivotably connected between the support members 20, 40 and the wall 12. In a third exemplary embodiment shown in FIGS. 26-38, a pair of first upper and lower arms 93, 96 are pivotably connected to the first support member 20 and slidably connected to a first wall mount 90 secured to the wall 12 and a pair of second upper and lower arms 103, 106 are pivotably connected to the second support member 40 and slidably connected to a second wall mount 100 secured to the wall 12. In a fourth exemplary embodiment shown in FIGS. 39-50, a first upper arm 113 and a first lower arm 123 are each pivotably connected to the first support member 20 and a second upper arm 116 and a second lower arm 126 are each pivotably connected to the second support member 40, with the first and second upper arms 113, 116 being slidably connected to an upper wall mount 110 and the first and second lower arms 123, 126 being slidably connected to a lower wall mount 120. Latches 140 and strikers 142 may be utilized to releasably lock the first and second support members 20, 40 in the extended and/or retracted positions.

In a first exemplary embodiment as shown in FIGS. 1-12, the retractable exercise rack system may include a first support member 20 and a second support member 40, with the second support member 40 being distally-spaced and parallel with respect to the first support member 20. An exercise bar 62 is connected between the first support member 20 and the second support member 40. A first wall mount 70 adapted to be connected to a wall 12, and a first linkage 78*a* is connected between the first wall mount 70 and the first support member 20. A first end of the first linkage 78*a* is pivotably connected to the first wall mount 70.

A second wall mount 74 is adapted to be connected to the wall 12, and a second linkage 79*a* is connected between the second wall mount 74 and the second support member 40. A first end of the second linkage 79*a* is pivotably connected to the second wall mount 74. The first support member 20 and the second support member 40 are adjustable between a retracted position and an extended position. In the retracted position, the first support member 20 and the second support member 40 are each positioned adjacent to the wall 12. In the extended position, the first support member 20 and the second support member 40 are distally positioned away from the wall 12.

Continuing to reference the first exemplary embodiment of FIGS. 1-12, it can be seen that a second end of the first linkage 78*a* is slidably connected to the first support member 20 and a second end of the second linkage 79*a* is slidably connected to the second support member 40. The first support member 20 includes a first slot 30*a* and the second support member 40 includes a second slot 50*a*, with the second end of the first linkage 78*a* being slidably connected within the first slot 30*a* of the first support member 20 and the second end of the second linkage 78*a* being slidably connected within the second slot 50*a* of the second support member 40. The second end of the first linkage 78*a* may include a first slide pin 32*a* and the second end of the second linkage 79*a* may include a second slide pin 52*a*. The first slide pin 32*a* is slidably connected within the first slot 30*a* and the second slide pin 52*a* is slidably connected within the second slot 50*a*. The first slot 30*a* may be positioned near an upper end of the first support member 20 and the second slot 50*a* may be positioned near an upper end of the second support member 40.

Continuing to reference FIGS. 1-12, it can be seen that a third wall mount 76 and a fourth wall mount 78 may be connected to the wall 12, with a third linkage 78*b* being connected between the third wall mount 76 and the first support member 20 and a fourth linkage 79*b* being connected between the fourth wall mount 78 and the second support member 20. The first support member 20 may include a first upper slot 30*a* near its upper end 21 and a first lower slot 30*b* near its lower end 22, and the second support member 40 may include a second upper slot 50*a* near its upper end 41 and a second lower slot 50*b* near its lower end 42. The first linkage 78*a* may be slidably connected within the first upper slot 30*a*, the second linkage 79*a* may be slidably connected within the second upper slot 50*a*, the third linkage 78*b* may be slidably connected within the first lower slot 30*b*, and the fourth linkage 79*b* may be slidably connected within the second lower slot 50*b*. The first support member 20 may include a first latch 140 for removably locking the first support member 20 in the extended position and the second support member 40 may include a second latch 140 for removably locking the second support member 40 in the extended position. Strikers 142 may be utilized to engage with the latches 140, and buttons 130, 135 may be operable to release the latches 140 from the strikers 142. The first linkage 78*a* may be perpendicular to the first support member 20 when the first support member 20 is in the extended position and the second linkage 79*a* may be perpendicular to the second support member 40 when the second support member 40 is in the extended position.

In a second exemplary embodiment as shown in FIGS. 13-25, scissor connectors 80*a*, 80*b*, 85*a*, 85*b* may be utilized to connect the respective first and second support members 20, 40 to the wall mounts 70, 72, 74, 76. A first upper scissor connector 80*a* may comprise a first arm 81*a* and a second arm 83*a*, a second upper scissor connector 85*a* may comprise a first arm 86*a* and a second arm 88*a*, a first lower scissor connector 80*b* may comprise a first arm 81*b* and a second arm 83*b*, and a second lower scissor connector 85*b* may comprise a first arm 86*b* and a second arm 88*b*. The first arm 81*a*, 81*b*, 86*a*, 86*b* of each scissor connector 80*a*, 80*b*, 85*a*, 85*b* may be pivotably connected to one of the wall mounts 70, 72, 74, 76 and the second arm 81*a*, 81*b*, 86*a*, 86*b* of each scissor connector 80*a*, 80*b*, 85*a*, 85*b* may be pivotably connected to one of the support members 20, 40. The first arms 81*a*, 81*b*, 86*a*, 86*b* of each scissor connector 80*a*, 80*b*, 85*a*, 85*b* may be linearly-aligned with the respective second arms 83*a*, 83*b*, 88*a*, 88*b* when the support members 20, 40 are in the extended position.

Continuing to reference the second exemplary embodiment of FIGS. 13-25, each of the scissor connectors 80*a*, 80*b*, 85*a*, 85*b* may include actuators 68 (e.g., gas shocks) connected between the wall mounts 70, 72, 74, 76 and their respective first arms 81*a*, 81*b*, 86*a*, 86*b* to smoothen movement and guide the scissor connectors 80*a*, 80*b*, 85*a*, 85*b*. Latches 140 may be utilized to releasably lock each of the scissor connectors 80*a*, 80*b*, 85*a*, 85*b* in the extended and/or retracted positions, with each latch 140 being adapted to engage with a corresponding striker 142. The first and second support members 20, 40 may include buttons 130, 135 which are operable to release the latches 140 from their corresponding strikers 142.

In a third exemplary embodiment shown in FIGS. 26-38, a first wall mount may be secured to the wall 12 adjacent the first support member 20 and a second wall mount 100 may be secured to the wall 12 adjacent the second support member 40, with the first and second wall mounts 90, 100 each being vertically-oriented and parallel to each other. Arms 93, 96, 103, 106 may be connected between the support members 20, 40 and the wall mounts 90, 100. A first end of each arm 93, 96, 103, 106 may be slidably connected to one of the wall mounts 90, 100, and a second end of each arm 93, 96, 103, 106 may be pivotably connected to one of the support members 20, 40. The wall mounts 90, 100 may each include slots 91, 92, 101, 102 in which corresponding slide pins 95, 98, 105, 108 may be slidably connected, with the slide pins 95, 98, 105, 108 each being connected to an arm 93, 96, 103, 106.

Continuing to reference the third exemplary embodiment shown in FIGS. 26-38, it can be seen that the first arms 93, 96 are perpendicular to the first wall mount 90 when the first support member 20 is in the extended position and the second arms 103, 106 are perpendicular to the second wall mount 100 when the second support member 40 is in the extended position. Conversely, the first arms 93, 96 are substantially parallel to the first wall mount 90 when the first support member 20 is in the retracted position and the second arms 103, 106 are substantially parallel to the second wall mount 100 when the second support member 40 is in the retracted position. The arms 93, 96, 103, 106 may each include a latch 140 for releasably locking the support members 20, 40 in the extended and/or retracted positions. The wall mounts 90, 100 may include corresponding strikers 142 with which the latches 140 may releasably engage. The support members 20, 40 may include buttons 130, 135 which are operable to release the latches 140 from the strikers 142.

In a fourth exemplary embodiment as shown in FIGS. 39-50, an upper wall mount 110 may be connected to the wall 12 near the upper ends 21, 41 of the support members 20, 40 and a lower wall mount 120 may be connected to the wall 12 near the lower ends 22, 42 of the support members 20, 40. Upper arms 113, 123 may be connected between the upper wall mount 110 and the support members 20, 40 and lower arms 116, 126 may be connected between the lower wall mount 120 and the support members 20, 40. Each arm 113, 116, 123, 126 may be slidably connected to a respective wall mount 110, 120 and pivotably connected to a respective support member 20, 40. The upper wall mount 110 may include first and second upper slots 111, 112 in which corresponding upper slide pins 115, 118 connected to the upper arms 113, 116 may be slidably connected. The lower wall mount 120 may include first and second lower slots 121, 122 in which corresponding lower slide pins 125, 128 connected to the lower arms 123, 126 may be slidably connected.

Continuing to reference the fourth exemplary embodiment of FIGS. 39-50, the arms 113, 116, 123, 126 may each include a latch 140 for releasably locking a respective support member 20, 40 in an extended and/or retracted position. Each of the upper and lower wall mounts 110, 120 may include corresponding strikers 142 each being adapted to be engaged by one of the latches 140. The first and second support members 20, 40 may include buttons 130, 135 which are operable to release one or more of the latches 140 from a corresponding striker 142. Guide arms 119*a*, 119*b*, 129*a*, 129*b* may be connected between the wall mounts 110, 120 and the arms 113, 116, 123, 126 to guide movement of the arms 113, 116, 123, 126 when the support members 20, 40 are being adjusted between positions.

B. Exercise Rack

As shown throughout the figures, the systems and methods described herein my include one or more support members 20, 40 which together may form an exercise rack. The exemplary embodiments shown in the figures each illustrate the usage of a first support member 20 and a second support member 40, with the first and second support members 20, 40 being distally-spaced. The distance between the pair of support members 20, 40 may vary in different embodiments to suit different exercise rack configurations and types of exercises. Thus, the distance shown between the support members 20, 40 in the exemplary figures should not be construed as limiting in scope.

The exercise rack may also include an exercise bar 62 connected between the first and second support members 20, 40. The exercise bar 62 may be utilized to perform various exercise movements, such as but not limited to pull-ups. The exercise bar 62 may be fixedly or removably connected to the first and second support members 20, 40. When the exercise bar 62 is connected to the first and second support members 20, 40, adjustment of the first support member 20 will also force adjustment of the interconnected second support member 40, and vice versa.

Figure 13:
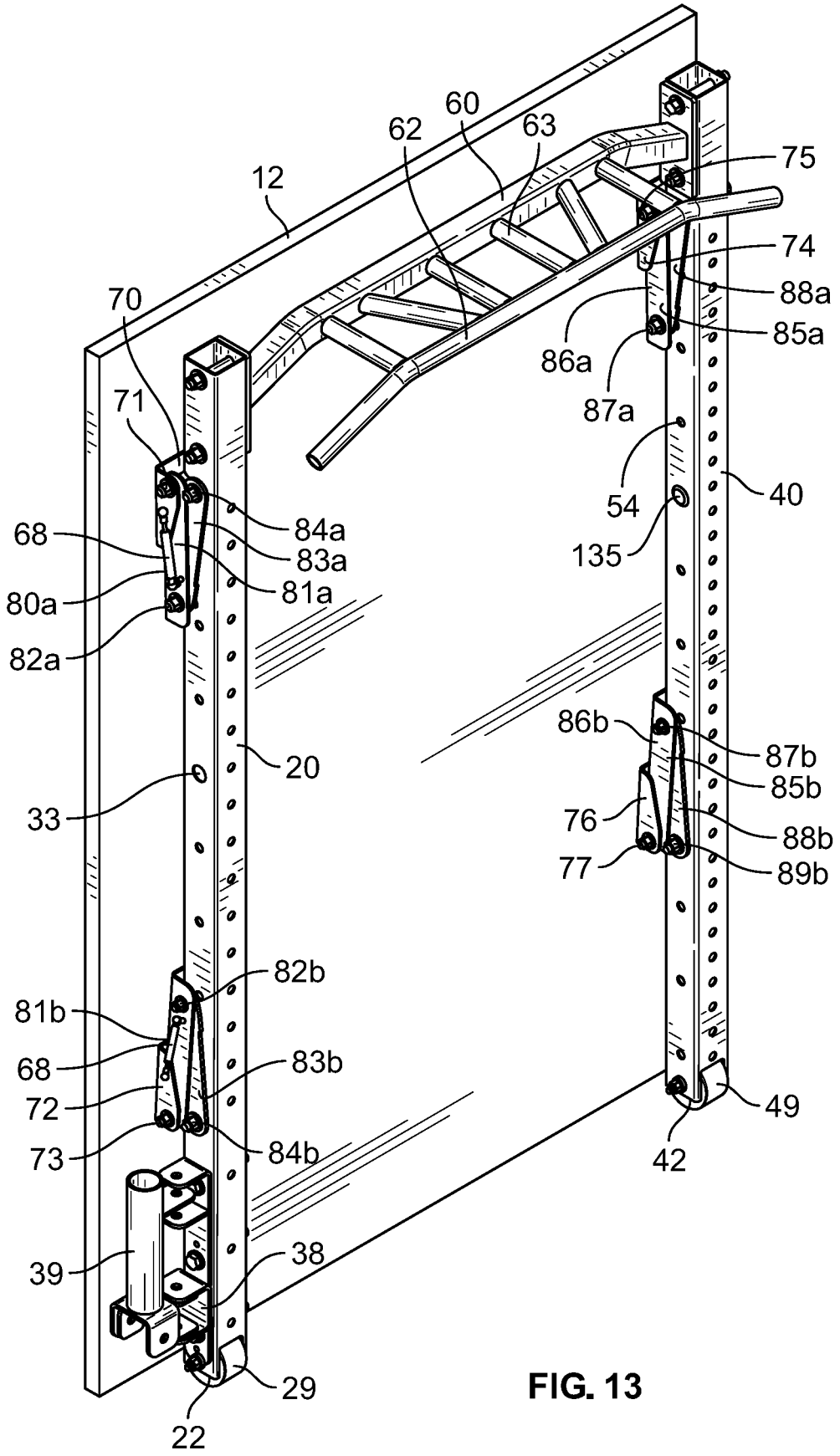
FIG. 13 is a perspective view of a retractable exercise rack system in a retracted position in accordance with an example embodiment.

The exercise rack may include various openings 28, 33, 54 to allow for a wide range of exercise attachments (e.g., exercise accessories or devices) to be removably attached to the first and/or second support members 20, 40 to allow for a wide range of exercises. By way of example and without limitation, such exercise attachments may include a landmine attachment 39 as shown in FIG. 13. As a further non-limiting example, such exercise attachments may also include brackets for weightlifting bars, spotter arms, benches, supports (e.g. brackets) for supporting weights, mobility bands, and the like.

Each of the support members 20, 40 may be adjustable between a retracted position in which each support member 20, 40 is positioned adjacent to or near a wall 12, and an extended position in which each support member 20, 40 is distally-positioned with respect to the wall 12. The distance between each support member 20, 40 and the wall 12 when the support members 20, 40 are in the extended position may vary in different embodiments. Additionally, the distance between each support member 20, 40 and the wall 12 when the support members 20, 40 are in the retracted position may vary in different embodiments. In some embodiments, the support members 20, 40 may each be in contact with the wall 12 (e.g., pressed against the wall 12) when in the retracted position. In some other embodiments, the support members 20, 40 may instead be close to, but not touching, the wall 12 when in the retracted position.

The exercise rack may thus be adjusted between the retracted position and the extended position. The retracted position may be utilized when the exercise rack is not in use (e.g., for storage) to maximize space available. The extended position may be utilized when the exercise rack is in use. The exercise rack may be removably locked in the extended and/or retracted positions as discussed herein. The manner in which the exercise rack is locked and/or unlocked from the extended and/or retracted positions may vary in different embodiments.

i. First Support Member.

As shown throughout the figures, a first support member 20 may comprise an upper end 21, a lower end 22, a front side 23, a rear side 24, an outer side 25, and an inner side 26. The lower end 22 of the first support member 20 may contact a ground surface 14 underlying the first support member 20 when the first support member 20 is in both the retracted and extended positions. Thus, the lower end 22 of the first support member 20 may stay in contact with the ground surface 14 when being adjusted between positions. In other embodiments, the lower end 22 of the first support member 20 may instead be raised off of the ground surface 14 when in the retracted position.

As shown in FIG. 1, the front side 23 of the first support member 20 faces away from the wall 12 and the rear side 24 of the first support member 20 faces towards the wall 12. As previously mentioned, the rear side 24 of the first support member 20 may, in some embodiments, contact the wall 12 when the first support member 20 is in the retracted position. The outer side 25 of the first support member 20 faces away from the second support member 40 and the inner side 26 of the first support member 20 faces towards the second support member 40.

The first support member 20 may comprise one or more openings 28, 33 which may be positioned on or along its front side 23, outer side 25, and/or inner side 26 of the first support member 20. The openings 28, 33 may allow the attachment of various types of exercise attachments (e.g., exercise devices, accessories, and/or supports) that may be adapted to be removably attached to the first support member 20 to perform various exercise movements.

In the exemplary embodiment shown in FIG. 1, it can be seen that the front side 23 of the first support member 20 includes a plurality of front openings 28 extending at least partially between the upper end 21 and the lower end 22 of the first support member 20. The front openings 28 may be utilized to attach various exercise attachments to the first support member 20 as-needed to perform various exercise movements. The number of such front openings 28 may vary in different embodiments. In some embodiments, the front openings 28 may be omitted entirely. In the embodiment shown in the figures, the front openings 28 form a column extending between the upper and lower ends 21, 22 of the first support member 20.

Figure 26:
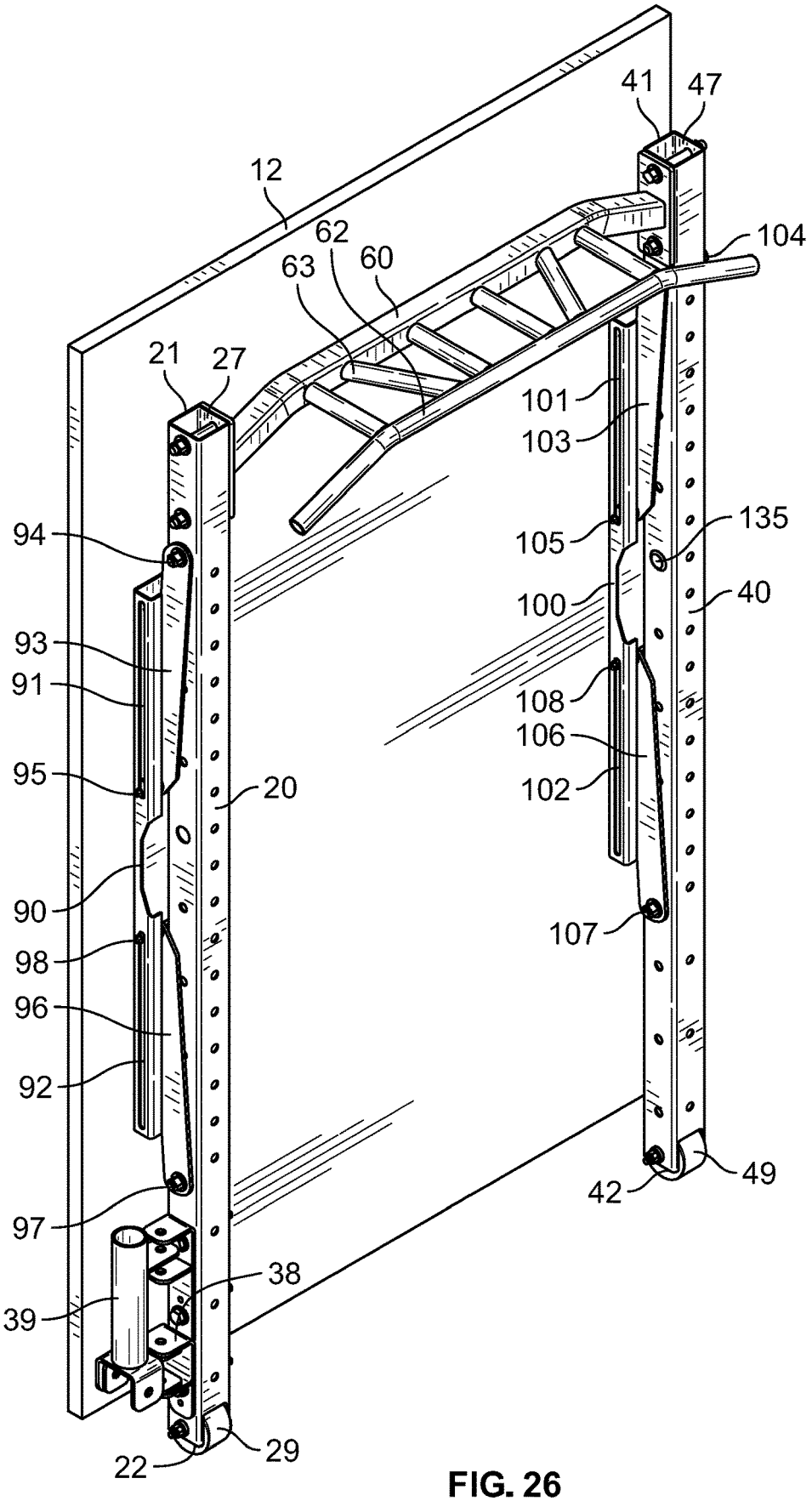
FIG. 26 is a perspective view of a retractable exercise rack system in a retracted position in accordance with an example embodiment.
Figure 27:
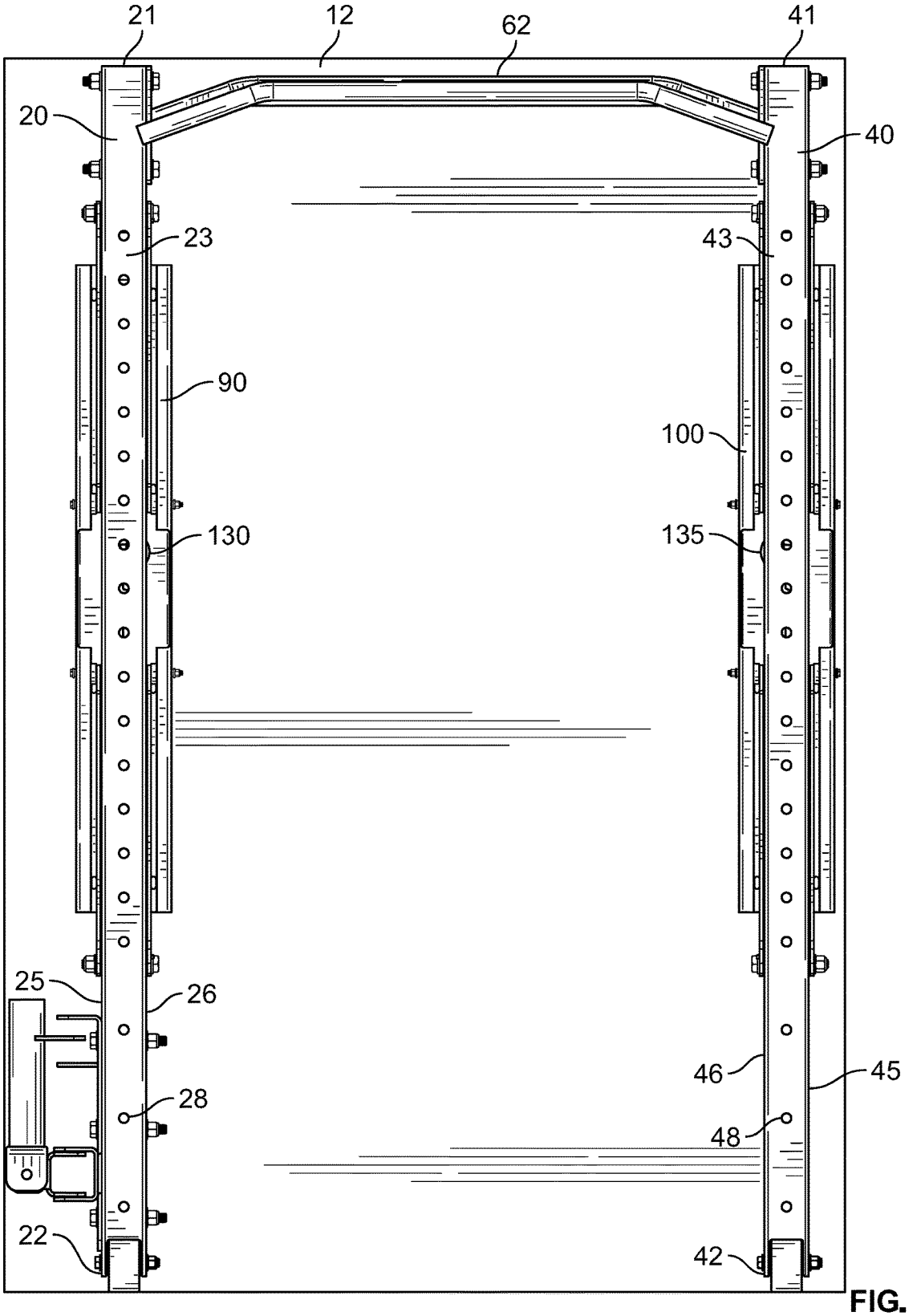
FIG. 27 is a front view of a retractable exercise rack system in a retracted position in accordance with an example embodiment.
Figure 39:
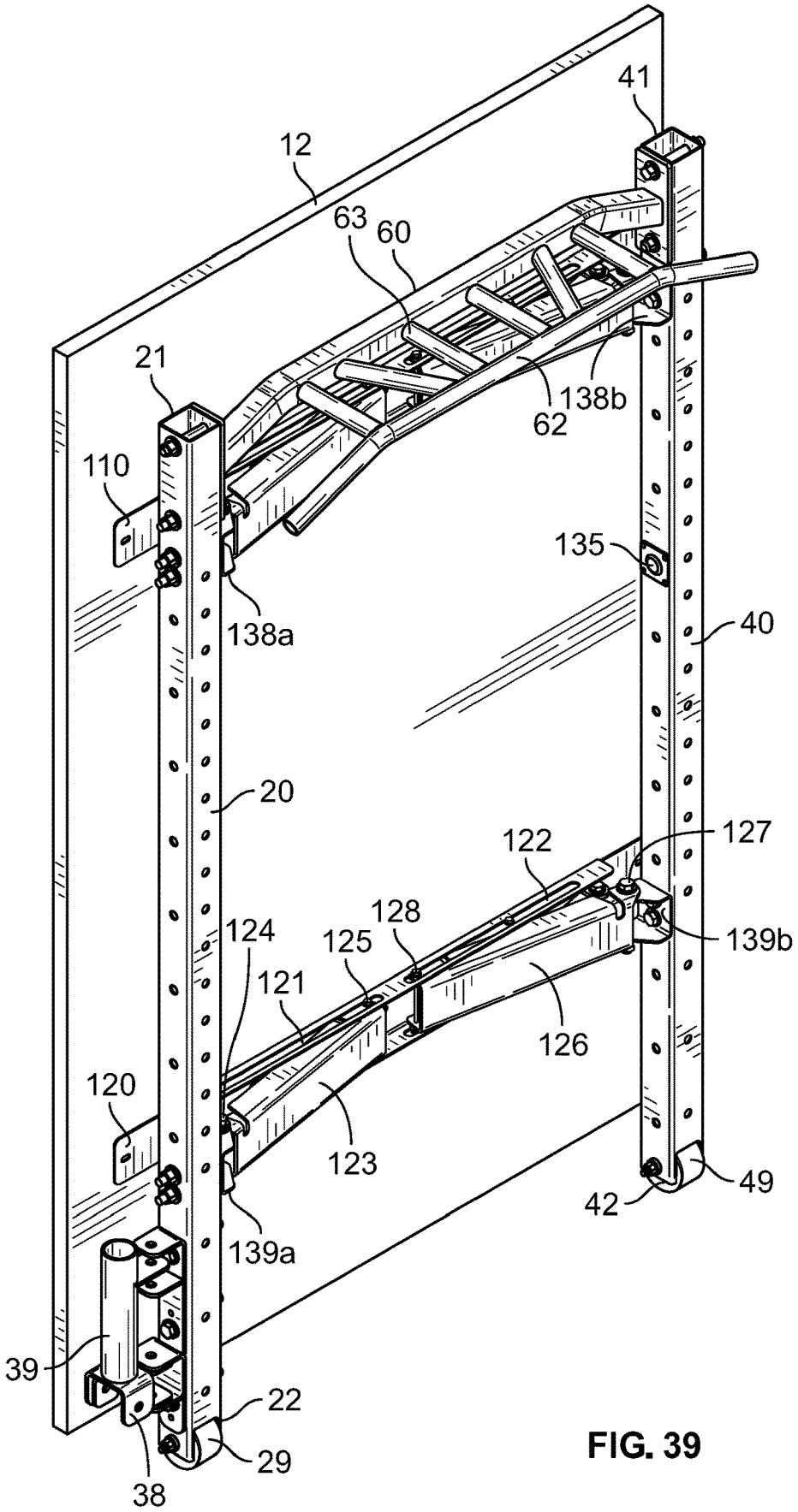
FIG. 39 is a perspective view of a retractable exercise rack system in a retracted position in accordance with an example embodiment.

In some embodiments such as shown in FIGS. 13, 26, and 39, the outer side 25 of the first support member 20 may include one or more outer openings 33 extending at least partially between the upper end 21 and the lower end 22 of the first support member 20. The outer openings 33 may be utilized to attach various exercise attachments to the first support member 20 as-needed to perform various exercise movements. The number of outer openings 33 may vary in different embodiments. In some embodiments such as shown in FIG. 1, the outer openings 33 may be omitted. The outer openings 33 may be arranged in a column as shown in FIG. 13.

In some embodiments such as shown in FIGS. 13, 26, and 39, the inner side 26 of the first support member 20 may include one or more inner openings extending at least partially between the upper end 21 and the lower end 22 of the first support member 20. Although the inner openings of the first support member 20 are not visible in the figures, they may appear similar to the outer openings 33 of the first support member 20 or the inner openings 54 of the second support member 40. The inner openings may be utilized to attach various exercise attachments to the first support member 20 as-needed to perform various exercise movements. The number of inner openings may vary in different embodiments. The inner openings may be omitted in some embodiments. The inner openings may be arranged in a column and may be aligned with the corresponding outer openings 33.

In some embodiments such as shown in FIG. 1, the first support member 20 may include one or more first slots 30*a*, 30*b*. As best shown in FIGS. 1-12, the first support member 20 may include at least one first upper slot 30*a* and at least one first lower slot 30*b*. By way of example, the first support member 20 may include a first upper slot 30*a* and a first lower slot 30*b* positioned on its outer side 25. Additionally or alternatively, in some embodiments, the first support member 20 may include such slots 30*a*, 30*b* on its inner side 26. In some embodiments, the first support member 20 may include both outer and inner slots 30*a*, 30*b* on both the outer and inner sides 25, 26 of the first support member 20. Such slots 30*a*, 30*b* may be aligned.

Slide pins 32*a*, 32*b* connected to the linkages 78*a*, 78*b* may be adapted to slide up and down within the first slots 30*a*, 30*b* when the first support member 20 is being adjusted between the extended and retracted positions as discussed herein. More specifically, the upper slide pin 32*a* may be slidably connected within the first upper slot 30*a* and the lower slide pin 32*b* may be slidably connected within the first lower slot 30*b*. Although not visible in the figures, the first support member 20 may also include slots 30*a*, 30*b* positioned on the inner side 26 of the first support member 20, with such inner slots of the first support member 20 being similar to and aligned with the outer slots 30*a*, 30*b*.

As shown throughout the figures, the first support member 20 may include a wheel 29 rotatably connected to the lower end 22 of the first support member 20. The wheel 29 may be utilized to aid in transitioning the first support member 20 between the extended and retracted positions. While only a single wheel 29 is shown in the figures connected to the first support member 20, it should be appreciated that multiple wheels 29 may in some embodiments be connected to the first support member 20. In some embodiments, the wheel 29 may be omitted entirely. In such embodiments, the lower end 22 of the first support member 20 may rest directly upon the underlying ground surface. In some embodiments, a footing such as a rubber footing may be utilized instead of a wheel 29.

As shown throughout the figures, the first support member 20 may be hollow, with a channel 27 extending at least partially between its upper and lower ends 21, 22. However, it should be appreciated that, in some embodiments, the first support member 20 may be solid for at least a portion of its height. Various structures of the retractable exercise system may be movably connected within the channel 27 as discussed herein. While the figures illustrate that the channel 27 (and thus the first support member 20) includes a square-shaped cross-section, it should be appreciated that, in some embodiments, various other shapes may be utilized (e.g., a circular cross-section).

Various exercise attachments (e.g., exercise devices) may be fixedly or removably connected to the first support member 20 to perform a wide range of exercises. In an exemplary embodiment shown in FIGS. 13, 26, and 39, it can be seen that a landmine attachment 39 is pivotably connected near the lower end 22 of the first support member 20. It should be appreciated that the type of exercise attachment may vary in different embodiments, and thus should not be construed as limited to a landmine attachment 39 which is merely for exemplary purposes.

In the illustrated embodiment, the landmine attachment 39 is connected to an attachment bracket 38, which is itself connected to the first support member 20 (e.g., using one or more of the outer openings 33 of the first support member 20). While the figures illustrate the landmine attachment 39 connected to the first support member 20, it should be appreciated that the landmine attachment 39 could instead be connected to the second support member 20. In other embodiments, both support members 20, 40 may include a landmine attachment 39, or various other types of exercise attachments known in the art.

ii. Second Support Member.

As shown throughout the figures, a second support member 40 may comprise an upper end 41, a lower end 42, a front side 43, a rear side 44, an outer side 45, and an inner side 46. The lower end 42 of the second support member 40 may contact a ground surface 14 underlying the second support member 40 when the second support member 40 is in both the retracted and extended positions. Thus, the lower end 42 of the second support member 40 may stay in contact with the ground surface 14 when being adjusted between positions. In other embodiments, the lower end 42 of the second support member 40 may instead be raised off of the ground surface 14 when in the retracted position.

As shown in FIG. 1, the front side 43 of the second support member 40 faces away from the wall 12 and the rear side 44 of the second support member 40 faces towards the wall 12. As previously mentioned, the rear side 44 of the second support member 40 may, in some embodiments, contact the wall 12 when the second support member 40 is in the retracted position. The outer side 45 of the second support member 40 faces away from the first support member 20 and the inner side 26 of the second support member 40 faces towards the first support member 20.

The second support member 40 may comprise one or more openings 48, 54 which may be positioned on or along its front side 43, outer side 45, and/or inner side 46. The openings 48, 54 may allow the attachment of various types of exercise accessories (e.g., exercise devices) that may be adapted to be removably attached to the second support member 40 to perform various exercise movements.

In the exemplary embodiment shown in FIG. 1, it can be seen that the front side 43 of the second support member 40 includes a plurality of front openings 48 extending at least partially between the upper end 41 and the lower end 42 of the second support member 40. The front openings 48 may be utilized to attach various exercise attachments to the second support member 40 as-needed to perform various exercise movements. The number of such front openings 48 may vary in different embodiments. In some embodiments, the front openings 48 may be omitted entirely. In the embodiment shown in the figures, the front openings 48 form a column extending between the upper and lower ends 41, 42 of the second support member 40.

In some embodiments such as shown in FIGS. 1-12, the inner side 46 of the second support member 40 may include one or more inner openings 54 extending at least partially between the upper end 41 and the lower end 42 of the second support member 40. The inner openings 54 may be utilized to attach various exercise attachments to the second support member 40 as-needed to perform various exercise movements. The number of inner openings 54 may vary in different embodiments. In some embodiments such as shown in FIG. 1, the inner openings 54 may be omitted. The inner openings 54 may be arranged in a column as shown in FIG. 1.

In some embodiments such as shown in FIG. 1, the outer side 45 of the second support member 40 may include one or more outer openings extending at least partially between the upper end 41 and the lower end 42 of the second support member 40. Although the outer openings of the second support member 40 are not visible in the figures, they may appear similar to the outer openings 33 of the second support member 40 or the inner openings 54 of the second support member 40. The outer openings may be utilized to attach various exercise attachments to the second support member 40 as-needed to perform various exercise movements. The number of outer openings may vary in different embodiments. The outer openings may be omitted in some embodiments. The outer openings may be arranged in a column and in alignment with the inner openings 54.

In some embodiments such as shown in FIG. 1, the inner side 46 of the second support member 40 may include one or more second slots 50*a*, 50*b*. As best shown in FIGS. 1-12, the second support member 40 may include at least one second upper slot 50*a* and at least one second lower slot 50*b*. By way of example, the second support member 40 may include a second upper slot 50*a* and a second lower slot 50*b* positioned on its outer side 45. Additionally or alternatively, in some embodiments, the second support member 40 may include such slots 50*a*, 50*b* on its inner side 46. In some embodiments, the second support member 40 may include both outer and inner slots 50*a*, 50*b* on both the outer and inner sides 45, 46 of the second support member 40. Such slots 50*a*, 50*b* may be aligned.

Slide pins 52*a*, 52*a* connected to the linkages 79*a*, 79*b* may be adapted to slide up and down within the second slots 50*a*, 50*b* when the second support member 40 is being adjusted between the extended and retracted positions as discussed herein. More specifically, the upper slide pin 52*a* may be slidably connected within the second upper slot 50*a* and the lower slide pin 52*b* may be slidably connected within the second lower slot 50*b*. Although not visible in the figures, the second support member 40 may also include outer slots positioned on the outer side 45 of the second support member 40, with the outer slots of the second support member 40 being similar to and aligned with the inner slots 50*a*, 50*b*.

As shown in FIGS. 1, 13, and 39, the second support member 40 may include a wheel 49 rotatably connected to the lower end 42 of the second support member 40. The wheel 49 may be utilized to aid in transitioning the second support member 40 between the extended and retracted positions. While only a single wheel 49 is shown in the figures connected to the second support member 40, it should be appreciated that multiple wheels 49 may in some embodiments be connected to the second support member 40. In some embodiments, the wheel 49 may be omitted entirely. In such embodiments, the lower end 42 of the second support member 40 may rest directly upon the underlying ground surface. In some embodiments, a footing such as a rubber footing may be utilized instead of a wheel 49.

As shown throughout the figures, the second support member 40 may be hollow, with a channel 47 extending at least partially between its upper and lower ends 41, 42. However, it should be appreciated that, in some embodiments, the second support member 40 may be solid for at least a portion of its height. Various structures of the retractable exercise system may be movably connected within the channel 47 as discussed herein. While the figures illustrate that the channel 47 (and thus the second support member 40) includes a square-shaped cross-section, it should be appreciated that, in some embodiments, various other shapes may be utilized (e.g., a circular cross-section).

iii. Exercise Bar.

As shown throughout the figures, a cross support 60 may be connected between the upper end 21 of the first support member 20 and the upper end 41 of the second support member 40. The cross support 60 may be connected at or near the respective upper ends 21, 41 of the support members 20, 40. In the exemplary embodiment shown in the figures, an exercise bar 62 is connected to the cross support 60 by one or more connectors 63. In the exemplary embodiment shown in the figures, the exercise bar 62 extends perpendicular to the first and second support members 20, 40.

The use of the cross support 60 allows for the distal side ends of the exercise bar 62 to extend over the first and second support members 20, 40. The cross support 60 also allows for the exerciser to be further from the wall 12 when performing exercises to allow for more movement without being inhibited by the wall 12.

In some embodiments, however, the cross support 60 may be omitted, with the exercise bar 62 instead being directly connected between the first and second support members 20, 40. In such an embodiment, the exercise bar 62 is perpendicular to the first and second support members 20, 40 but terminates at the respective inner sides 26, 46 of the support members 20, 40. Such an embodiment may be desirable for an even more compact configuration.

iv. Latching/Locking System.

The retractable exercise rack system may utilize various types of locking or latching systems for selectively and removably locking the first and second support members 20, 40 in the extended and/or retracted positions. By way of a non-limiting example, the first and second support members 20, 40 may include detent devices comprised of a detent pin in combination with a corresponding opening, with the detent pin engaging within the corresponding opening to lock, and the detent pin being adapted to be pressed inwardly to disengage from the corresponding opening to unlock.

As an example, the embodiment shown in FIGS. 1-12 could utilize detent pins and openings on the support members 20, 40, wall mounts 70, 72, 74, 76, and/or linkages 78*a*, 78*b*, 79*a*, 79*b* to allow for releasable locking in the extended and/or retracted positions. As a further example, the embodiment shown in FIGS. 13-25 could utilize detent pins and openings on the support members 20, 40, wall mounts 70, 72, 74, 76 and/or scissor connectors 80*a*, 80*b*, 85*a*, 85*b* to allow for releasable locking in the extended and/or retracted positions.

As yet another example, the embodiment shown in FIGS. 26-38 could utilize detent pins and openings on the support members 20, 40, wall mounts 90, 100, and/or arms 93, 96, 103, 106 to allow for releasable locking in the extended and/or retracted positions. As another example, the embodiment shown in FIGS. 39-51 could utilize detent pins and openings on the support members 20, 40, wall mounts 110, 120, and/or arms 113, 116, 123, 126 to allow for releasable locking in the extended and/or retracted positions.

As another non-limiting example, latches 140 may be utilized for releasably locking the first and second support members 20, 40 in the extended and/or retracted positions. Exemplary latches 140 are shown throughout the figures and are best shown in FIGS. 3, 7, 11, 25, 38, and 51. As shown, each latch 140 may be pivotable to either engage on or disengage from a corresponding striker 142. Each latch 140 may include a connector 144 which is pivotably adjustable to switch the latch 140 between the engaged and disengaged positions.

The manner in which the latch 140 is switched between engagement and disengagement may vary in different embodiments. In some embodiments, the connector 144 of each latch 140 may include a handle or other structure that may be manually manipulated by-hand. In other embodiments such as is shown in FIGS. 52A and 52B, buttons 130, 135 may be linked to the connector 144 of each latch 140 such that the buttons 130, 135 are operable to engage and/or disengage the latch 140 to and/or from a corresponding striker 142.

Figure 52A:
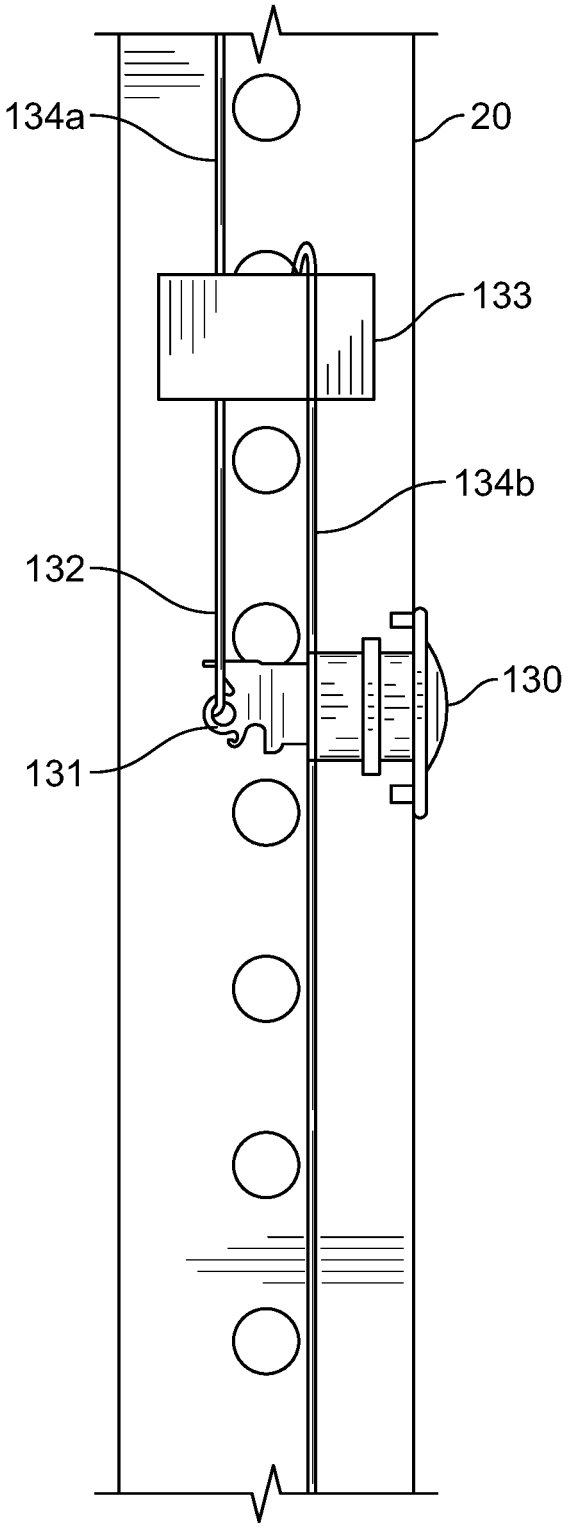
FIG. 52A is a frontal view of a button and cables operable to control the latching system of a retractable exercise rack system in accordance with an example embodiment.
Figure 52B:
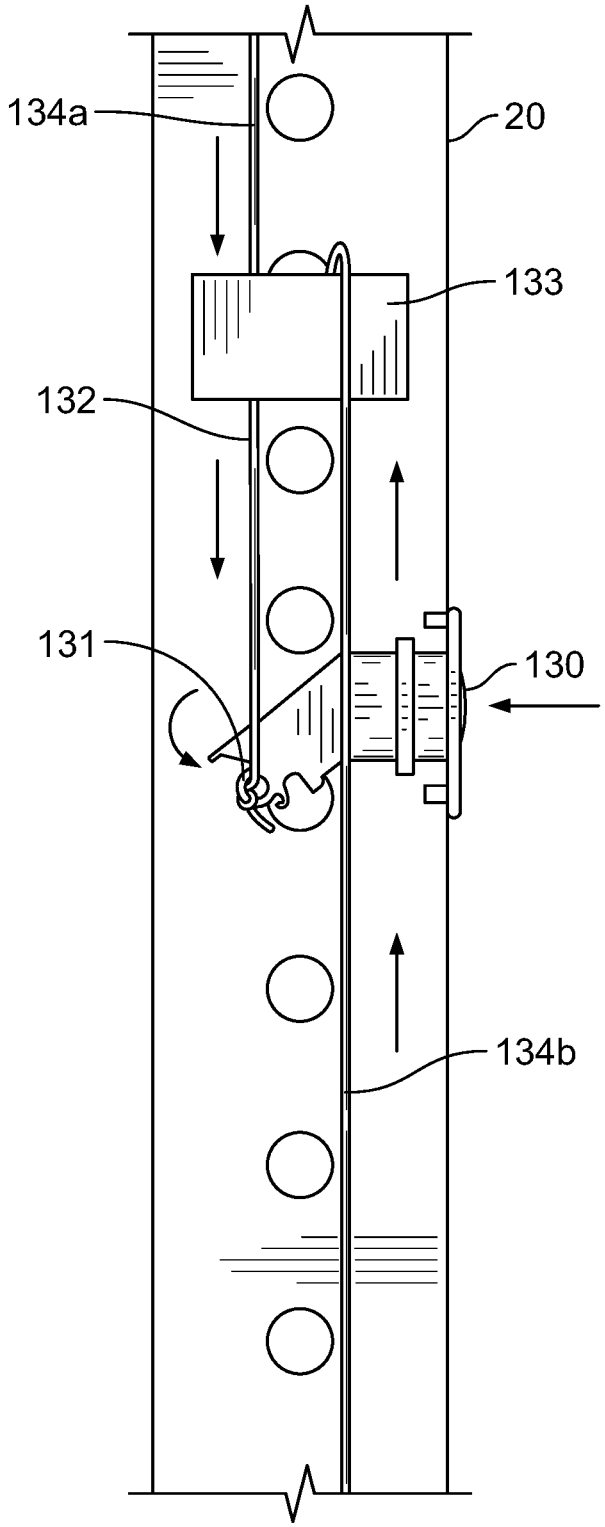
FIG. 52B is a frontal view of a depressed button and adjusted cables operable to control the latching system of a retractable exercise rack system in accordance with an example embodiment.

As shown in FIGS. 52A and 52B, the buttons 130, 135 may be connected to or integral with an eyelet 131 such that pressing the button 130, 135 is operable to pivot or rotate the eyelet 131. An in cable 132 is connected to the eyelet 131 at a first end and to a splitter 133 at a second end. A pair of out cables 134*a*, 134*b* extend from the splitter 133, with the first out cable 134*a* being connected to a first latch 140 and the second out cable 134*b* being connected to a second latch 140.

When the button 130, 135 is pressed inwardly as shown in FIG. 52B, the eyelet 131 pivots downwardly to pull on the in cable 132. The splitter 133 translates this force to the out cables 134*a*, 134*b* such that both of the out cables 134*a*, 134*b* are pulled when the button 130, 135 is depressed. The distal ends of each of the out cables 134*a*, 134*b* may be connected to a connector 144 of a corresponding latch 140 such that the pulling of the out cables 134*a*, 134*b* pivots the latch 140 into the disengaged position to release a corresponding striker 142.

Figure 3:
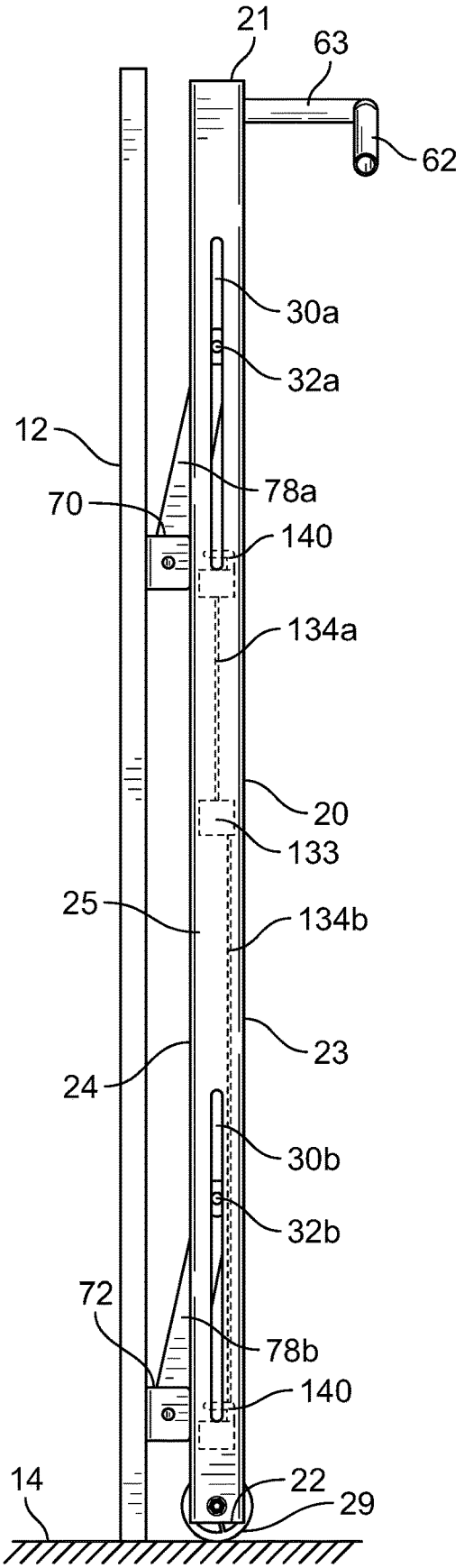
FIG. 3 is a side view of a retractable exercise rack system in a retracted position in accordance with an example embodiment.
Figure 4:
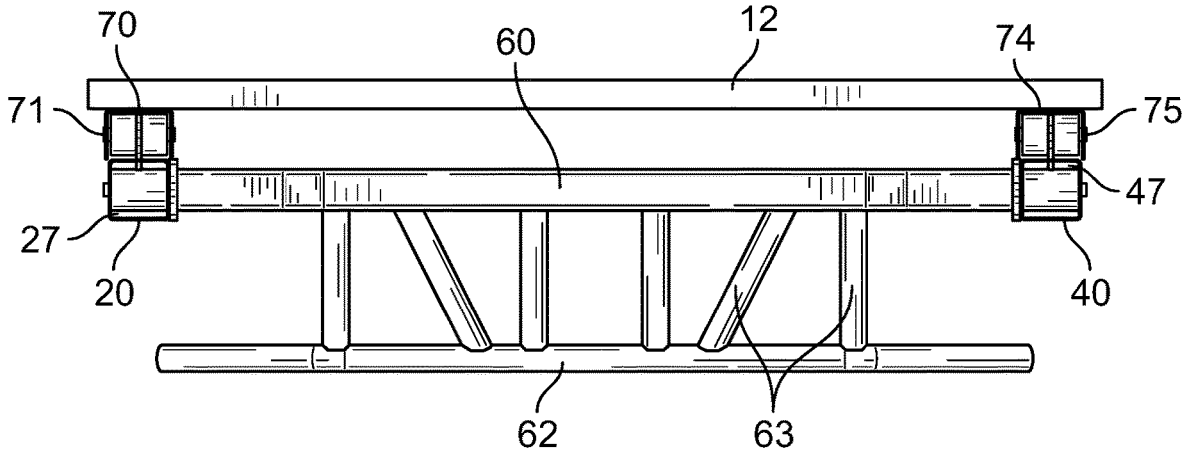
FIG. 4 is a top view of a retractable exercise rack system in a retracted position in accordance with an example embodiment.
Figure 7:
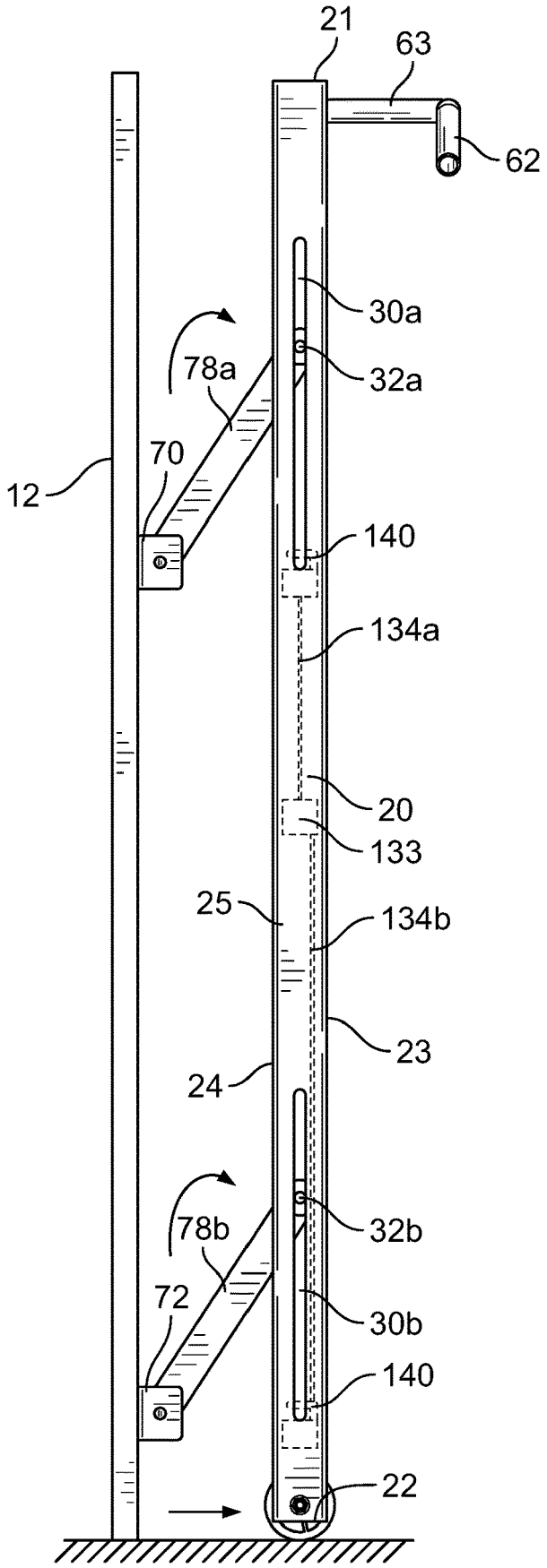
FIG. 7 is a side view of a retractable exercise rack system between positions in accordance with an example embodiment.
Figure 8:
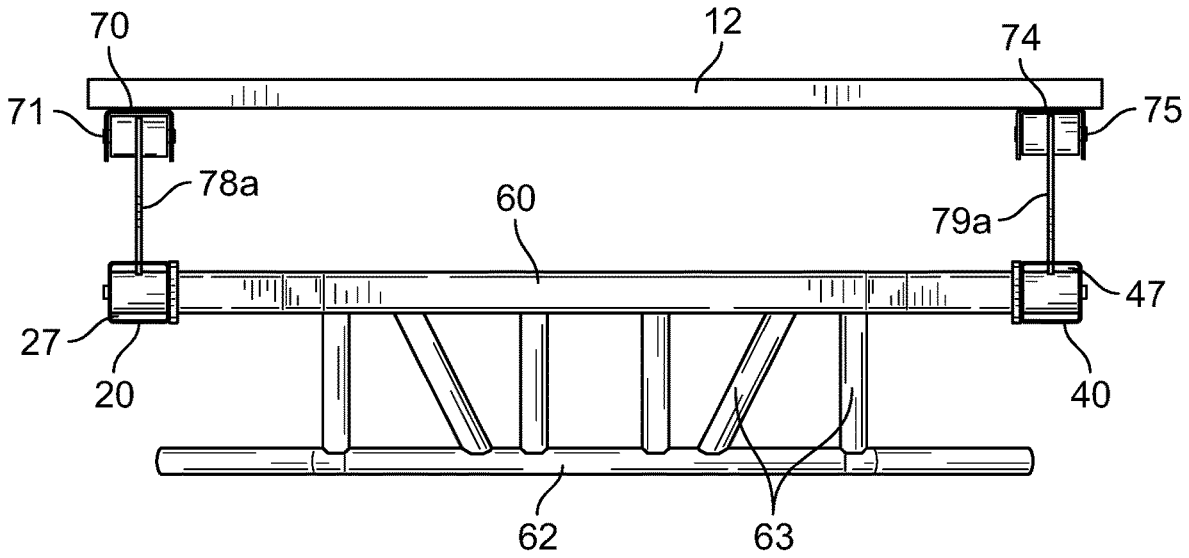
FIG. 8 is a top view of a retractable exercise rack system between positions in accordance with an example embodiment.
Figure 11:
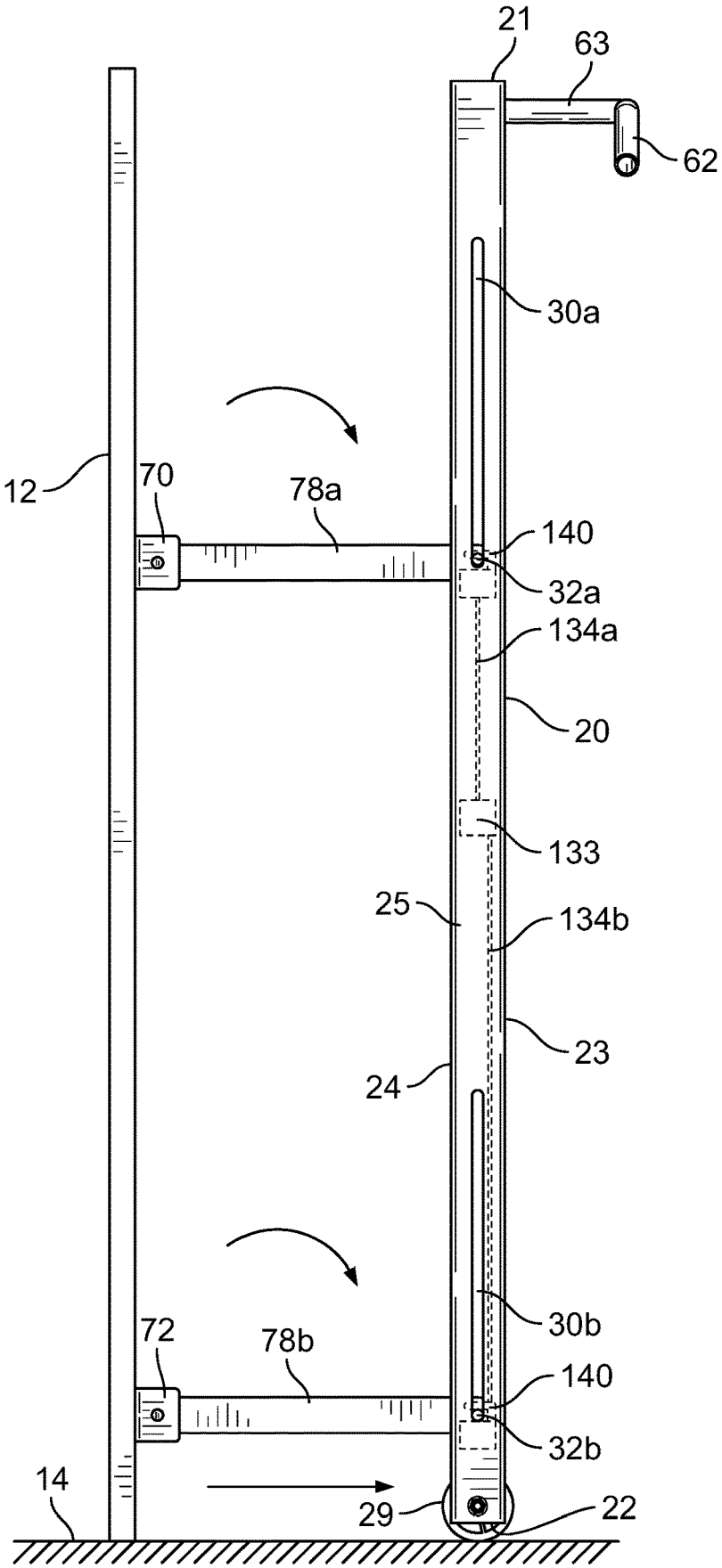
FIG. 11 is a side view of a retractable exercise rack system in an extended position in accordance with an example embodiment.
Figure 12:
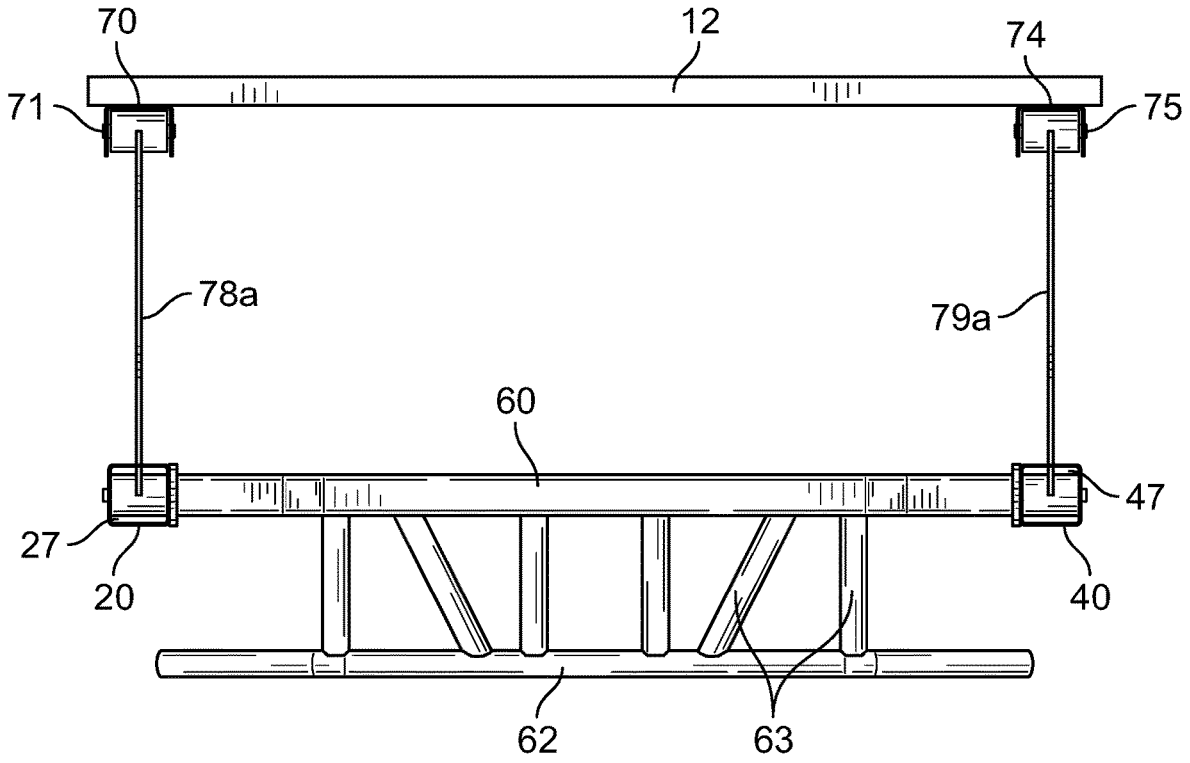
FIG. 12 is a top view of a retractable exercise rack system in an extended position in accordance with an example embodiment.
Figure 25:
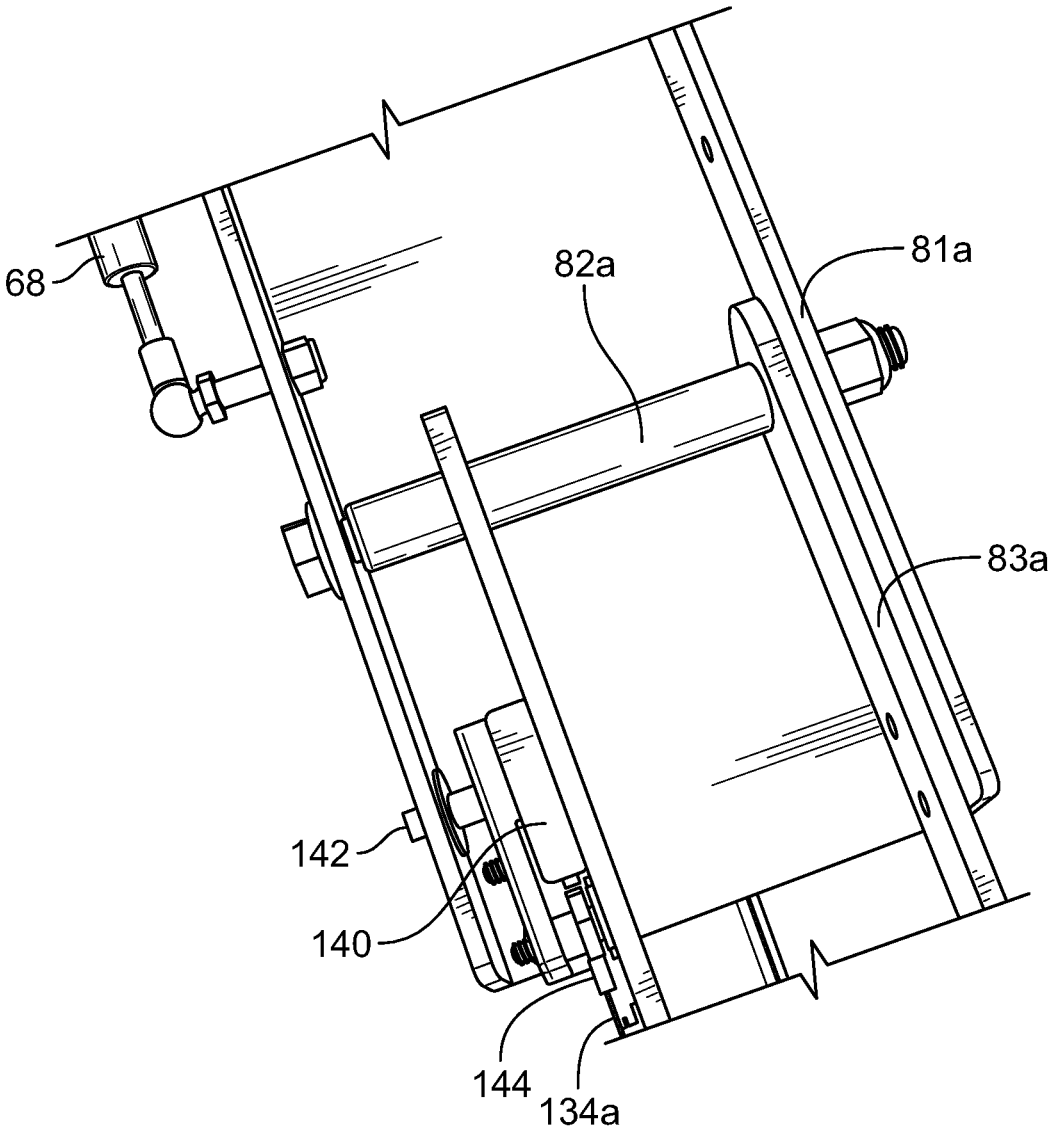
FIG. 25 is an upper view of a latching system of a retractable exercise rack system in accordance with an example embodiment.
Figure 38:
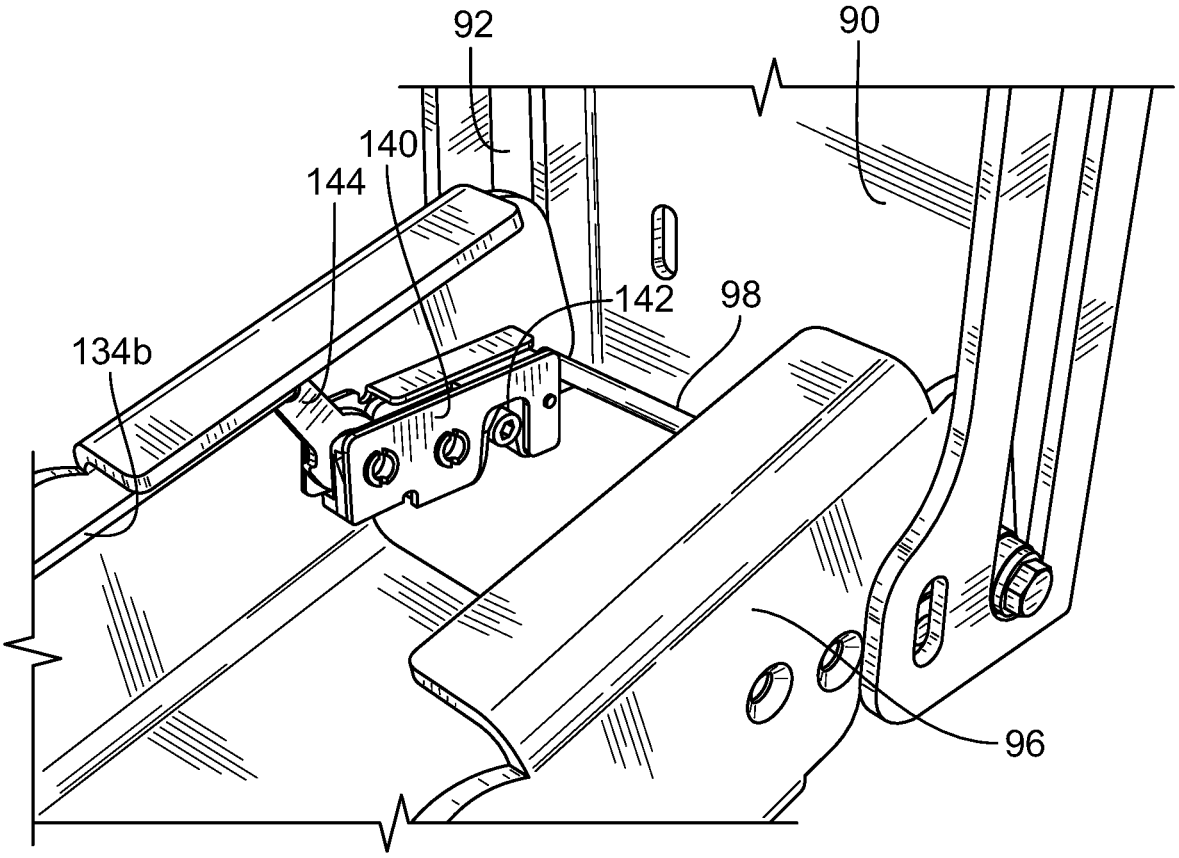
FIG. 38 is a perspective view of a latching system of a retractable exercise rack system in accordance with an example embodiment.
Figure 51:
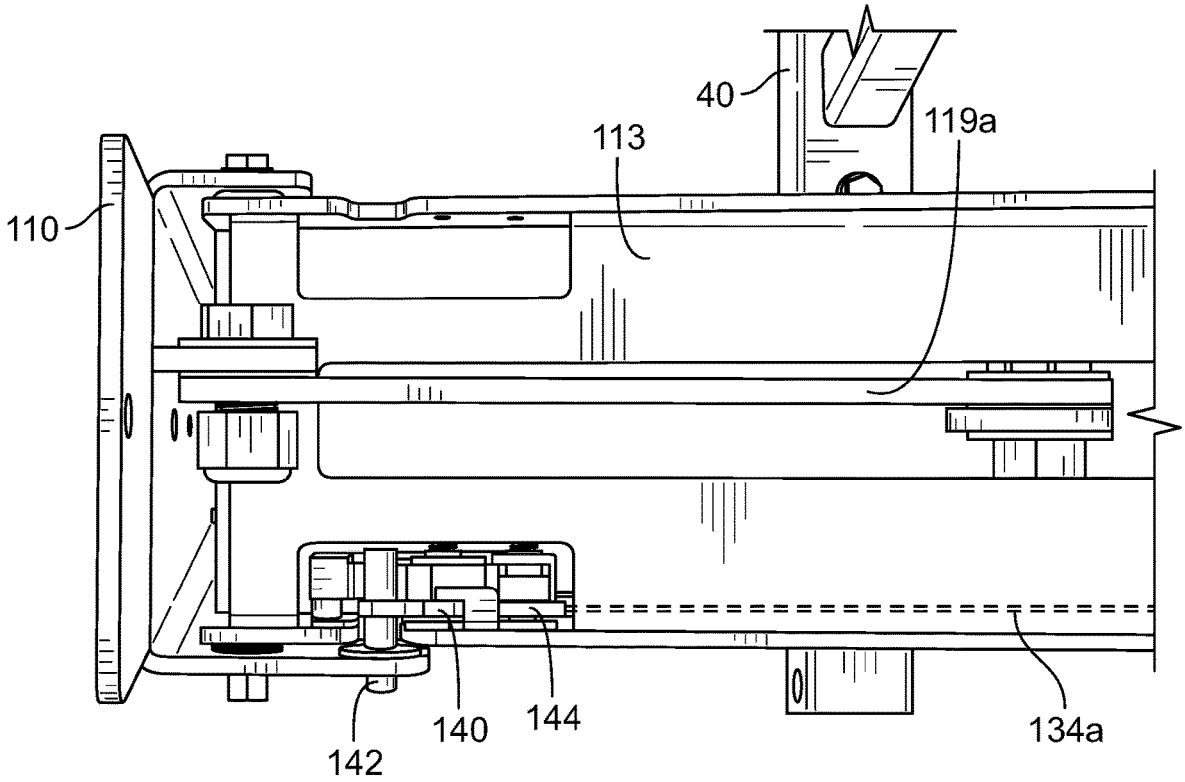
FIG. 51 is a side view of a latching system of a retractable exercise rack system in accordance with an example embodiment.

FIGS. 3, 7, and 11 illustrate interconnections between the out cables 134*a*, 134*b* and a pair of latches 140 in a first exemplary embodiment. FIG. 25 illustrates interconnection between an out cable 134*a* and a first latch 140 in a second exemplary embodiment. FIG. 38 illustrates interconnection between an out cable 134*b* and a latch 140 in a third exemplary embodiment. FIG. 51 illustrates interconnection between an out cable 134*a* and a latch 140 in a fourth exemplary embodiment. The positioning of the latches 140, buttons 130, 135, strikers 142, and splitters 133 may vary in different embodiments as discussed herein.

C. First Exemplary Embodiment (FIGS. 1-12)

FIGS. 1-12 illustrate a first exemplary embodiment of a retractable exercise rack system. FIGS. 1-4 illustrate such an exemplary embodiment in a first, retracted position against or near a wall 12. FIGS. 5-8 illustrate an exemplary embodiment as it is being adjusted between positions. FIGS. 9-12 illustrate an exemplary embodiment in a second, extended position which is distally-spaced from the wall 12.

As shown in FIGS. 1-12, the first exemplary embodiment generally includes a pair of support members 20, 40 which are parallel to each other and distally-spaced. The distance between the first and second support members 20, 40 may vary in different embodiments to suit different exercise spaces or exercisers. A cross support 60 is shown extending between a point near the upper ends 21, 41 of the respective support members 20, 40.

As best shown in FIGS. 2, 6, 10, and 14, the front side 23 of the first support member 20 includes a column of front openings 28 and the front side 43 of the second support member 20 includes a column of front openings 48. The front openings 48 may be utilized for attaching various exercise attachments as needed to perform a wide range of exercises. Each of the first and second support members 20, 40 are also shown as including a wheel 29, 49 rotatably connected to their respective lower ends 22, 42. The wheels 29, 49 are adapted to traverse a ground surface 14 underlying the first and second support members 20, 40 as the first and second support members 20, 40 are adjusted between the retracted and extended positions in either direction.

Figure 5:
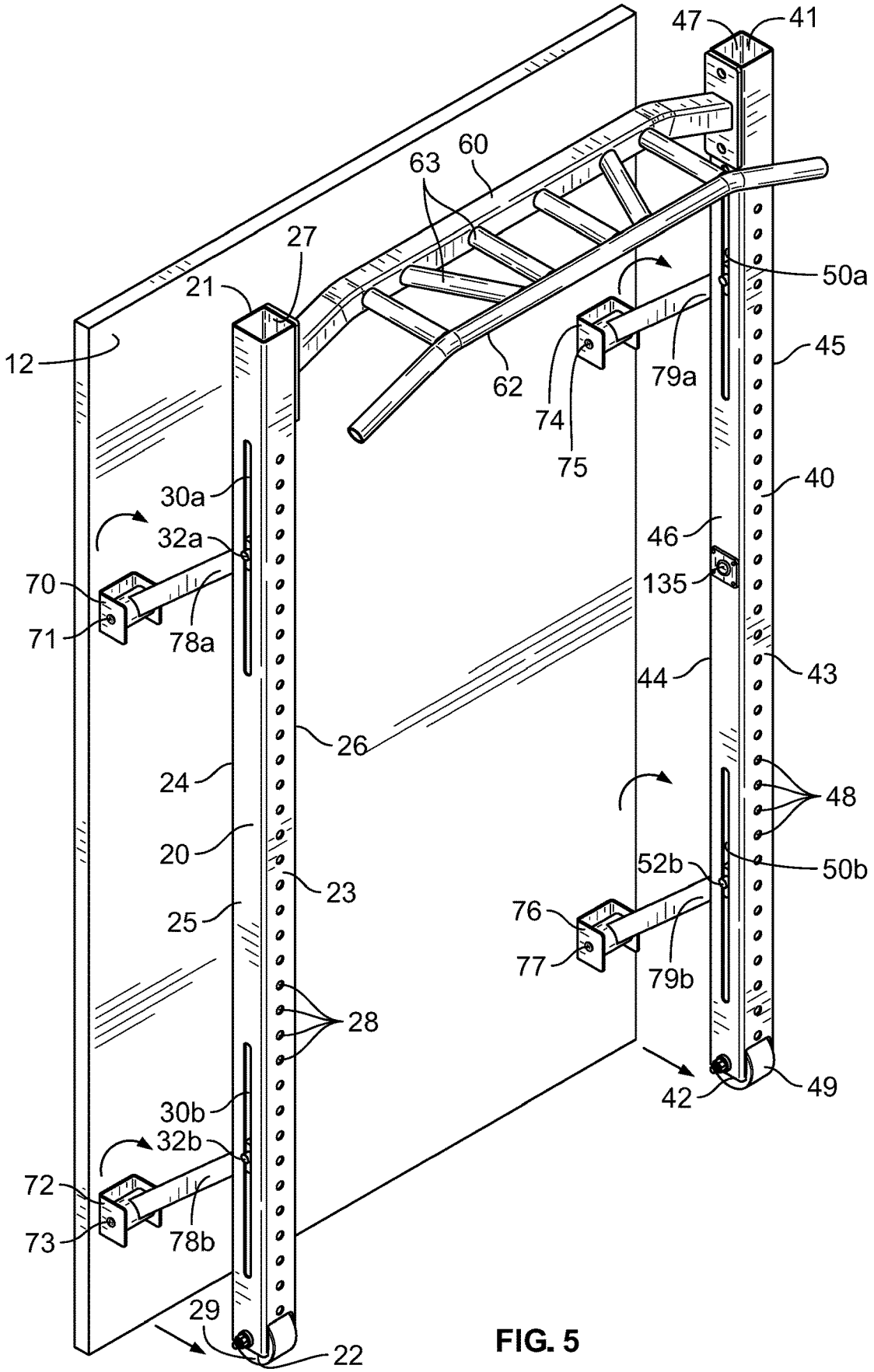
FIG. 5 is a perspective view of a retractable exercise rack system between positions in accordance with an example embodiment.
Figure 6:
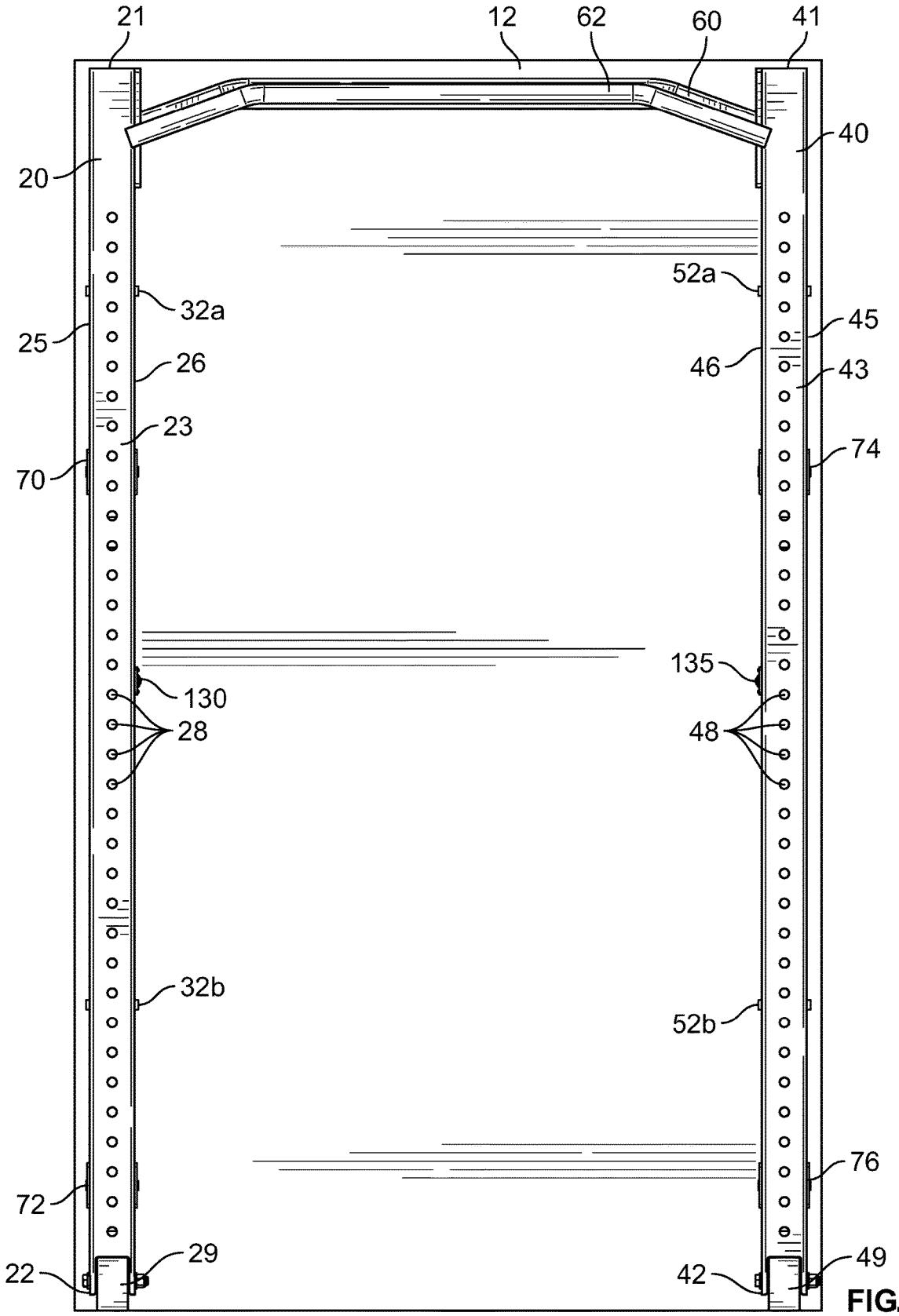
FIG. 6 is a front view of a retractable exercise rack system between positions in accordance with an example embodiment.
Figure 9:
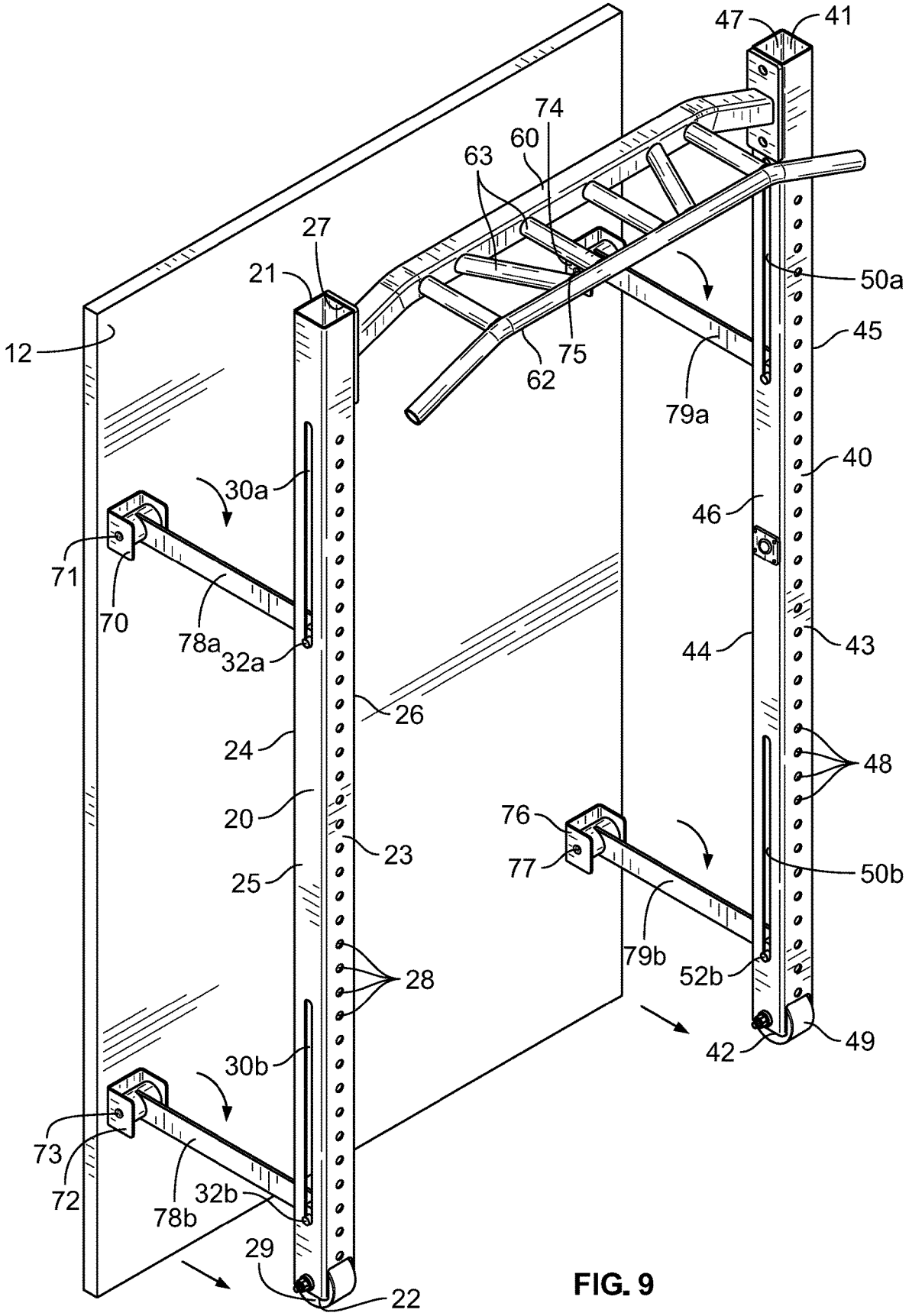
FIG. 9 is a perspective view of a retractable exercise rack system in an extended position in accordance with an example embodiment.
Figure 10:
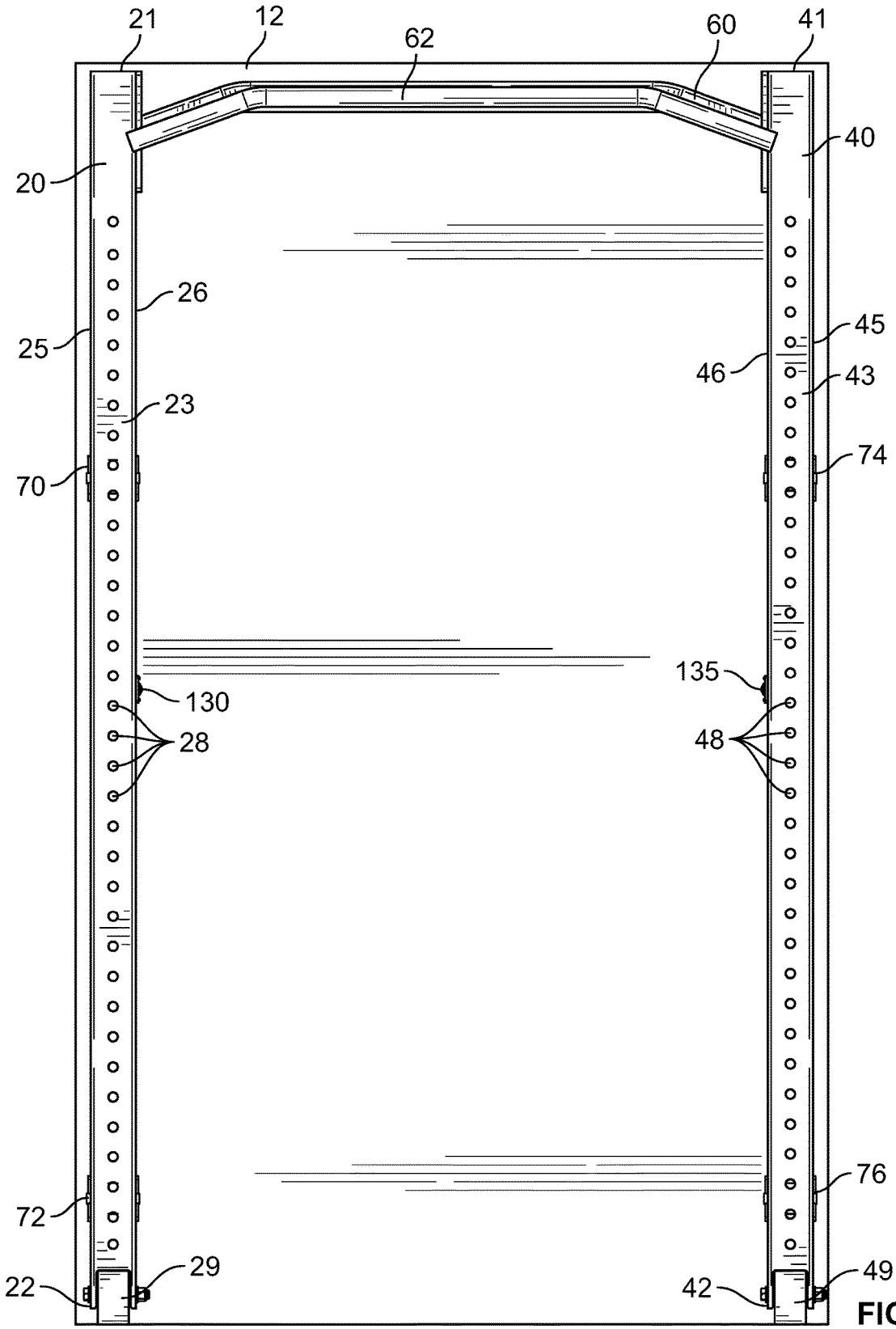
FIG. 10 is a front view of a retractable exercise rack system in an extended position in accordance with an example embodiment.

As best shown in FIGS. 1, 5, and 9, a plurality of wall mounts 70, 72, 74, 76 may be utilized to secure the first and second support members 20, 40 to a horizontal surface such as a wall 12. In the exemplary embodiment shown in FIG. 3, it can be seen that the first support member 20 is secured to the wall 12 by a first upper wall mount 70 and a first lower wall mount 72. Similarly, the second support member 40 is secured to the wall 12 by a second upper wall mount 74 and a second lower wall mount 76.

The manner in which the wall mounts 70, 72, 74, 76 are secured to the wall 12 may vary in different embodiments. By way of example and without limitation, the wall mounts 70, 72, 74, 76 may be secured to the wall 12 by fasteners, adhesives, magnets, and the like. Additionally, the type of wall mounts 70, 72, 74, 76 utilized may vary in different embodiments. In the exemplary embodiment shown in the figures, each of the wall mounts 70, 72, 74, 76 is shown as comprising a bracket-like structure having a U-shaped design including a rear member and a pair of side members extending perpendicularly from each side of the rear member, with the rear member being secured to the wall 12.

As best shown in FIGS. 1, 5, and 9, each of the wall mounts 70, 72, 74, 76 includes a pivot member 71, 73, 75, 77 which is pivotably or rotatably connected to the wall mounts 70, 72, 74, 76. As illustrated, the first upper wall mount 70 may include a first upper pivot member 71, the first lower wall mount 72 may include a first lower pivot member 73, the second upper wall mount 74 may include a second upper pivot member 75, and the second lower wall mount 76 may include a second lower pivot member 77. Each of the pivot members 71, 73, 75, 77 may include a pin, rod, or other structure capable of rotating or pivoting with respect to each wall mount 70, 72, 74, 76.

The number of wall mounts 70, 72, 74, 76 may vary in different embodiments. While the figures illustrate that each support member 20, 40 includes a pair of wall mounts 70, 72, 74, 76, more or less wall mounts 70, 72, 74, 76 may be utilized for each support member 20, 40 in different embodiments. As a non-limiting example, the first support member 20 may in some embodiments be connected to only a single wall mount 70 and the second support member 40 may be connected to only a single wall mount 74. As a further non-limiting example, the first support member 20 could be connected to three or more wall mounts 70, 72 and the second support member 40 could be connected to three or more wall mounts 74, 76.

It should also be appreciated that the positioning of the wall mounts 70, 72, 74, 76 with respect to the first and second support members 20, 40 may vary in different embodiments. In the exemplary embodiment shown in the figures, the first support member 20 rests against the first upper and lower wall mounts 70, 72 and the second support member 40 rests against the second upper and lower wall mounts 74, 76 when in the retracted position. However, in some embodiments, the first and second support members 20, 40 may be shaped so as to pass over the respective wall mounts 70, 72, 74, 76 and press directly against the wall 12. Thus, the rear sides 24, 44 of the respective support members 20, 40 may in some embodiments includes slots or openings into which the respective wall mounts 70, 72, 74, 76 may be inserted when the support members 20, 40 are in the retracted position.

As best shown in FIGS. 1, 5, and 9, each of the wall mounts 70, 72, 74, 76 may be connected to a respective support member 20, 40 by one or more linkages 78*a*, 78*b*, 79*a*, 79*b*. Each of the linkages 78*a*, 78*b*, 79*a*, 79*b* may comprise an elongated member such as a rod, bar, or the like which is connected between the wall mounts 70, 72, 74, 76 and one of the support members 20, 40.

In the exemplary embodiment shown in the figures, the first support member 20 is connected to the first upper wall mount 70 by a first linkage 78*a* and to the first lower wall mount 72 by a second linkage 78*b*. Similarly, the second support member 40 is connected to the second upper wall mount 74 by a first linkage 79*a* and to the second lower wall mount 76 by a second linkage 79*b*.

As best shown in FIGS. 3, 7, and 11, it can be seen that a first linkage 78*a* is connected between the first upper wall mount 70 and the first support member 20. The first linkage 78*a* may be connected to or integrally formed at its first end with the first upper pivot member 71 which is pivotably connected to the first upper wall mount 70. The first linkage 78*a* may be connected at its second end to the first support member 20 as discussed herein.

The second linkage 78*b* is connected between the first lower wall mount 72 and the first support member 20. The second linkage 78*b* may be connected to or integrally formed at its first end with the first lower pivot member 73 which is pivotably connected to the first lower wall mount 72. The second linkage 78*b* may be connected at its second end to the first support member 20 as discussed herein.

The first linkage 79*a* is connected between the second upper wall mount 74 and the second support member 40. The first linkage 79*a* may be connected to or integrally formed at its first end with the second upper pivot member 75 which is pivotably connected to the second upper wall mount 74. The first linkage 79*a* may be connected at its second end to the second support member 40 as discussed herein.

The second linkage 79*b* is connected between the second lower wall mount 76 and the second support member 40. The second linkage 79*b* may be connected to or integrally formed at its first end with the second lower pivot member 77 which is pivotably connected to the second lower wall mount 76. The second linkage 79*b* may be connected at its second end to the second support member 40 as discussed herein.

The manner in which each of the linkages 78*a*, 78*b*, 79*a*, 79*b* are connected to the respective support members 20, 40 may vary in different embodiments. In the exemplary embodiment best shown in FIGS. 1, 5, and 9, it can be seen that each of the linkages 78*a*, 78*b*, 79*a*, 79*b* includes or is connected to a slide pin 32*a*, 32*b*, 52*a*, 52*b* which is adapted to slide within one or more slots 30*a*, 30*b*, 50*a*, 50*b* formed within the support members 20, 40.

As best shown in FIG. 1, the first support member 20 may include one or more slots 30*a* positioned near an upper end 21 of the first support member 20. Although only a first upper slot 30*a* positioned on the outer side 25 of the first support member 20 is shown in the figures, it should be appreciated that an upper inner slot may also be positioned on the opposite, inner side 26 of the first support member 20 in alignment with the first upper slot 30*a*.

The first upper slide pin 32*a* of the first linkage 78*a* may be slidably connected within the one or more first upper slots 30*a* of the first support member 20 such that the first upper slide pin 32*a* may slide within the one or more first upper slots 30*a* when the first support member 20 is being adjusted between positions. FIG. 1 illustrates the first support member 20 in its retracted position, with the first upper slide pin 32*a* being positioned at the upper terminus of the first upper slot 30*a*. As the first support member 20 is adjusted towards the extended position such as shown in FIG. 5, it can be seen that the slide pin 32*a* moves down within the first upper slot 30*a*. When the first support member 20 reaches the extended position as shown in FIG. 9, it can be seen that the slide pin 32*a* has reached the lower terminus of the first upper slot 30*a*.

The first support member 20 may include one or more slots 30*b* positioned near a lower end 22 of the first support member 20. Although only a first lower slot 30*b* positioned on the outer side 25 of the first support member 20 is shown in the figures, it should be appreciated that a lower inner slot may also be positioned on the opposite, inner side 26 of the first support member 20 in alignment with the first lower slot 30*b*.

The first lower slide pin 32*b* of the second linkage 78*b* may be slidably connected within the one or more first lower slots 30*b* of the first support member 20 such that the first lower slide pin 32*b* may slide within the one or more first lower slots 30*b* when the first support member 20 is being adjusted between positions. FIG. 1 illustrates the first support member 20 in its retracted position, with the first lower slide pin 32*b* being positioned at the upper terminus of the first lower slot 30*a*. As the first support member 20 is adjusted towards the extended position such as shown in FIG. 5, it can be seen that the slide pin 32*b* moves down within the first lower slot 30*b*. When the first support member 20 reaches the extended position as shown in FIG. 9, it can be seen that the slide pin 32*b* has reached the lower terminus of the first lower slot 30*b*.

The second support member 40 may include one or more slots 50*a* positioned near an upper end 41 of the second support member 40. Although only an second upper slot 50*a* positioned on the inner side 46 of the second support member 40 is shown in the figures, it should be appreciated that an upper outer slot may also be positioned on the opposite, outer side 45 of the second support member 40 in alignment with the second upper slot 50*a*.

The second upper slide pin 52*a* of the second linkage 79*a* may be slidably connected within the one or more second upper slots 50*a* of the second support member 40 such that the second upper slide pin 52*a* may slide within the one or more second upper slots 50*a* when the second support member 40 is being adjusted between positions. FIG. 1 illustrates the second support member 40 in its retracted position, with the second upper slide pin 52*a* being positioned at the upper terminus of the second upper slot 50*a*. As the second support member 40 is adjusted towards the extended position such as shown in FIG. 5, it can be seen that the slide pin 52*a* moves down within the second upper slot 50*a*. When the second support member 40 reaches the extended position as shown in FIG. 9, it can be seen that the slide pin 52*a* has reached the lower terminus of the second upper slot 50*a*.

The second support member 40 may include one or more slots 50*b* positioned near a lower end 42 of the second support member 40. Although only a second lower slot 50*b* positioned on the inner side 46 of the second support member 40 is shown in the figures, it should be appreciated that a lower outer slot may also be positioned on the opposite, outer side 45 of the second support member 40 in alignment with the second lower slot 50*b*.

The second lower slide pin 52*b* of the second linkage 79*b* may be slidably connected within the one or more second lower slots 50*b* of the second support member 40 such that the second lower slide pin 52*b* may slide within the one or more second lower slots 50*b* when the second support member 40 is being adjusted between positions. FIG. 1 illustrates the second support member 40 in its retracted position, with the second lower slide pin 52*b* being positioned at the upper terminus of the second lower slot 50*b*. As the second support member 40 is adjusted towards the extended position such as shown in FIG. 5, it can be seen that the slide pin 52*b* moves down within the second lower slot 50*b*. When the second support member reaches the extended position as shown in FIG. 9, it can be seen that the slide pin 52*b* has reached the lower terminus of the second lower slot 50*b*.

The first and second support members 20, 40 may be releasably locked in the extended position to ensure that the first and second support members 20, 40 do not move when exercises are being performed. The manner in which the first and second support members 20, 40 are locked and/or released from the extended position may vary in different embodiments. In the exemplary embodiment shown in FIGS. 1-12, a plurality of latches 140 may be utilized.

As best shown in FIGS. 3, 7, and 11, a latch 140 may be positioned at the lower terminus of each of the slots 30*a*, 30*b*, 50*a*, 50*b* so as to engage with and catch the slide pins 32*a*, 32*b*, 52*a*, 52*b* when the slide pins 32*a*, 32*b*, 52*a*, 52*b* reach the lower terminus of the slots 30*a*, 30*b*, 50*a*, 50*b*. Thus, a first latch 140 may be positioned at the lower terminus of the first upper slot 30*a*, a second latch 140 may be positioned at the lower terminus of the first lower slot 30*b*, a third latch 140 may be positioned at the lower terminus of the second upper slot 50*a*, and a fourth latch 140 may be positioned at the lower terminus of the second lower slot 50*b*.

Each latch 140 may be pivotable so as to catch each slide pin 32*a*, 32*b*, 52*a*, 52*b*. The slide pins 32*a*, 32*b*, 52*a*, 52*b* may function to pivot each latch 140 as the slide pins 32*a*, 32*b*, 52*a*, 52*b* pass each latch 140 so as to allow each latch 140 to engage with each of the slide pins 32*a*, 32*b*, 52*a*, 52*b*. When so engaged, each slide pin 32*a*, 32*b*, 52*a*, 52*b* is locked into position by a respective latch 140 until such time as each latch 140 is released to allow the slide pins 32*a*, 32*b*, 52*a*, 52*b* to freely slide upwardly within the respective slots 30*a*, 30*b*, 50*a*, 50*b*.

FIGS. 9-12 illustrate the first and second support members 20, 40 locked in the extended position. In such a position, each of the slide pins 32*a*, 32*b*, 52*a*, 52*b* is engaged by a latch 140 to prevent the first and second support members 20, 40 from moving (e.g., towards the retracted position) until desired by the exerciser. The manner in which the latches 140 are released may vary in different embodiments. In some embodiments, each latch 140 may be accessible to be manually released by an exerciser.

In the exemplary embodiment best shown in FIGS. 5, 6, 9, and 10, buttons 130, 135 may be utilized to release each latch 140. FIG. 3 illustrates that a first button 130 may be connected to the first support member 20 to release the first slide pins 32*a*, 32*b* and a second button 135 may be connected to the second support member 40 to release the second slide pins 52*a*, 52*b*. While the figures illustrate that the first button 130 is connected to the inner side 26 of the first support member 20 and that the second button 135 is connected to the inner side 46 of the second support member 40, it should be appreciated that the positioning of the buttons 130, 135 may vary in different embodiments. By way of non-limiting example, the buttons 130, 135 could instead be connected to the front sides 23, 43, rear sides 24, 44, or outer sides 25, 45 of the respective support members 20, 40 in some embodiments.

Each button 130, 135 may be connected to an eyelet 131. An in cable 132 may be connected to the eyelet 131 at its first end and to a splitter 133 at its second end. When the button 130, 135 is pressed inwardly such as shown in FIG. 52B, the eyelet 131 may pivot downwardly so as to pull on the in cable 132. The splitter 133 may include a pair of out cables 134*a*, 134*b*, with the first out cable 134*a* being connected to a first latch 140 and the second outer cable 134*b* being connected to a second latch 140. Thus, each the button 130, 135 is depressed, the first out cable 134*a* may pull the first latch 140 downwardly to disengage the upper slide pins 32*a*, 52*a* and the second outer cable 134*b* may pull the second latch 140 upwardly to disengage the lower slide pins 32*b*, 52*b*.

It should be appreciated that one or both of the first and second support members 20, 40 may be releasably locked by latches 140 in the extended position. In the embodiment shown in FIGS. 5, 6, 9, and 10, it can be seen that each of the first and second support members 20, 40 includes a button 130, 135 interconnected so as to release a latch 140. However, in some embodiments, only a single button 130 on one of the first or second support members 20, 40 may be utilized. Because the support members 20, 40 are linked to each other by the cross support 60 and/or exercise bar 62, locking one of the support members 20, 40 in an extended position functions to lock the other support member 20, 40 in the same position.

It should also be appreciated that, in some embodiments, the first and second support members 20, 40 may also be locked into the retracted position by latches 140. In such embodiments, the upper terminus of each of the slots 30*a*, 30*b*, 50*a*, 50*b* may also include a latch 140. However, in the embodiment shown in the figures, the first and second support members 20, 40 are naturally locked into the retracted position without the use of separate latches 140.

D. Second Exemplary Embodiment (FIGS. 13-25)

FIGS. 13-25 illustrate a second exemplary embodiment of a retractable exercise rack system. FIGS. 13-16 illustrate such an exemplary embodiment in a first, retracted position against or near a wall 12. FIGS. 17-20 illustrate such an exemplary embodiment as it is being adjusted between positions. FIGS. 21-24 illustrate such an exemplary in a second, extended position which is distally-spaced from the wall. FIG. 25 illustrates an exemplary latching system for releasably locking such an exemplary embodiment in the retracted and/or extended positions.

As shown in FIGS. 13-24, the second exemplary embodiment generally includes a pair of support members 20, 40 which are parallel to each other and distally-spaced. The distance between the first and second support members 20, 40 may vary in different embodiments to suit different exercise spaces or exercisers. A cross support 60 is shown extending between a point near the upper ends 21, 41 of the respective support members 20, 40.

Figure 14:
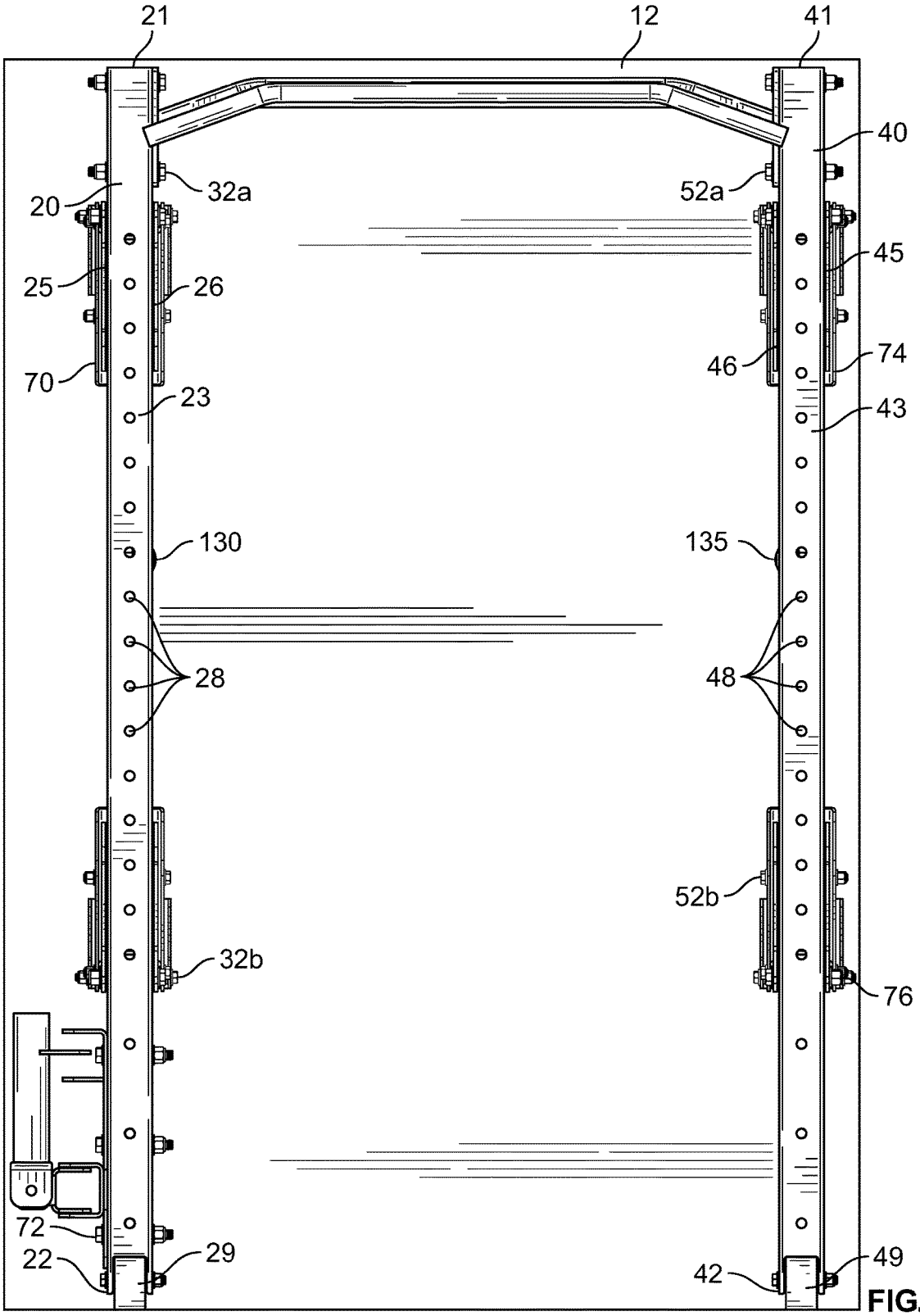
FIG. 14 is a front view of a retractable exercise rack system in a retracted position in accordance with an example embodiment.
Figure 15:
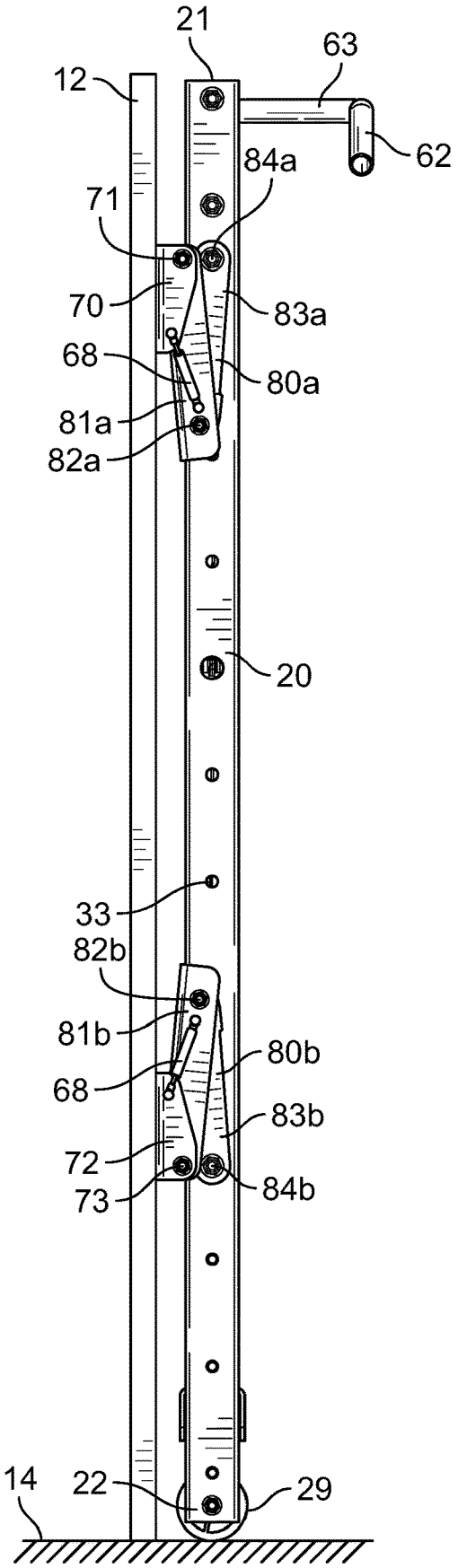
FIG. 15 is a side view of a retractable exercise rack system in a retracted position in accordance with an example embodiment.
Figure 16:
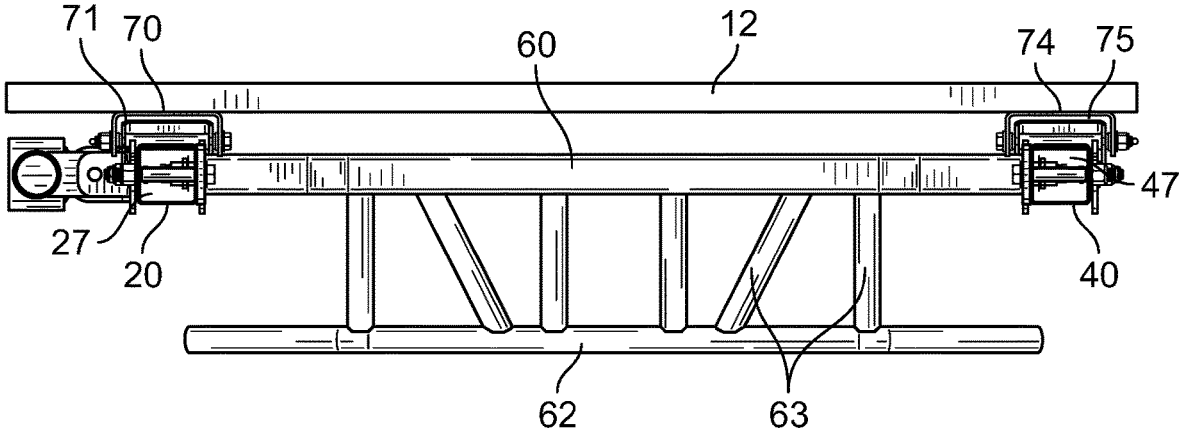
FIG. 16 is a top view of a retractable exercise rack system in a retracted position in accordance with an example embodiment.
Figure 18:
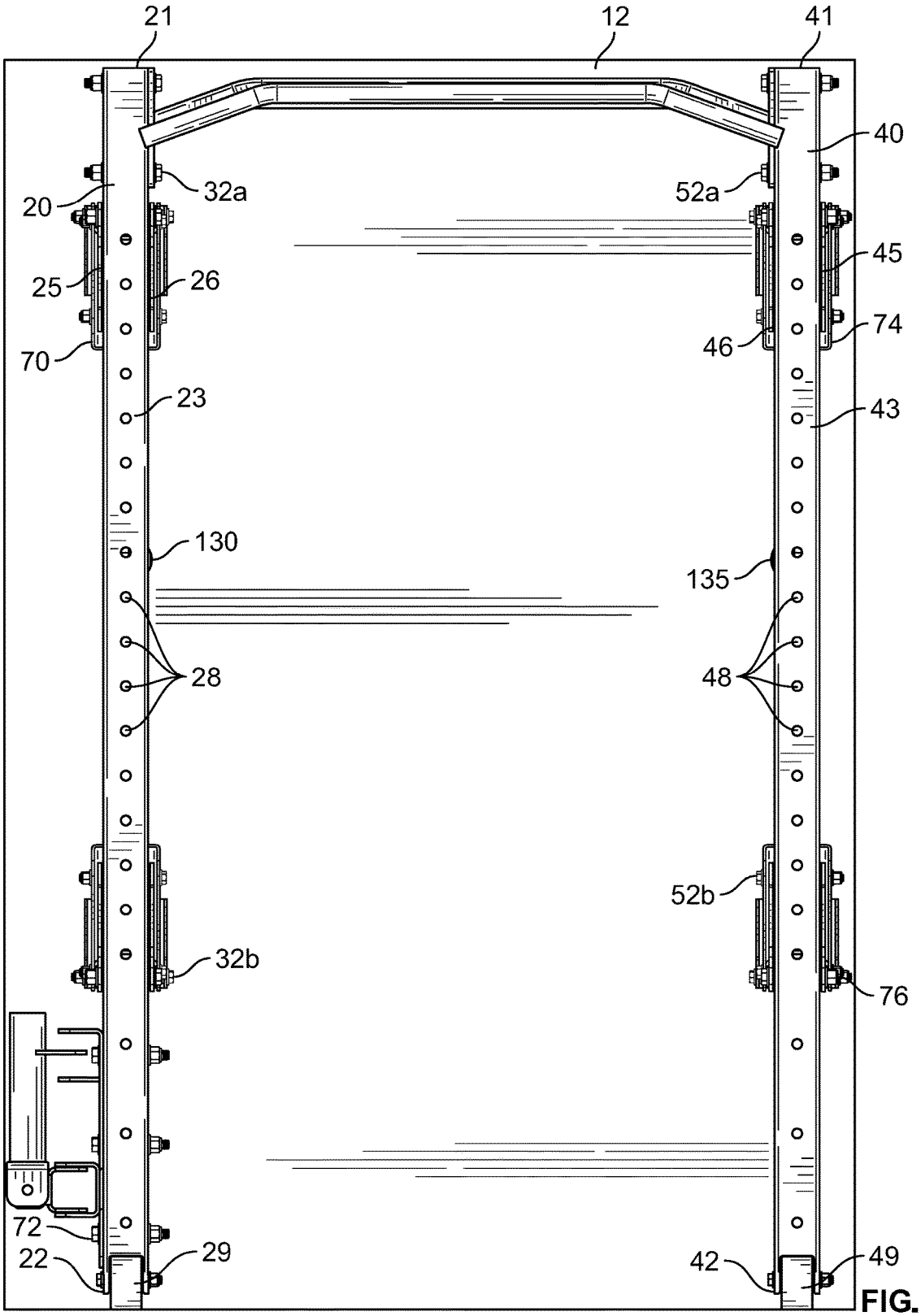
FIG. 18 is a front view of a retractable exercise rack system between positions in accordance with an example embodiment.
Figure 22:
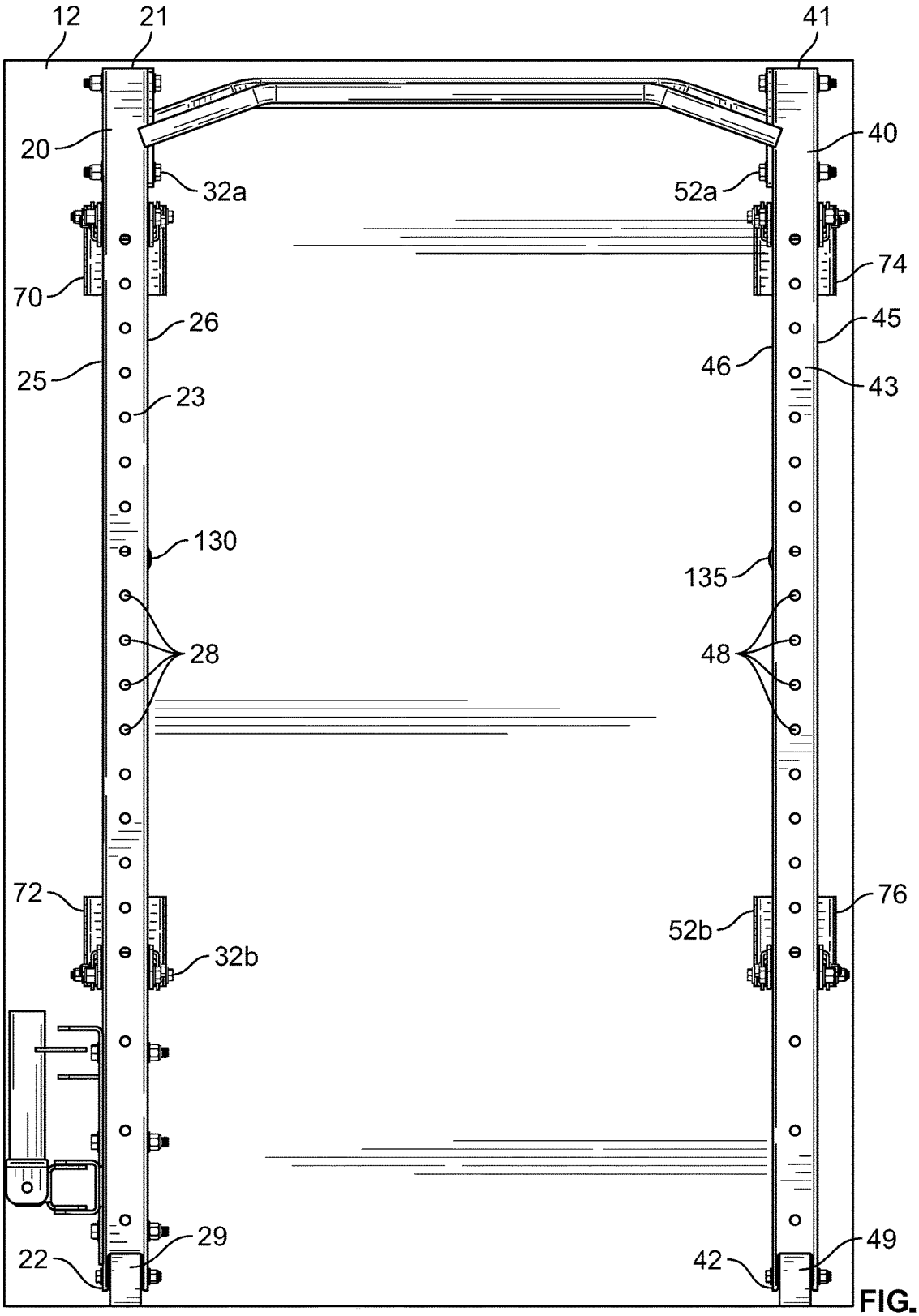
FIG. 22 is a front view of a retractable exercise rack system in an extended position in accordance with an example embodiment.
Figure 23:
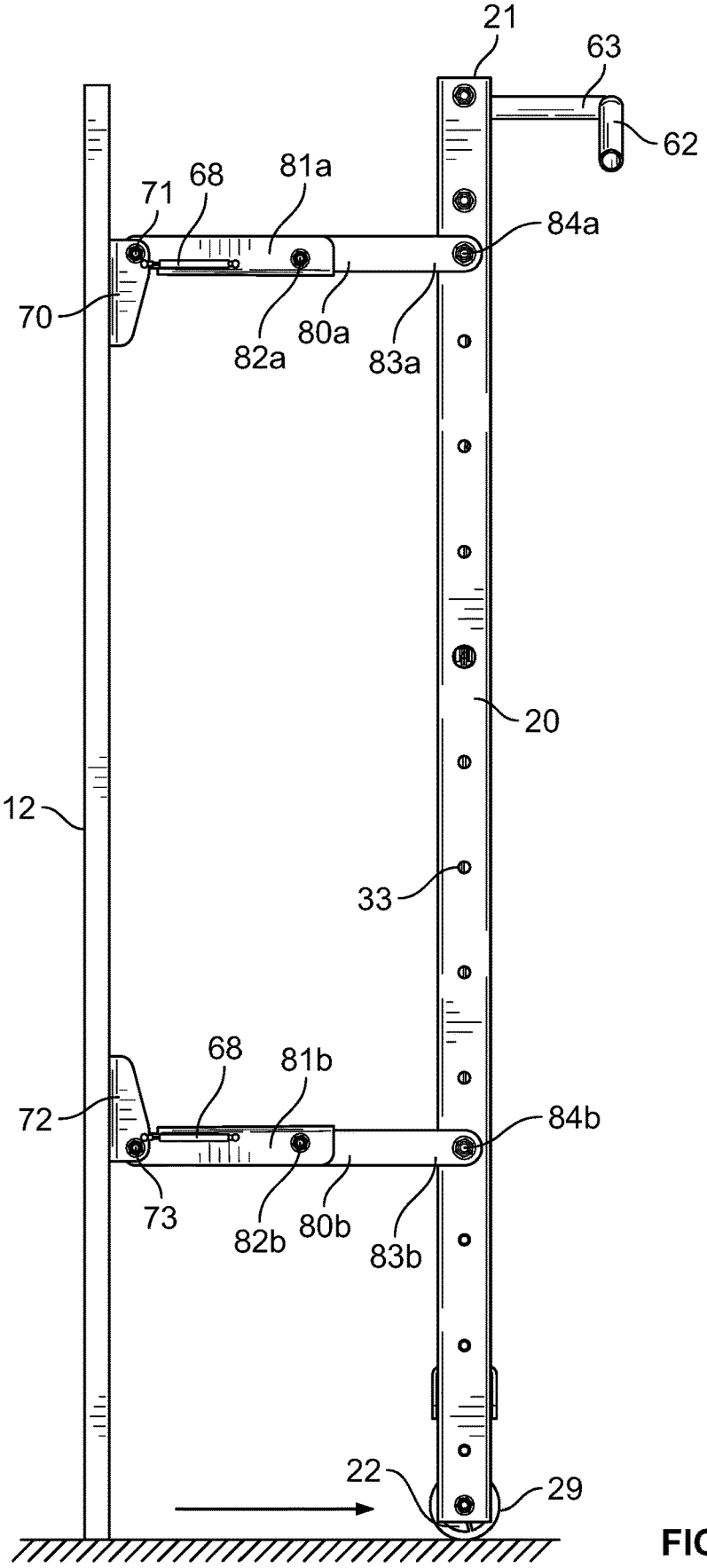
FIG. 23 is a side view of a retractable exercise rack system in an extended position in accordance with an example embodiment.
Figure 24:
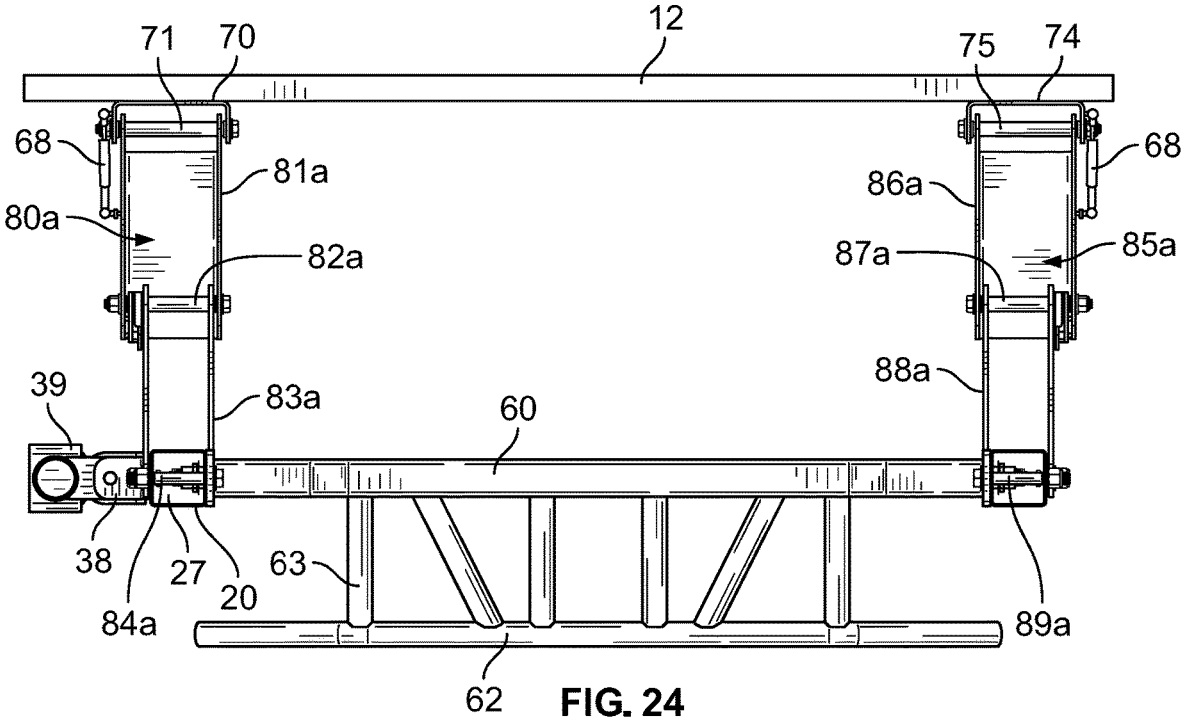
FIG. 24 is a top view of a retractable exercise rack system in an extended position in accordance with an example embodiment.

As best shown in FIGS. 14, 18, and 22, the front side 23 of the first support member 20 includes a column of front openings 28 and the front side 43 of the second support member 20 includes a column of front openings 48. The front openings 48 may be utilized for attaching various exercise attachments as needed to perform a wide range of exercises. Additionally, each of the support members 20, 40 may include additional openings 33, 54 along their respective outer and/or inner sides 25, 26 which may be utilized both to attach various exercise attachments, and to attach scissor connectors 80*a*, 80*b*, 85*a*, 85*b* as discussed herein.

Each of the first and second support members 20, 40 are also shown as including a wheel 29, 49 rotatably connected to their respective lower ends 22, 42. The wheels 29, 49 are adapted to traverse a ground surface 14 underlying the first and second support members 20, 40 as the first and second support members 20, 40 are adjusted between the retracted and extended positions in either direction.

As best shown in FIGS. 13-24, a plurality of wall mounts 70, 72, 74, 76 may be utilized to secure the first and second support members 20, 40 to a horizontal surface such as a wall 12. In the exemplary embodiment shown in FIG. 19, it can be seen that the first support member 20 is secured to the wall 12 by a first upper wall mount 70 and a first lower wall mount 72. Similarly, the second support member 40 is secured to the wall 12 by a second upper wall mount 74 and a second lower wall mount 76.

The manner in which the wall mounts 70, 72, 74, 76 are secured to the wall 12 may vary in different embodiments. By way of example and without limitation, the wall mounts 70, 72, 74, 76 may be secured to the wall 12 by fasteners, adhesives, magnets, and the like. Additionally, the type of wall mounts 70, 72, 74, 76 utilized may vary in different embodiments. In the exemplary embodiment shown in the figures, each of the wall mounts 70, 72, 74, 76 is shown as comprising a bracket-like structure having a U-shaped design including a rear member and a pair of side members extending perpendicularly from each side of the rear member, with the rear member being secured to the wall 12.

As best shown in FIGS. 13-24, each of the wall mounts 70, 72, 74, 76 includes a pivot member 71, 73, 75, 77 which is pivotably or rotatably connected to the wall mounts 70, 72, 74, 76. As illustrated, the first upper wall mount 70 may include a first upper pivot member 71, the first lower wall mount 72 may include a first lower pivot member 73, the second upper wall mount 74 may include a second upper pivot member 75, and the second lower wall mount 76 may include a second lower pivot member 77. Each of the pivot members 71, 73, 75, 77 may include a pin, rod, or other structure capable of rotating or pivoting with respect to each wall mount 70, 72, 74, 76.

The number of wall mounts 70, 72, 74, 76 may vary in different embodiments. While the figures illustrate that each support member 20, 40 includes a pair of wall mounts 70, 72, 74, 76, more or less wall mounts 70, 72, 74, 76 may be utilized for each support member 20, 40 in different embodiments. As a non-limiting example, the first support member 20 may in some embodiments be connected to only a single wall mount 70 and the second support member 40 may be connected to only a single wall mount 74. As a further non-limiting example, the first support member 20 could be connected to three or more wall mounts 70, 72 and the second support member 40 could be connected to three or more wall mounts 74, 76.

It should also be appreciated that the positioning of the wall mounts 70, 72, 74, 76 with respect to the first and second support members 20, 40 may vary in different embodiments. In the exemplary embodiment shown in the figures, the first support member 20 rests against the first upper and lower wall mounts 70, 72 and the second support member 40 rests against the second upper and lower wall mounts 74, 76 when in the retracted position. However, in some embodiments, the first and second support members 20, 40 may be shaped so as to pass over the respective wall mounts 70, 72, 74, 76 and press directly against the wall 12. Thus, the rear sides 24, 44 of the respective support members 20, 40 may in some embodiments includes slots or openings into which the respective wall mounts 70, 72, 74, 76 may be inserted when the support members 20, 40 are in the retracted position.

As shown in FIGS. 13-24, each of the wall mounts 70, 72, 74, 76 may be connected to a respective support member 20, 40 by one or more scissor connectors 80*a*, 80*b*, 85*a*, 85*b*. Each of the scissor connectors 80*a*, 80*b*, 85*a*, 85*b* may be comprised of a first arm 81*a*, 81*b*, 86*a*, 86*b* and a second arm 83*a*, 83*b*, 88*a*, 88*b*, with each first arm 81*a*, 81*b*, 86*a*, 86*b* being pivotably connected at its first end to a wall mount 70, 72, 74, 76 and at its second end to a second arm 83*a*, 83*b*, 88*a*, 88*b*. Each second arm 83*a*, 83*b*, 88*a*, 88*b* may be pivotably connected at its first end to a first arm 81*a*, 81*b*, 86*a*, 86*b* and at its second end to a support member 20, 40.

As shown in FIGS. 13-24, the support members 20, 40 may include openings 33, 54 on their respective outer and/or inner sides 25, 26, 45, 46 to which the scissor connectors 80*a*, 80*b*, 85*a*, 85*b* may be connected, such as by the use of pivot members 84*a*, 84*b*, 89*a*, 89*b* such as fasteners or the like.

In the exemplary embodiment shown in the figures, the first support member 20 is connected to the upper wall mount 70 by a first upper connector 80*a* and to the first lower wall mount 72 by a first lower scissor connector 80*b*. Similarly, the second support member 40 is connected to the second upper wall mount 74 by a second upper scissor connector 85*a* and to the second lower wall mount 76 by a second lower scissor connector 85*b*.

As best shown in FIGS. 13-24, it can be seen that a first upper scissor connector 80*a* is connected between the first upper wall mount 70 and the first support member 20. The first upper scissor connector 80*a* will generally be comprised of a first arm 81*a* and a second arm 83*a*. The first arm 81*a* of the first upper scissor connector 80*a* may be pivotably connected at its first end to the first upper wall mount 70 and at its second end to the second arm 83*a*. The second arm 83*a* of the first upper scissor connector 80*a* may be pivotably connected at its first end to the first arm 81*a* and at its second end to the first support member 20.

Figure 19:
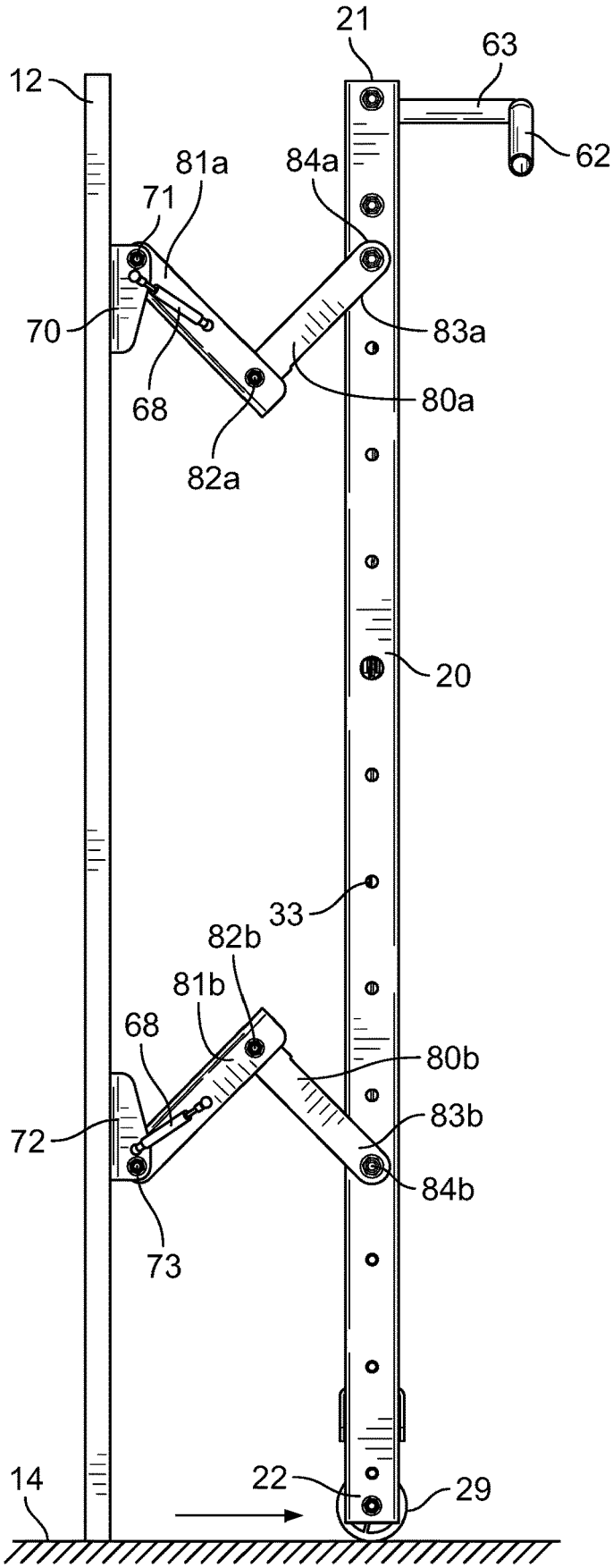
FIG. 19 is a side view of a retractable exercise rack system between positions in accordance with an example embodiment.
Figure 20:
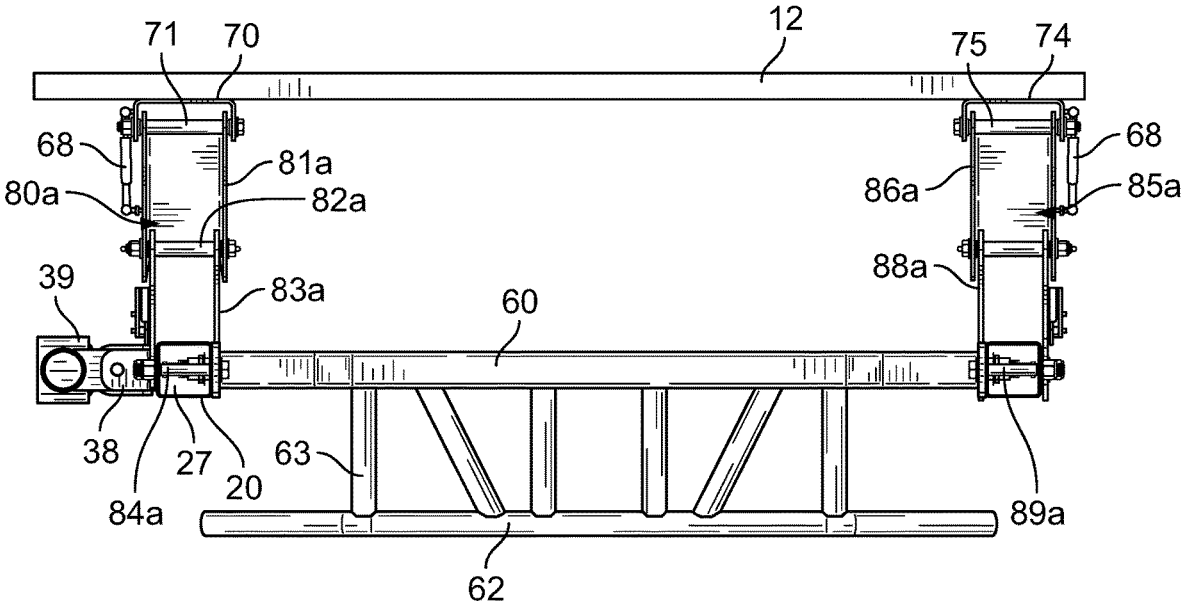
FIG. 20 is a top view of a retractable exercise rack system between positions in accordance with an example embodiment.

As best shown in FIG. 19, the pivotable connection between the first arm 81*a* and the first upper wall mount 70 may utilize a first upper pivot member 71. The pivotable connection between the first arm 81*a* and the second arm 83*a* may utilize a first upper pivot member 82*a*. The pivotable connection between the second arm 83*a* and the first support member 20 may utilize a first upper pivot member 84*a*. Such pivot members 71, 82*a*, 84*a* may comprise various structures, such as but not limited to fasteners, pins, rods, and the like.

As best shown in FIGS. 13-24, it can be seen that a first lower scissor connector 80*b* is connected between the first lower wall mount 72 and the first support member 20. The first lower scissor connector 80*b* will generally be comprised of a first arm 81*b* and a second arm 83*b*. The first arm 81*b* of the first lower scissor connector 80*b* may be pivotably connected at its first end to the first lower wall mount 72 and at its second end to the second arm 83*b*. The second arm 83*b* of the first lower scissor connector 80*b* may be pivotably connected at its first end to the first arm 81*b* and at its second end to the first support member 20.

As best shown in FIG. 19, the pivotable connection between the first arm 81*b* and the first lower wall mount 72 may utilize a first lower pivot member 73. The pivotable connection between the first arm 81*b* and the second arm 83*b* may utilize a first lower pivot member 82*b*. The pivotable connection between the second arm 83*b* and the first support member 20 may utilize a first lower pivot member 84*b*. Such pivot members 73, 82*b*, 84*b* may comprise various structures, such as but not limited to fasteners, pins, rods, and the like.

As best shown in FIGS. 13-24, it can be seen that a second upper scissor connector 85*a* is connected between the second upper wall mount 74 and the second support member 40. The second upper scissor connector 85*a* will generally be comprised of a first arm 86*a* and a second arm 88*a*. The first arm 86*a* of the second upper scissor connector 85*a* may be pivotably connected at its first end to the second upper wall mount 74 and at its second end to the second arm 88*a*. The second arm 88*a* of the second upper scissor connector 85*a* may be pivotably connected at its first end to the first arm 86*a* and at its second end to the second support member 40.

Figure 17:
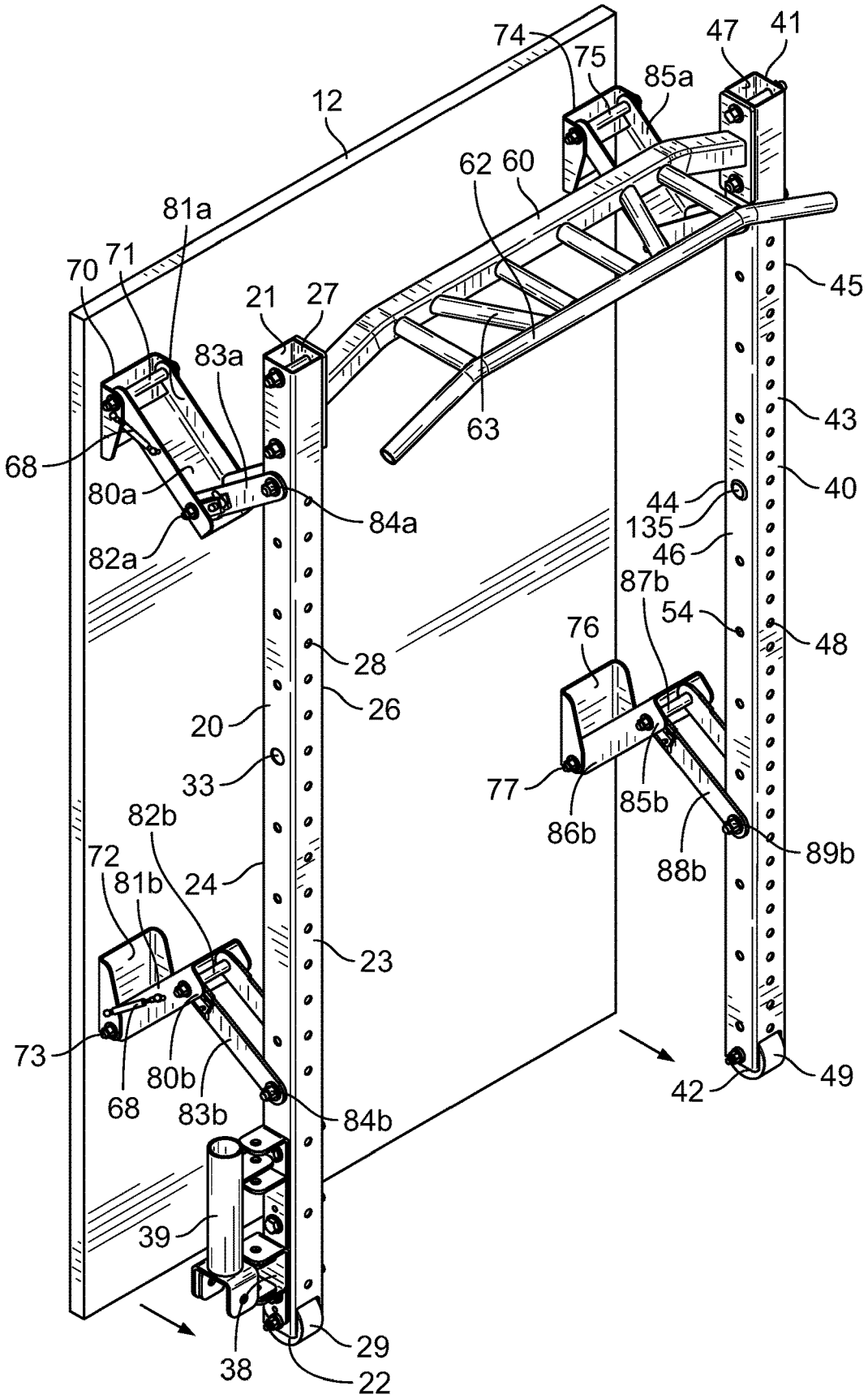
FIG. 17 is a perspective view of a retractable exercise rack system between positions in accordance with an example embodiment.

As best shown in FIG. 17, the pivotable connection between the first arm 86*a* and the second upper wall mount 74 may utilize a second upper pivot member 75. The pivotable connection between the first arm 86*a* and the second arm 88*a* may utilize a second upper pivot member 87*a*. The pivotable connection between the second arm 88*a* and the second support member 40 may utilize a second upper pivot member 89*a*. Such pivot members 75, 87*a*, 89*a* may comprise various structures, such as but not limited to fasteners, pins, rods, and the like.

As best shown in FIGS. 13-24, it can be seen that a second lower scissor connector 85*b* is connected between the second lower wall mount 76 and the second support member 40. The second lower scissor connector 85*b* will generally be comprised of a first arm 86*b* and a second arm 88*b*. The first arm 86*b* of the second lower scissor connector 85*b* may be pivotably connected at its first end to the second lower wall mount 76 and at its second end to the second arm 88*b*. The second arm 88*b* of the second lower scissor connector 85*b* may be pivotably connected at its first end to the first arm 86*b* and at its second end to the second support member 40.

As best shown in FIG. 17, the pivotable connection between the first arm 86*b* and the second lower wall mount 76 may utilize a second lower pivot member 77. The pivotable connection between the first arm 86*b* and the second arm 88*b* may utilize a second lower pivot member 87*b*. The pivotable connection between the second arm 88*b* and the second support member 40 may utilize a second lower pivot member 89*b*. Such pivot members 77, 87*b*, 89*b* may comprise various structures, such as but not limited to fasteners, pins, rods, and the like.

As best shown in FIGS. 13-24, the scissor connectors 80*a*, 80*b*, 85*a*, 85*b* may each utilize actuators 68 such as gas shocks to ease and smoothen the movement of the first and second support members 20, 40 between the positions. In the exemplary embodiment shown in the figures, an actuator 68 is shown connected between the first upper wall mount 70 and the first arm 81*a* of the first upper scissor connector 80*a*. An actuator 68 is also shown connected between the first lower wall mount 72 and the first arm 81*b* of the first lower scissor connector 80*b*. An actuator 68 is additionally shown connected between the second upper wall mount 74 and the first arm 86*a* of the second upper scissor connector 85*a*. Finally, an actuator 68 is shown connected between the second lower wall mount 76 and the first arm 88*a* of the second lower scissor connector 85*b*.

Figure 21:
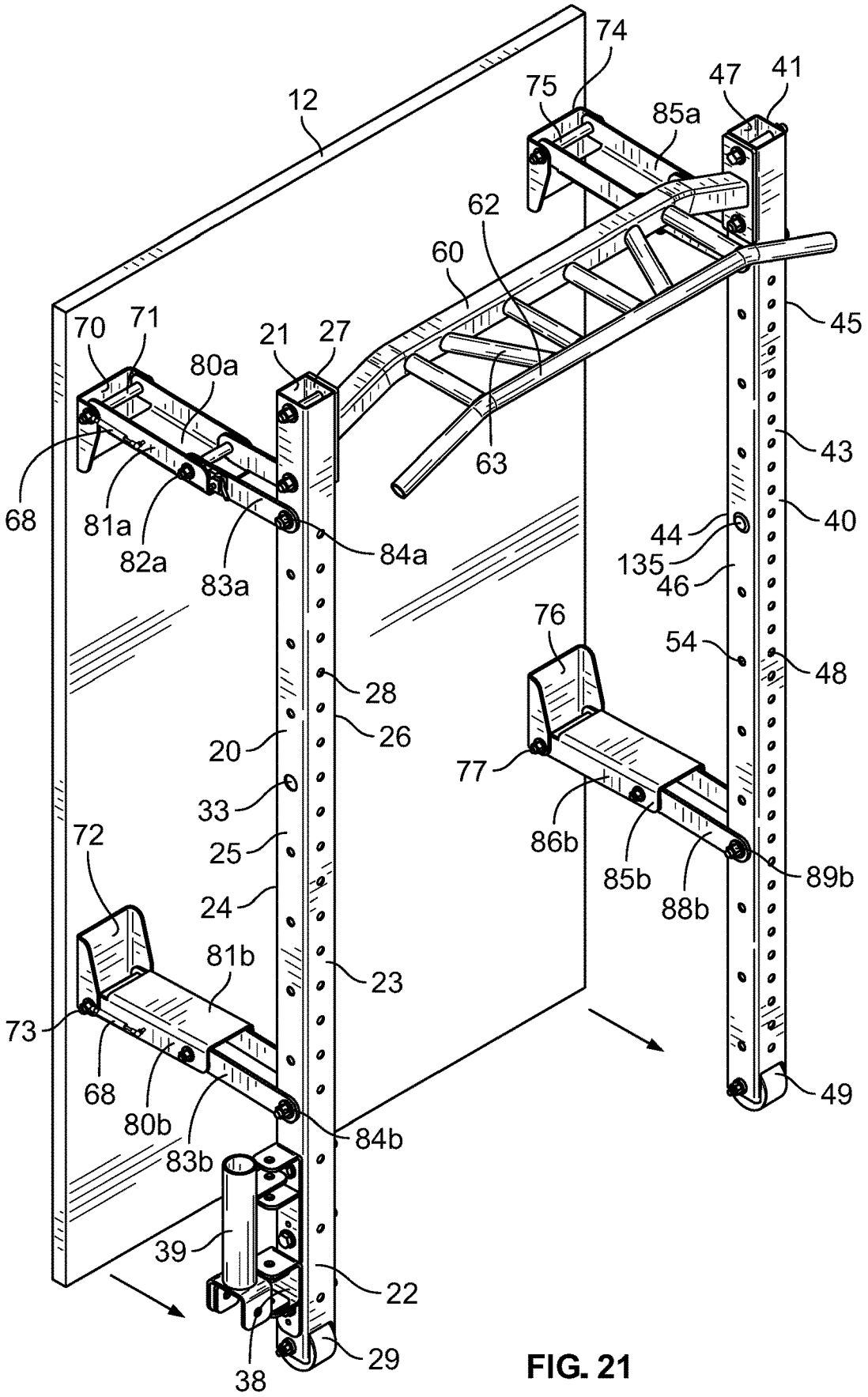
FIG. 21 is a perspective view of a retractable exercise rack system in an extended position in accordance with an example embodiment.

As best shown in FIG. 13, it can be seen that each of the scissor connectors 80*a*, 80*b*, 85*a*, 85*b* is folded upon itself when the exercise rack is in the retracted position. As the exercise rack is adjusted towards the extended position as best shown in FIG. 17, the scissor connectors 80*a*, 80*b*, 85*a*, 85*b* each begin to unfold, with the respective first arms 81*a*, 81*b*, 86*a*, 86*b* and the respective second arms 83*a*, 83*b*, 88*a*, 88*b* pivoting away from each other. As best shown in FIG. 21, the first arms 81*a*, 81*b*, 86*a*, 86*b* and the second arms 83*a*, 83*b*, 88*a*, 88*b* are each horizontally-oriented and linearly-aligned when the exercise rack is in the extended position.

Each of the scissor connectors 80*a*, 80*b*, 85*a*, 85*b* may be releasably locked in the extended position and/or the retracted position. Each of the scissor connectors 80*a*, 80*b*, 85*a*, 85*b* may thus include a latch 140 for releasably locking the scissor connectors 80*a*, 80*b*, 85*a*, 85*b* in either or both positions.

An exemplary latch 140 is shown in FIG. 25. The latch 140 may be configured to selectively, lockably, and removably engage with a corresponding striker 142, with the latch 140 being locked when engaged with the striker 142. Each latch 140 may include a connector 144 which is pivotable to selectively release the latch 140 from engagement with the striker 142 to unlock the latch 140. One or more buttons 130, 135 may be operable to disengage the latch 140, with an out cable 134*a*, 134*b* that is interconnected with the one or more buttons 130, 135 being adapted to pull or push the latch 140 to disengage from the striker 142 when the one or more buttons 130, 135 are depressed. In other embodiments, however, the latches 140 may each be disengaged using other methods, such as but not limited to manual disengagement by-hand.

As shown throughout FIGS. 13-25, the first upper scissor connector 80*a* may include a latch 140 connected to its second arm 83*a* and a striker 142 connected to its first arm 81*a*. However, the converse may be utilized, with the latch 140 instead being connected to the first arm 81*a* and the striker 142 instead being connected to the second arm 83*a*. When the first and second arms 81*a*, 83*a* of the first upper scissor connector 80*a* are extended, the striker 142 will engage within the latch 140 to lock the first and second arms 81*a*, 83*a* in an extended position until such time as the latch 140 is disengaged by pivoting away from engagement with the striker 142.

The first lower scissor connector 80*b* may include a latch 140 connected to its second arm 83*b* and a striker 142 connected to tis first arm 81*b*. However, the converse may be utilized, with the latch 140 instead being connected to the first arm 81*b* and the striker 142 instead being connected to the second arm 83*b*. When the first and second arms 81*b*, 83*b* of the first lower scissor connector 80*b* are extended, the striker 142 will engage within the latch 140 to lock the first and second arms 81*b*, 83*b* in an extended position until such time as the latch 140 is disengaged by pivoting away from engagement with the striker 142.

The second upper scissor connector 85*a* may include a latch 140 connected to its second arm 88*a* and a striker 142 connected to tis first arm 86*a*. However, the converse may be utilized, with the latch 140 instead being connected to the first arm 86*a* and the striker 142 instead being connected to the second arm 88*a*. When the first and second arms 86*a*, 88*a* of the second upper scissor connector 85*a* are extended, the striker 142 will engage within the latch 140 to lock the first and second arms 86*a*, 88*a* in an extended position until such time as the latch 140 is disengaged by pivoting away from engagement with the striker 142.

The first lower scissor connector 85*b* may include a latch 140 connected to its second arm 88*b* and a striker 142 connected to tis first arm 86*b*. However, the converse may be utilized, with the latch 140 instead being connected to the first arm 86*b* and the striker 142 instead being connected to the second arm 88*b*. When the first and second arms 86*b*, 88*b* of the second lower scissor connector 85*b* are extended, the striker 142 will engage within the latch 140 to lock the first and second arms 86*b*, 88*b* in an extended position until such time as the latch 140 is disengaged by pivoting away from engagement with the striker 142.

E. Third Exemplary Embodiment (FIGS. 26-38)

FIGS. 26-38 illustrate a third exemplary embodiment of a retractable exercise rack system. FIGS. 26-29 illustrate such an exemplary embodiment in a first, retracted position against or near a wall 12. FIGS. 30-33 illustrate such an exemplary embodiment as it is being adjusted between positions. FIGS. 34-37 illustrate such an exemplary in a second, extended position which is distally-spaced from the wall. FIG. 38 illustrates an exemplary latching system for releasably locking such an exemplary embodiment in the retracted and/or extended positions.

As shown in FIGS. 26-37, the third exemplary embodiment generally includes a pair of support members 20, 40 which are parallel to each other and distally-spaced. The distance between the first and second support members 20, 40 may vary in different embodiments to suit different exercise spaces or exercisers. A cross support 60 is shown extending between a point near the upper ends 21, 41 of the respective support members 20, 40.

The front side 23 of the first support member 20 includes a column of front openings 28 and the front side 43 of the second support member 20 includes a column of front openings 48. The front openings 48 may be utilized for attaching various exercise attachments as needed to perform a wide range of exercises. Additionally, each of the support members 20, 40 may include additional openings 33, 54 along their respective outer and/or inner sides 25, 26 which may be utilized both to attach various exercise attachments, and to attach first and second wall mounts 90, 100 as discussed herein.

Each of the first and second support members 20, 40 are also shown as including a wheel 29, 49 rotatably connected to their respective lower ends 22, 42. The wheels 29, 49 are adapted to traverse a ground surface 14 underlying the first and second support members 20, 40 as the first and second support members 20, 40 are adjusted between the retracted and extended positions in either direction.

As best shown in FIGS. 26-37, the first support member 20 may be connected to the wall 12 by a first wall mount 90 and the second support member 40 may be connected to the wall by a second wall mount 100. Each of the support members 20, 40 includes upper arms 93, 103 which are pivotably connected between the support members 20, 40 and the first wall mount 90 and lower arms 96, 106 which are pivotably connected between the support members 20, 40 and the second wall mount 100.

Figure 28:
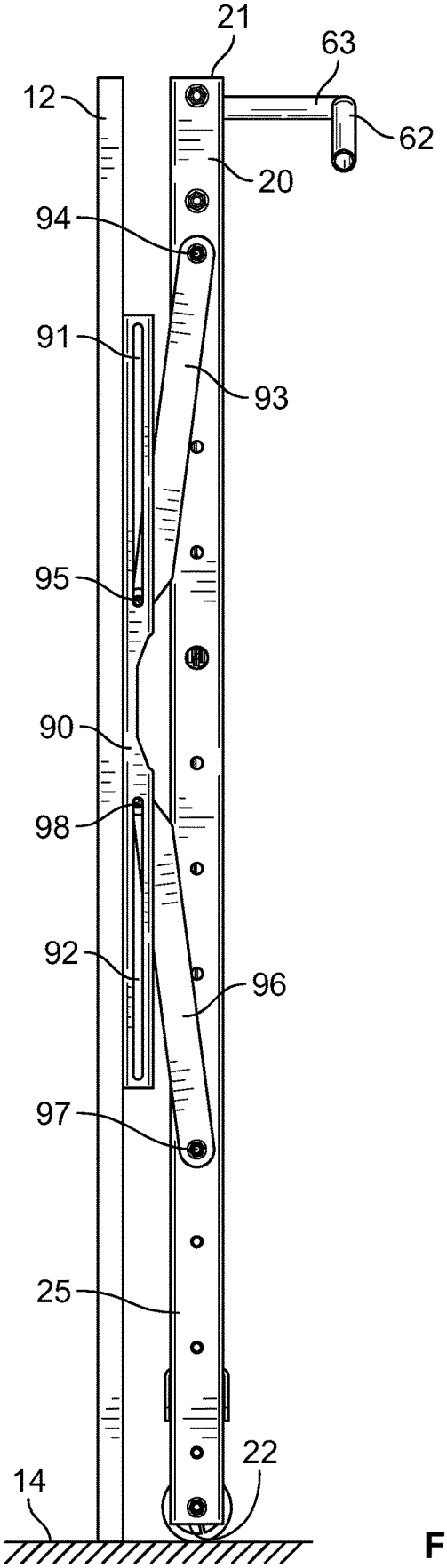
FIG. 28 is a side view of a retractable exercise rack system in a retracted position in accordance with an example embodiment.
Figure 29:
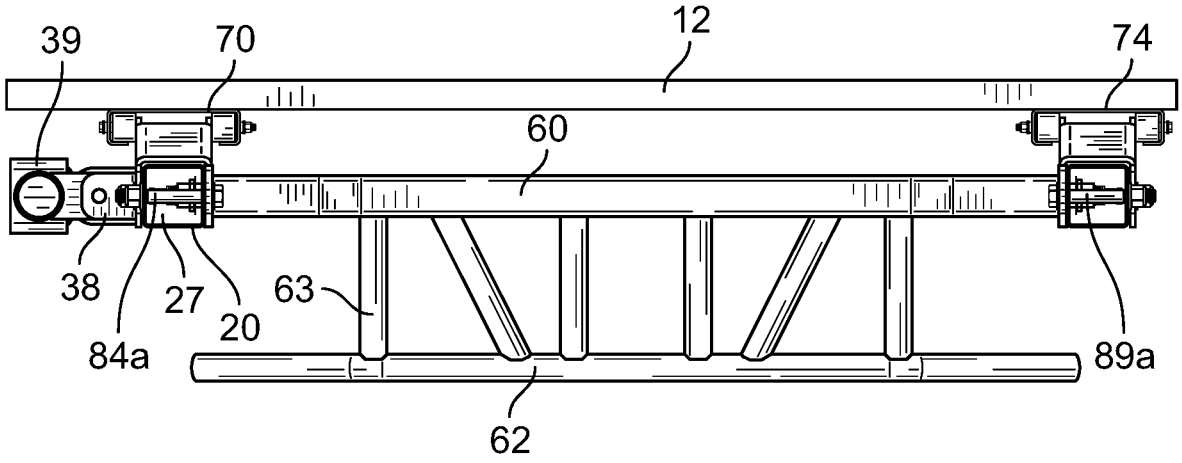
FIG. 29 is a top view of a retractable exercise rack system in a retracted position in accordance with an example embodiment.

As best shown in FIG. 28, a first wall mount 90 may be connected to the wall 12 by various methods such as but not limited to fasteners, adhesives, magnets, and the like. The first wall mount 90 will generally comprise an elongated member that is oriented vertically along the wall 12, parallel to the first support member 20. The first support member 20 may be adapted to rest against the first wall mount 90 when in the retracted position such as shown in FIG. 28. The first wall mount 90 may be at least partially hollow such as shown in the figures.

As shown in the figures, the first wall mount 90 may include one or more upper slots 91 and one or more lower slots 92. The one or more upper slots 91 may be positioned along the upper half of the first wall mount 90 and the one or more lower slots 92 may be positioned along the lower half of the first wall mount 90. In an exemplary embodiment, the first wall mount 90 may include a pair of upper slots 91 on either side of the first wall mount 90 and a pair of lower slots 92 on either side of the first wall mount 90.

The one or more upper slots 91 will generally be aligned with the one or more lower slots 92 as shown in the figures. The length of the respective slots 91, 92 may vary in different embodiments and thus should not be construed as limited by the exemplary figures. Additionally, the distance between the respective slots 91, 92 (e.g., the distance between the lower end of the upper slot 91 and the upper end of the lower slot 92) may also vary in different embodiments.

A first upper arm 93 may be pivotably connected between the first wall mount 90 and the first support member 20. More specifically, it can be seen in the figures that the first upper arm 93 is slidably connected at its first end to the first wall mount 90 and pivotably connected at its second end to the first support member 20. The first upper arm 93 will generally comprise an elongated arm member such as shown in the figures. As best shown in FIGS. 26-37, the first upper arm 93 may comprise a pair of parallel arm members, with the first arm member being pivotably connected to an outer side 25 of the first support member 20 and the second arm member being pivotably connected to an inner side 26 of the first support member 20.

The first end of the first upper arm 93 will generally include a first upper slide pin 95 which is slidably engaged within the one or more upper slots 91 of the first wall mount 90. In embodiments in which the first upper arm 93 includes a pair of parallel, spaced-apart arm members such as shown in FIG. 34, the first upper slide pin 95 may extend between the distal ends of the pair of arm members.

Figure 30:
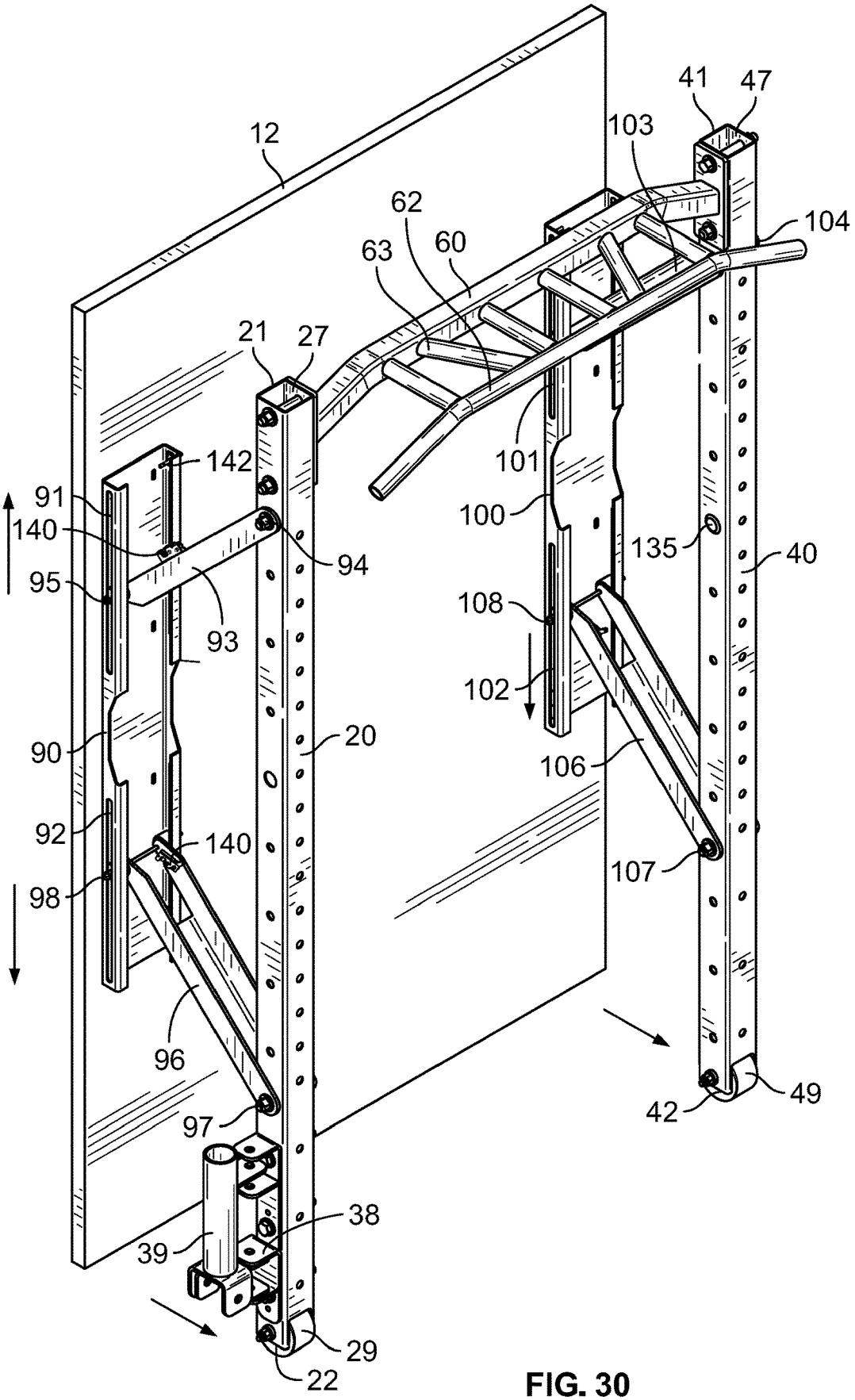
FIG. 30 is a perspective view of a retractable exercise rack system between positions in accordance with an example embodiment.
Figure 31:
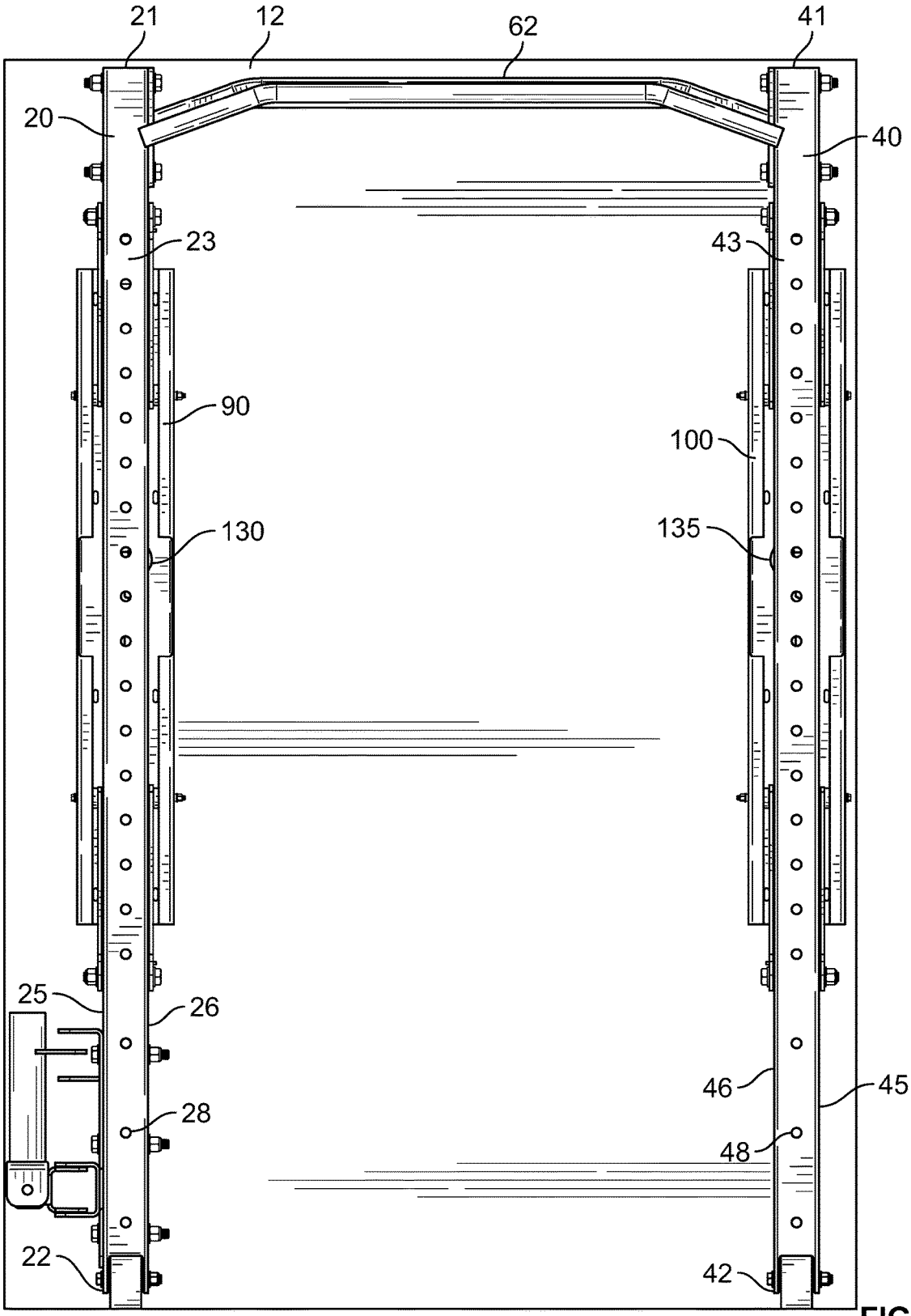
FIG. 31 is a front view of a retractable exercise rack system between positions in accordance with an example embodiment.
Figure 32:
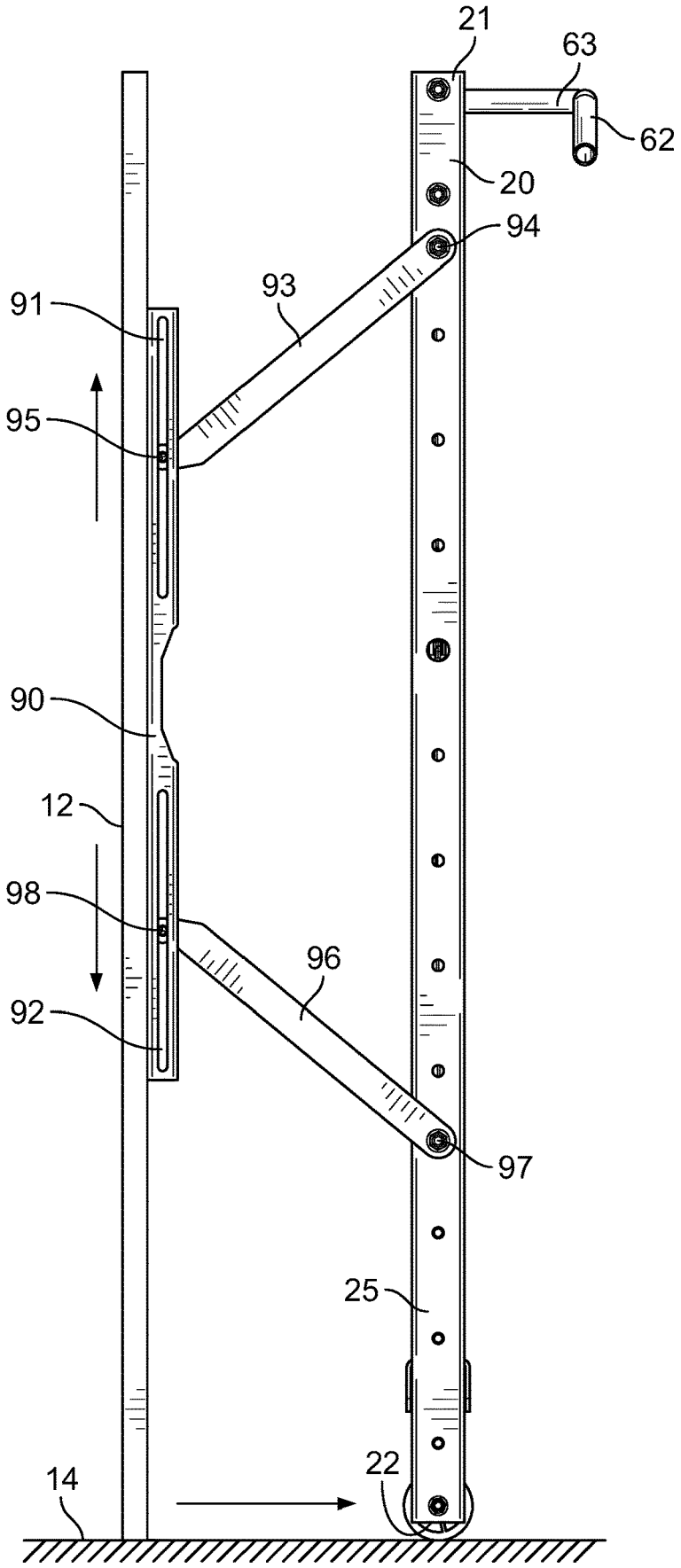
FIG. 32 is a side view of a retractable exercise rack system between positions in accordance with an example embodiment.
Figure 33:
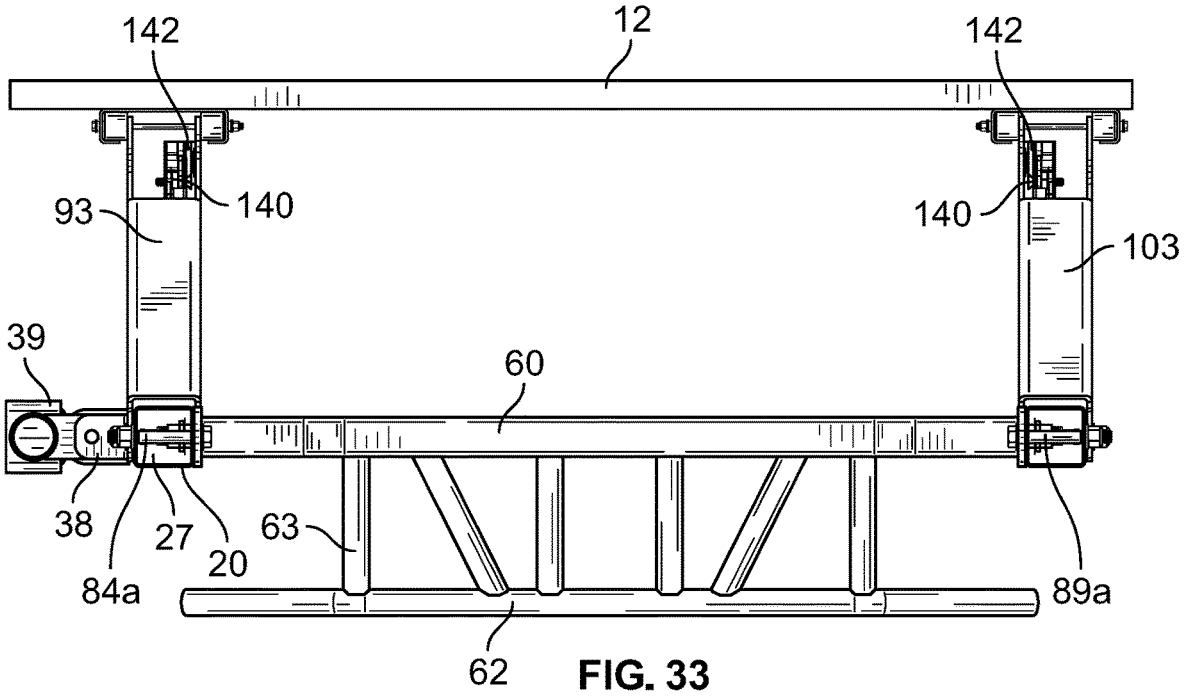
FIG. 33 is a top view of a retractable exercise rack system between positions in accordance with an example embodiment.

When the first support member 20 is in the retracted position, the first upper slide pin 95 will be positioned at the lower terminus of the one or more upper slots 91 such as shown in FIG. 26. When the first support member 20 is transitioning between positions, the first upper slide pin 95 will be positioned between the upper and lower terminuses of the one or more upper slots 91 such as shown in FIG. 30. When the first support member 20 is in the extended position, the first upper slide pin 95 will be positioned at the upper terminus of the one or more upper slots 91 such as shown in FIG. 34.

The second end of the first upper arm 93 will generally be pivotably connected to the first support member 20 near its upper end 21. A first upper pivot 94 such as a fastener, pin, rod, or the like may be utilized to pivotably connect the second end of the first upper arm 93 to the first support member 20. The first upper pivot 94 may extend through openings 33 on the outer and/or inner sides 25, 26 of the first support member 20 as shown in the figures.

Figure 34:
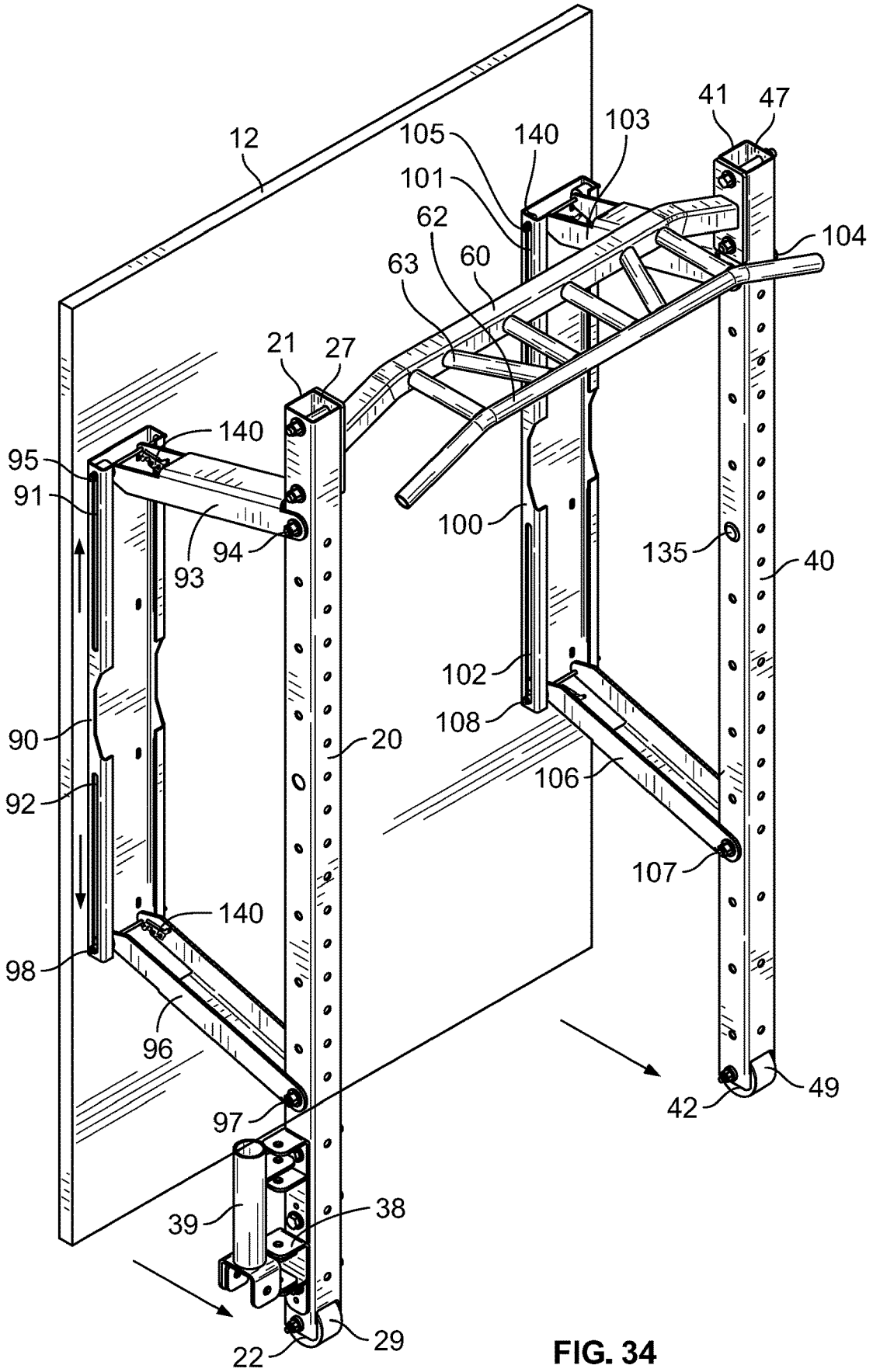
FIG. 34 is a perspective view of a retractable exercise rack system in an extended position in accordance with an example embodiment.
Figure 35:
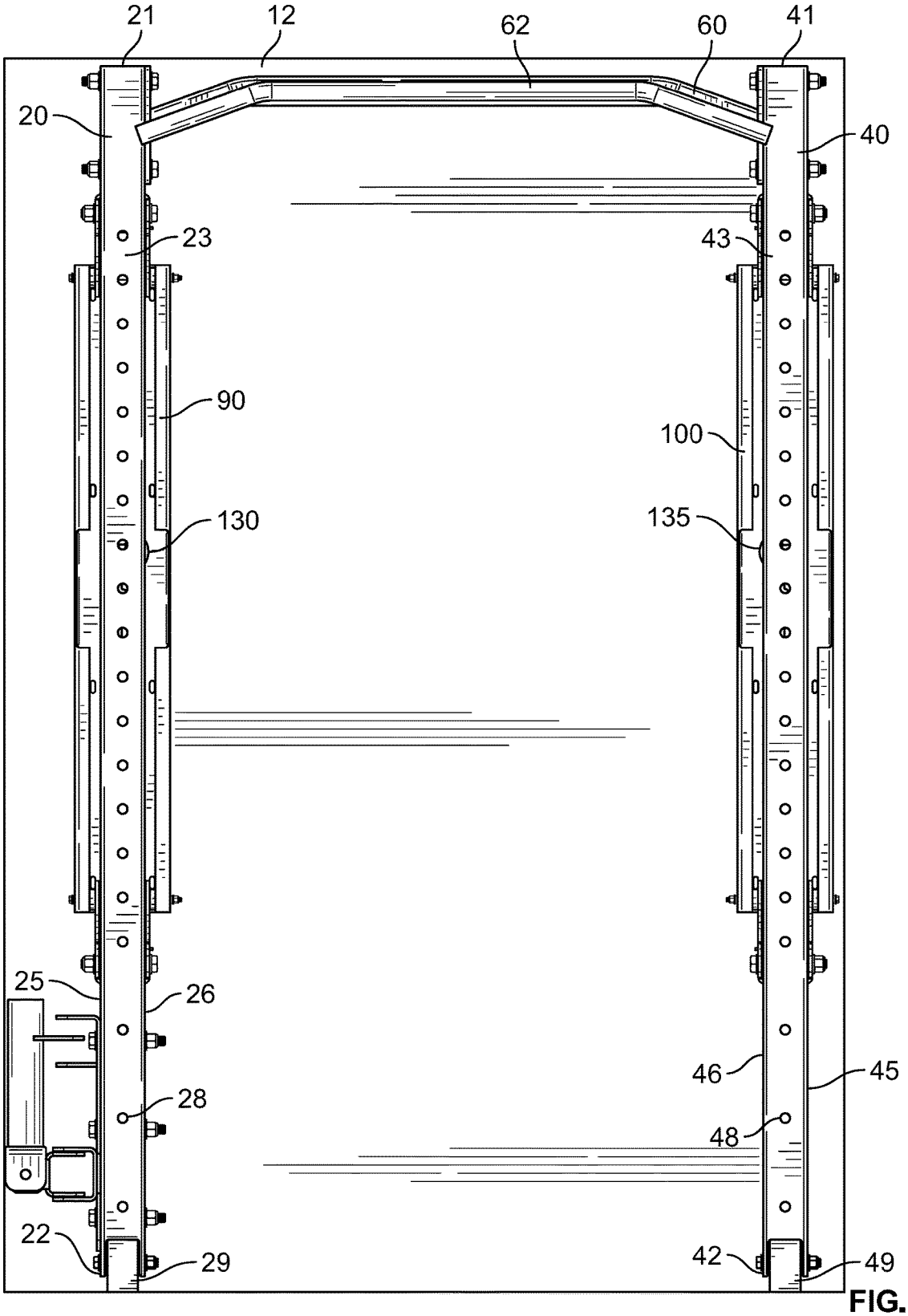
FIG. 35 is a front view of a retractable exercise rack system in an extended position in accordance with an example embodiment.
Figure 36:
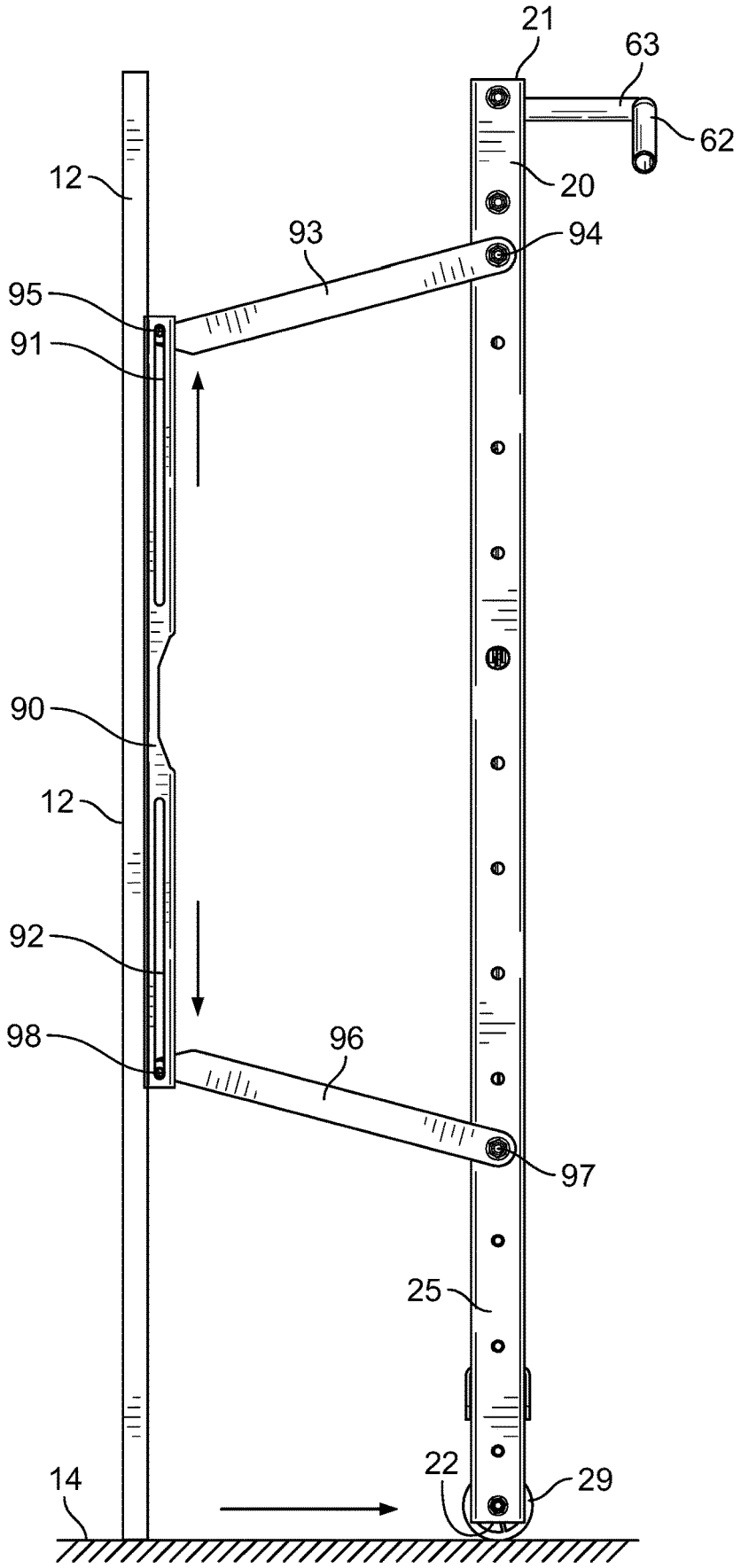
FIG. 36 is a side view of a retractable exercise rack system in an extended position in accordance with an example embodiment.
Figure 37:
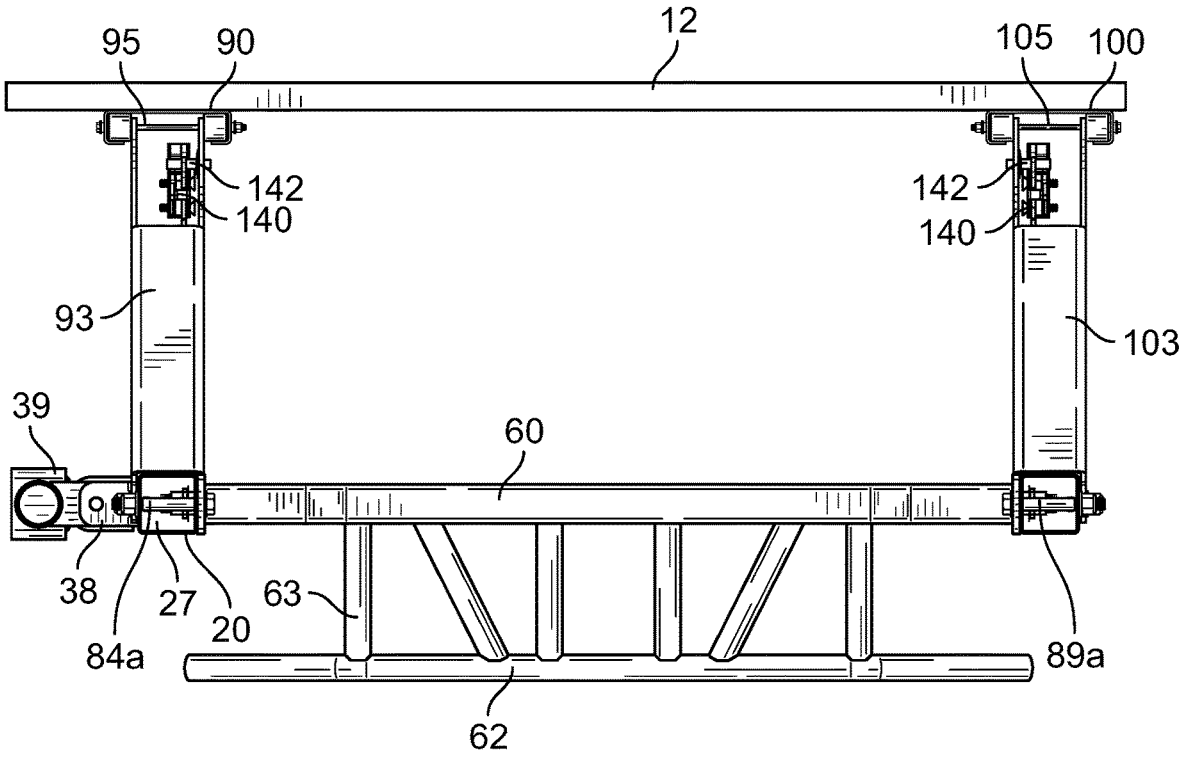
FIG. 37 is a top view of a retractable exercise rack system in an extended position in accordance with an example embodiment.

As best shown in FIGS. 26-37, a first lower arm 96 may be pivotably connected between the first wall mount 90 and the first support member 20. More specifically, it can be seen in the figures that the first lower arm 96 is slidably connected at its first end to the first wall mount 90 and pivotably connected at its second end to the first support member 20. The first lower arm 96 will generally comprise an elongated arm member such as shown in the figures. As best shown in FIGS. 34, the first lower arm 96 may comprise a pair of parallel arm members, with the first arm member being pivotably connected to an outer side 25 of the first support member 20 and the second arm member being pivotably connected to an inner side 26 of the first support member 20.

The first end of the first lower arm 96 will generally include a first lower slide pin 98 which is slidably engaged within the one or more lower slots 92 of the first wall mount 90. In embodiments in which the first lower arm 96 includes a pair of parallel, spaced-apart arm members such as shown in FIG. 34, the first lower slide pin 98 may extend between the distal ends of the pair of arm members.

When the first support member 20 is in the retracted position, the first lower slide pin 98 will be positioned at the upper terminus of the one or more lower slots 92 such as shown in FIG. 26. When the first support member 20 is transitioning between positions, the first lower slide pin 98 will be positioned between the upper and lower terminuses of the one or more lower slots 92 such as shown in FIG. 30. When the first support member 20 is in the extended position, the first lower slide pin 98 will be positioned at the lower terminus of the one or more lower slots 92 such as shown in FIG. 34.

The second end of the first lower arm 96 will generally be pivotably connected to the first support member 20 near its lower end 22. A first lower pivot 97 such as a fastener, pin, rod, or the like may be utilized to pivotably connect the second end of the first lower arm 96 to the first support member 20. The first lower pivot 97 may extend through openings 33 on the outer and/or inner sides 25, 26 of the first support member 20 as shown in the figures.

As best shown in FIG. 34, a second wall mount 100 may be connected to the wall 12 by various methods such as but not limited to fasteners, adhesives, magnets, and the like. The second wall mount 100 will generally comprise an elongated member that is oriented vertically along the wall 12, parallel to the second support member 40. The second support member 40 may be adapted to rest against the second wall mount 100 when in the retracted position such as shown in FIG. 26. The second wall mount 100 may be at least partially hollow such as shown in the figures.

As shown in the figures, the second wall mount 100 may include one or more upper slots 101 and one or more lower slots 102. The one or more upper slots 101 may be positioned along the upper half of the second wall mount 100 and the one or more lower slots 102 may be positioned along the lower half of the second wall mount 100. In an exemplary embodiment, the second wall mount 100 may include a pair of upper slots 101 on either side of the second wall mount 100 and a pair of lower slots 102 on either side of the second wall mount 100.

The one or more upper slots 101 will generally be aligned with the one or more lower slots 102 as shown in the figures. The length of the respective slots 101, 102 may vary in different embodiments and thus should not be construed as limited by the exemplary figures. Additionally, the distance between the respective slots 101, 102 (e.g., the distance between the lower end of the upper slot 101 and the upper end of the lower slot 102) may also vary in different embodiments.

As best shown in FIGS. 26-37, a second upper arm 103 may be pivotably connected between the second wall mount 100 and the second support member 40. More specifically, it can be seen in the figures that the second upper arm 103 is slidably connected at its first end to the second wall mount 100 and pivotably connected at its second end to the second support member 40. The second upper arm 103 will generally comprise an elongated arm member such as shown in the figures. As best shown in FIG. 34, the second upper arm

103 may comprise a pair of parallel arm members, with the first arm member being pivotably connected to an outer side 25 of the second support member 40 and the second arm member being pivotably connected to an inner side 26 of the second support member 40.

The first end of the second upper arm 103 will generally include a second upper slide pin 105 which is slidably engaged within the one or more upper slots 101 of the second wall mount 100. In embodiments in which the second upper arm 103 includes a pair of parallel, spaced-apart arm members such as shown in FIG. 34, the second upper slide pin 105 may extend between the distal ends of the pair of arm members.

When the second support member 40 is in the retracted position, the second upper slide pin 105 will be positioned at the lower terminus of the one or more upper slots 101 such as shown in FIG. 26. When the second support member 40 is transitioning between positions, the second upper slide pin 105 will be positioned between the upper and lower terminuses of the one or more upper slots 101 such as shown in FIG. 30. When the second support member 40 is in the extended position, the second upper slide pin 105 will be positioned at the upper terminus of the one or more upper slots 101 such as shown in FIG. 34.

The second end of the second upper arm 103 will generally be pivotably connected to the second support member 40 near its upper end 41. A second upper pivot 104 such as a fastener, pin, rod, or the like may be utilized to pivotably connect the second end of the second upper arm 103 to the second support member 40. The second upper pivot 104 may extend through openings 54 on the outer and/or inner sides 45, 46 of the second support member 40 as shown in the figures.

As best shown in FIGS. 26-37, a second lower arm 106 may be pivotably connected between the second wall mount 100 and the second support member 40. More specifically, it can be seen in the figures that the second lower arm 106 is slidably connected at its first end to the second wall mount 100 and pivotably connected at its second end to the second support member 40. The second lower arm 106 will generally comprise an elongated arm member such as shown in the figures. As best shown in FIGS. 34, the second lower arm 106 may comprise a pair of parallel arm members, with the first arm member being pivotably connected to an outer side 45 of the second support member 40 and the second arm member being pivotably connected to an inner side 46 of the second support member 40.

The first end of the second lower arm 106 will generally include a second lower slide pin 108 which is slidably engaged within the one or more lower slots 102 of the second wall mount 100. In embodiments in which the second lower arm 106 includes a pair of parallel, spaced-apart arm members such as shown in FIG. 34, the second lower slide pin 108 may extend between the distal ends of the pair of arm members.

When the second support member 40 is in the retracted position, the second lower slide pin 108 will be positioned at the upper terminus of the one or more lower slots 102 such as shown in FIG. 26. When the second support member 40 is transitioning between positions, the second lower slide pin 108 will be positioned between the upper and lower terminuses of the one or more lower slots 102 such as shown in FIG. 30. When the second support member 40 is in the extended position, the second lower slide pin 108 will be positioned at the lower terminus of the one or more lower slots 102 such as shown in FIG. 34.

The second end of the second lower arm 106 will generally be pivotably connected to the second support member 40 near its lower end 22. A second lower pivot 107 such as a fastener, pin, rod, or the like may be utilized to pivotably connect the second end of the second lower arm 106 to the second support member 40. The second lower pivot 107 may extend through openings 33 on the outer and/or inner sides 25, 26 of the second support member 40 as shown in the figures.

Each of the arms 93, 96, 103, 106 may be releasably locked in the extended position and/or the retracted position. Each of the arms 93, 96, 103, 106 may thus include a latch 140 for releasably locking the arms 93, 96, 103, 106 in either or both positions.

An exemplary latch 140 is shown in FIG. 38. The latch 140 may be configured to selectively, lockably, and removably engage with a corresponding striker 142, with the latch 140 being locked when engaged with the striker 142. Each latch 140 may include a connector 144 which is pivotable to selectively release the latch 140 from engagement with the striker 142 to unlock the latch 140. One or more buttons 130, 135 may be operable to disengage the latch 140, with an out cable 134*a*, 134*b* that is interconnected with the one or more buttons 130, 135 being adapted to pull or push the latch 140 to disengage from the striker 142 when the one or more buttons 130, 135 are depressed. In other embodiments, however, the latches 140 may each be disengaged using other methods, such as but not limited to manual disengagement by-hand.

The first end of the upper arm 93 may include a latch 140, with a corresponding striker 142 attached to an upper end of the first wall mount 90. Conversely, the first wall mount 90 may include a latch 140 connected at its upper end, with a corresponding striker 142 being connected to the first end of the upper arm 93. When the upper arm 93 is in the extended position, the striker 142 will engage within the latch 140 to lock the upper arm 93 in the extended position until such time as the latch 140 is disengaged by pivoting away from engagement with the striker 142.

The first end of the lower arm 96 may include a latch 140, with a corresponding striker 142 attached to a lower end of the first wall mount 90. Conversely, the first wall mount 90 may include a latch 140 connected at its lower end, with a corresponding striker 142 being connected to the first end of the lower arm 96. When the lower arm 96 is in the extended position, the striker 142 will engage within the latch 140 to lock the lower arm 96 in the extended position until such time as the latch 140 is disengaged by pivoting away from engagement with the striker 142.

The first end of the upper arm 103 may include a latch 140, with a corresponding striker 142 being attached to an upper end of the second wall mount 100. Conversely, the second wall mount 100 may include a latch 140 connected at its upper end, with a corresponding striker 142 being connected to the first end of the upper arm 103. When the upper arm 103 is in the extended position, the striker will engage within the latch 140 to lock the upper arm 103 in the extended position until such time as the latch 140 is disengaged by pivoting away from engagement with the striker 142.

The first end of the lower arm 106 may include a latch 140, with a corresponding striker 142 being attached to a lower end of the second wall mount 100. Conversely, the second wall mount 100 may include a latch 140 connected at its lower end, with a corresponding striker 142 being connected to the first end of the lower arm 106. When the lower arm 106 is in the extended position, the striker 142 will engage within the latch 140 to lock the lower arm 106 in the extended position until such time as the latch 140 is disengaged by pivoting away from engagement with the striker 142.

F. Fourth Exemplary Embodiment (FIGS. 39-51)

FIGS. 39-51 illustrate a fourth exemplary embodiment of a retractable exercise rack system. FIGS. 39-42 illustrate such an exemplary embodiment in a first, retracted position against or near a wall 12. FIGS. 43-46 illustrate such an exemplary embodiment as it is being adjusted between positions. FIGS. 47-50 illustrate such an exemplary in a second, extended position which is distally-spaced from the wall. FIG. 51 illustrates an exemplary latching system for releasably locking such an exemplary embodiment in the retracted and/or extended positions.

As shown in FIGS. 39-50, the fourth exemplary embodiment generally includes a pair of support members 20, 40 which are parallel to each other and distally-spaced. The distance between the first and second support members 20, 40 may vary in different embodiments to suit different exercise spaces or exercisers. A cross support 60 is shown extending between a point near the upper ends 21, 41 of the respective support members 20, 40.

Figure 40:
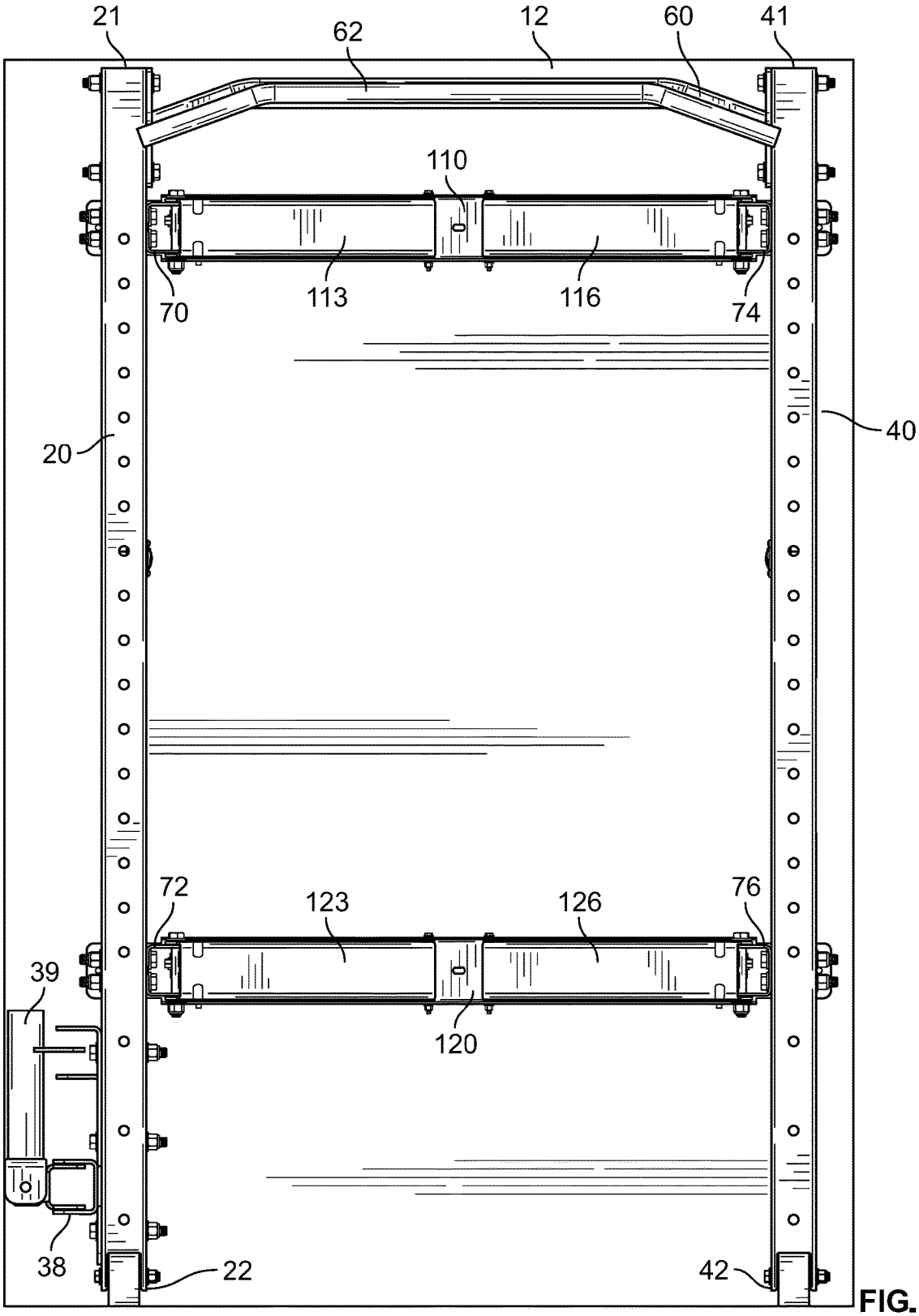
FIG. 40 is a front view of a retractable exercise rack system in a retracted position in accordance with an example embodiment.
Figure 41:
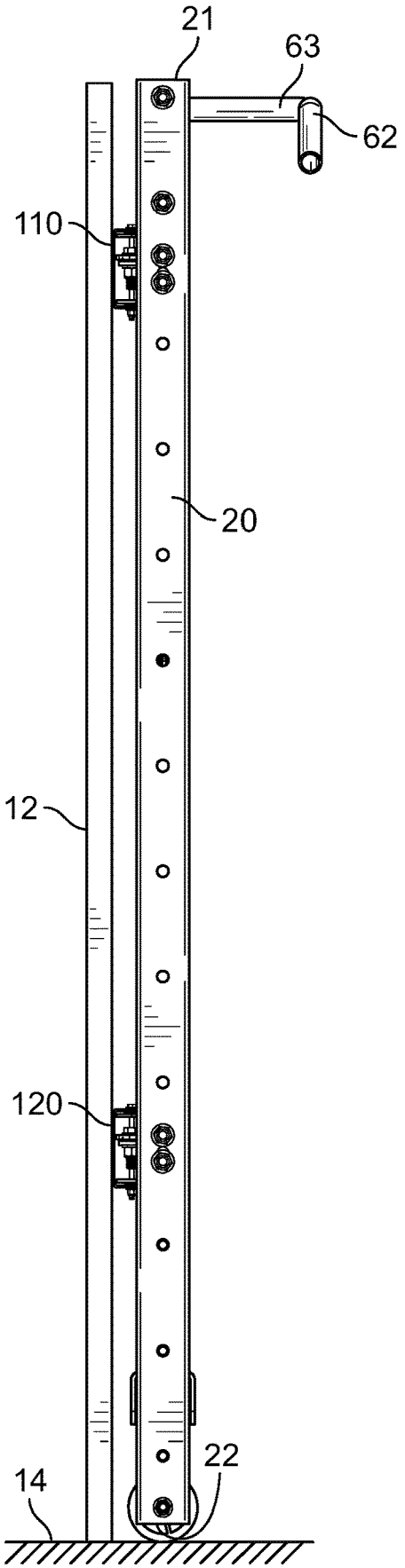
FIG. 41 is a side view of a retractable exercise rack system in a retracted position in accordance with an example embodiment.
Figure 42:
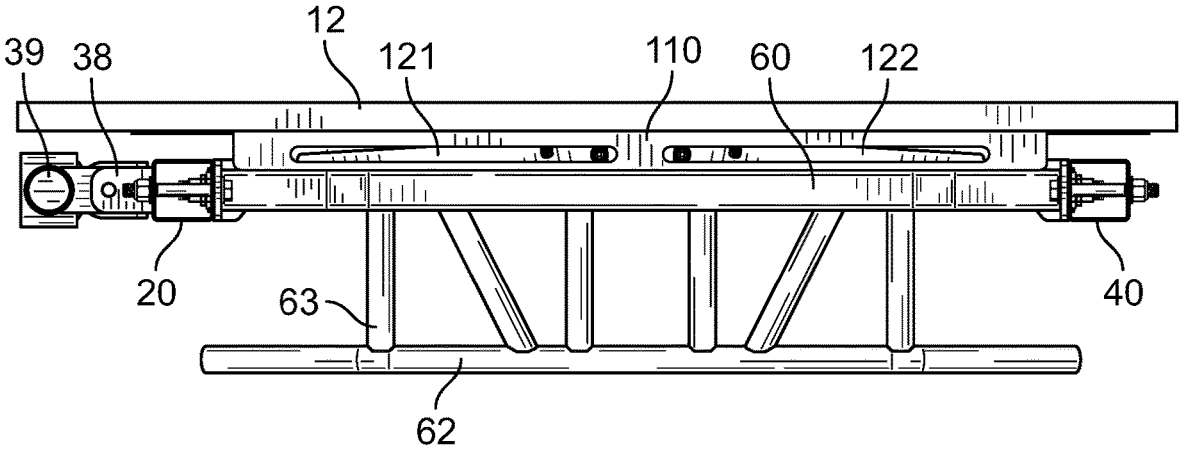
FIG. 42 is a top view of a retractable exercise rack system in a retracted position in accordance with an example embodiment.
Figure 44:
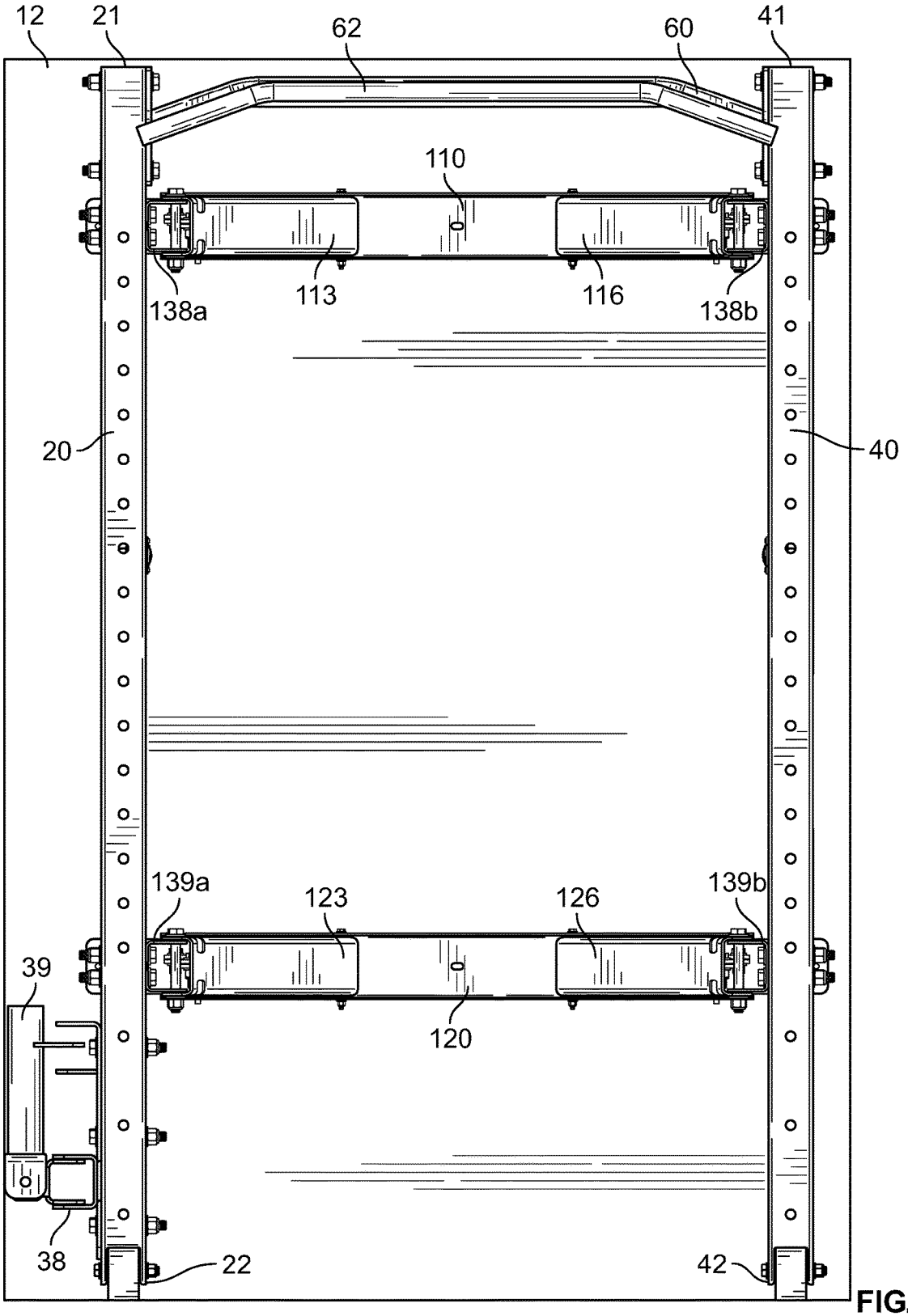
FIG. 44 is a front view of a retractable exercise rack system between positions in accordance with an example embodiment.
Figure 48:
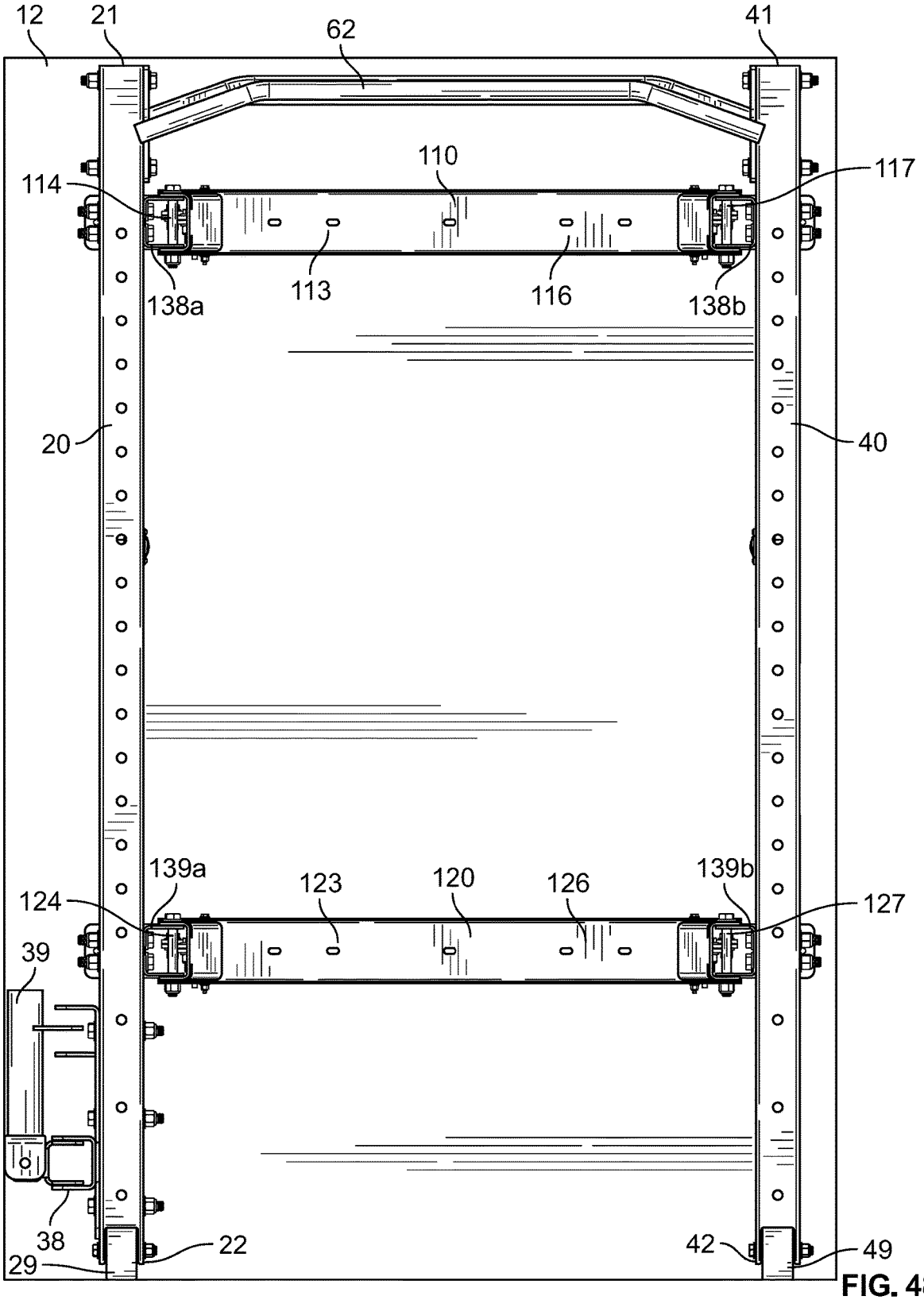
FIG. 48 is a front view of a retractable exercise rack system in an extended position in accordance with an example embodiment.
Figure 49:
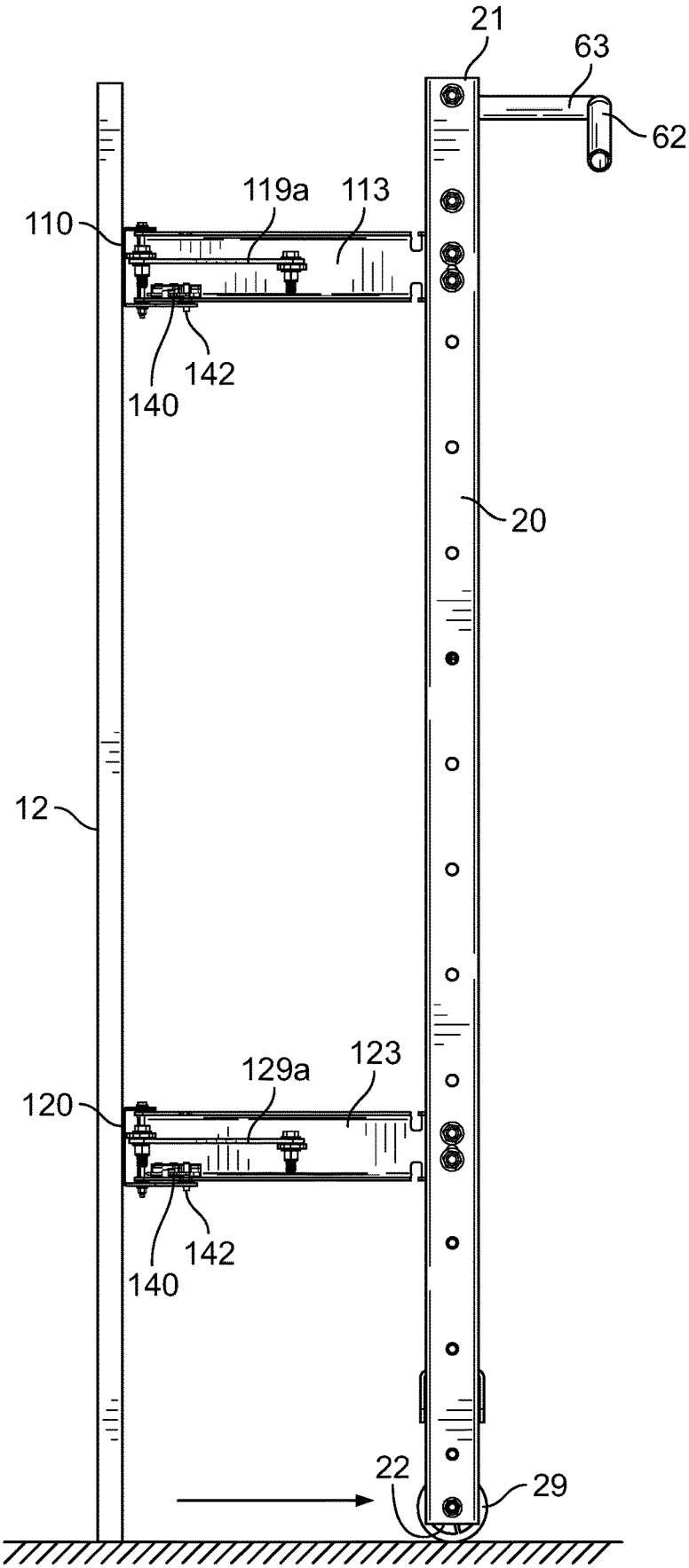
FIG. 49 is a side view of a retractable exercise rack system in an extended position in accordance with an example embodiment.
Figure 50:
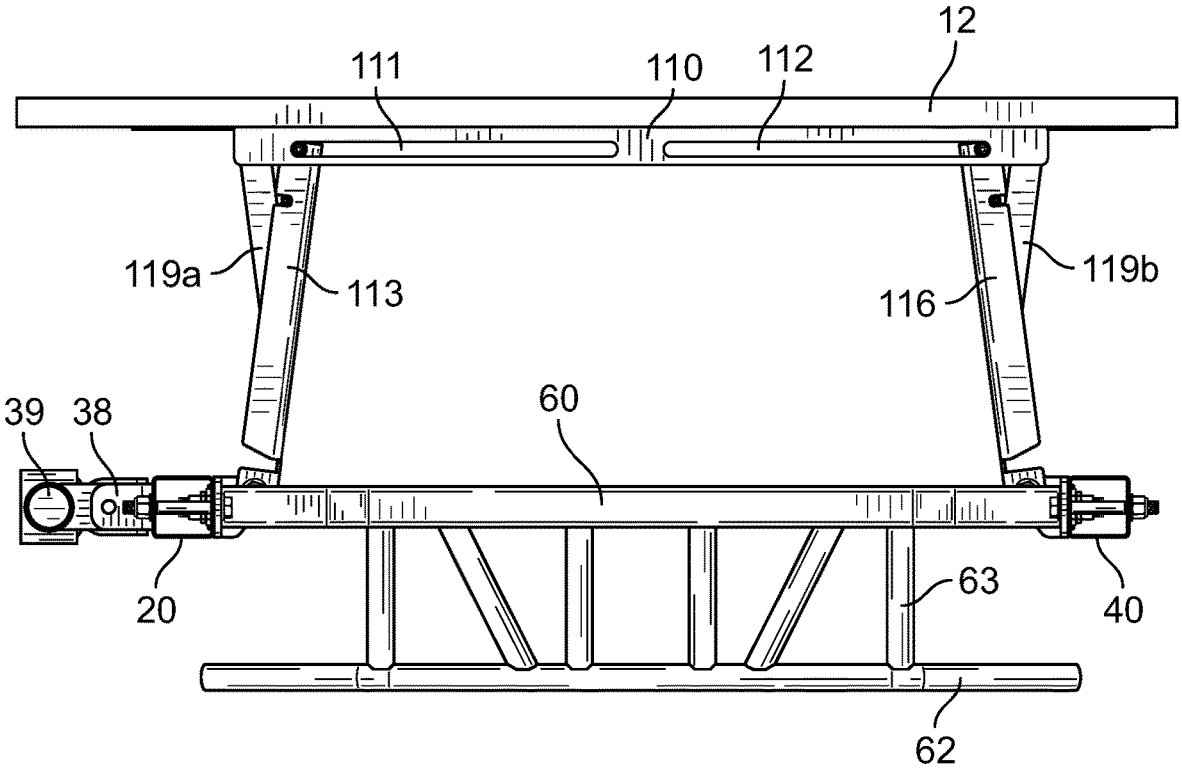
FIG. 50 is a top view of a retractable exercise rack system in an extended position in accordance with an example embodiment.

As best shown in FIGS. 40, 44, and 48, the front side 23 of the first support member 20 includes a column of front openings 28 and the front side 43 of the second support member 20 includes a column of front openings 48. The front openings 48 may be utilized for attaching various exercise attachments as needed to perform a wide range of exercises. Additionally, each of the support members 20, 40 may include additional openings 33, 54 along their respective outer and/or inner sides 25, 26 which may be utilized both to attach various exercise attachments, and to attach first and second wall mounts 90, 100 as discussed herein.

Each of the first and second support members 20, 40 are also shown as including a wheel 29, 49 rotatably connected to their respective lower ends 22, 42. The wheels 29, 49 are adapted to traverse a ground surface 14 underlying the first and second support members 20, 40 as the first and second support members 20, 40 are adjusted between the retracted and extended positions in either direction.

As best shown in FIGS. 39-50, the first and second support members 20, 40 may be connected at or near their respective upper ends 21, 41 to the wall 12 by an upper wall mount 110. The first and second support members 20, 40 may additionally be connected at or near their respective lower ends 22, 42 to the wall by a lower wall mount 120. Each of the support members 20, 40 includes upper arms 113, 116 which are pivotably connected between the support members 20, 40 and the upper wall mount 110 and lower arms 123, 126 which are pivotably connected between the support members 20, 40 and the lower wall mount 120.

Figure 45:
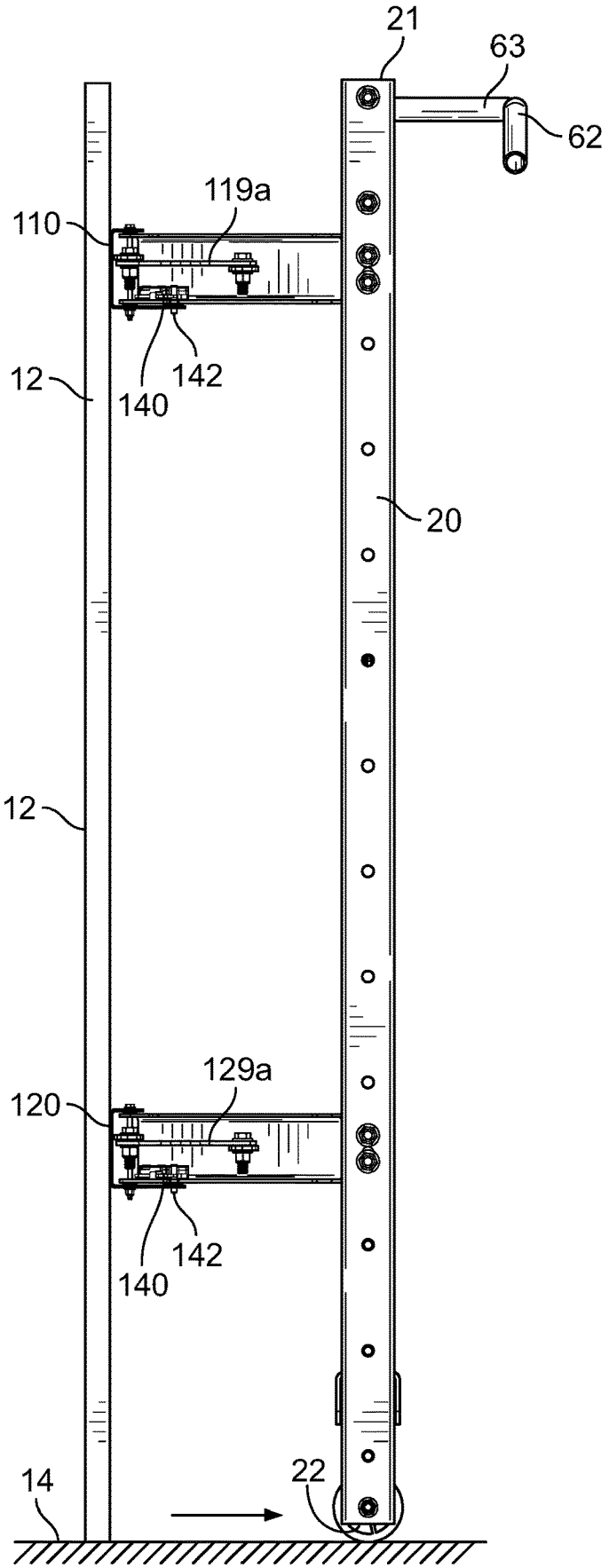
FIG. 45 is a side view of a retractable exercise rack system between positions in accordance with an example embodiment.
Figure 46:
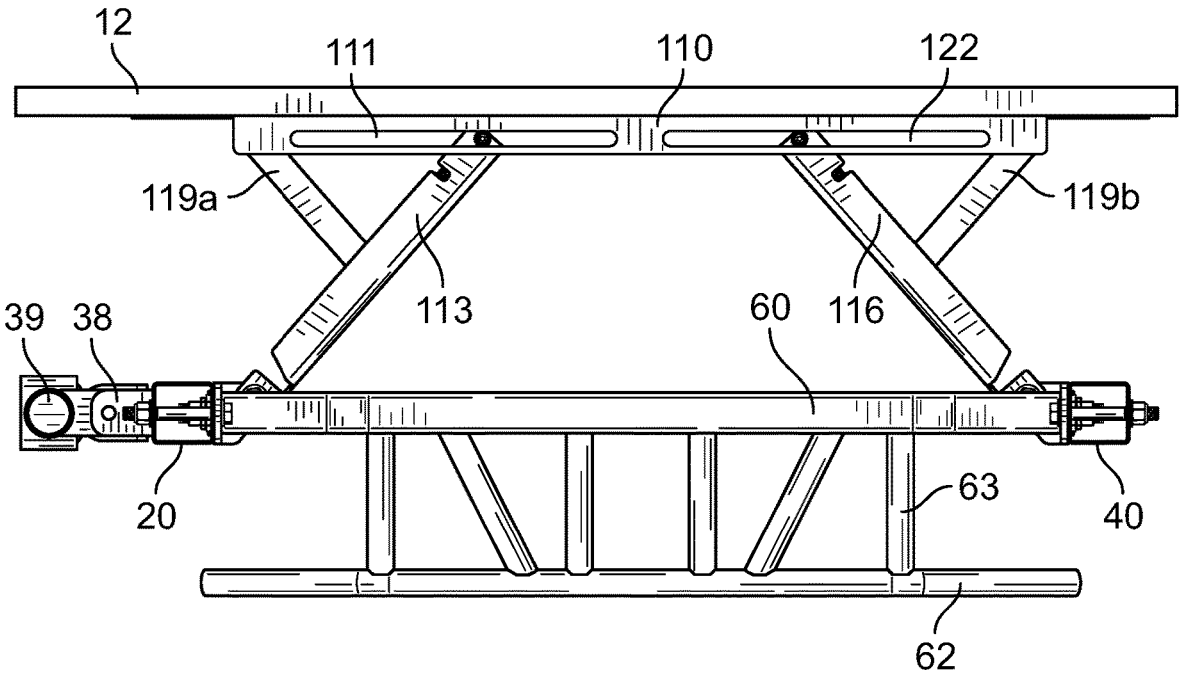
FIG. 46 is a top view of a retractable exercise rack system between positions in accordance with an example embodiment.

As best shown in FIG. 45, an upper wall mount 110 may be connected to the wall 12 by various methods such as but not limited to fasteners, adhesives, magnets, and the like. The upper wall mount 110 will generally comprise an elongated member that is oriented horizontally along the wall 12, perpendicular to the first and second support members 20, 40. The first and second support members 20, 40 may be adapted to rest against the upper wall mount 110 when in the retracted position such as shown in FIG. 39. The upper wall mount 110 may be at least partially hollow such as shown in the figures.

As shown in the figures, the upper wall mount 110 may include one or more first slots 111 and one or more second slots 112. The one or more first slots 111 may be positioned along the first half of the upper wall mount 110 and the one or more second slots 112 may be positioned along the second half of the upper wall mount 110. In an exemplary embodiment, the upper wall mount 110 may include a pair of first slots 111 on the upper and lower ends of a first side of the upper wall mount 110 and a pair of second slots 112 on the upper and lower ends of a second side of the upper wall mount 110.

The one or more first slots 111 will generally be aligned horizontally with the one or more second slots 112 as shown in the figures. The length of the respective slots 111, 112 may vary in different embodiments and thus should not be construed as limited by the exemplary figures. Additionally, the distance between the respective slots 111, 112 (e.g., the distance between the second end of the first slot 111 and the first end of the second slot 112) may also vary in different embodiments.

Figure 43:
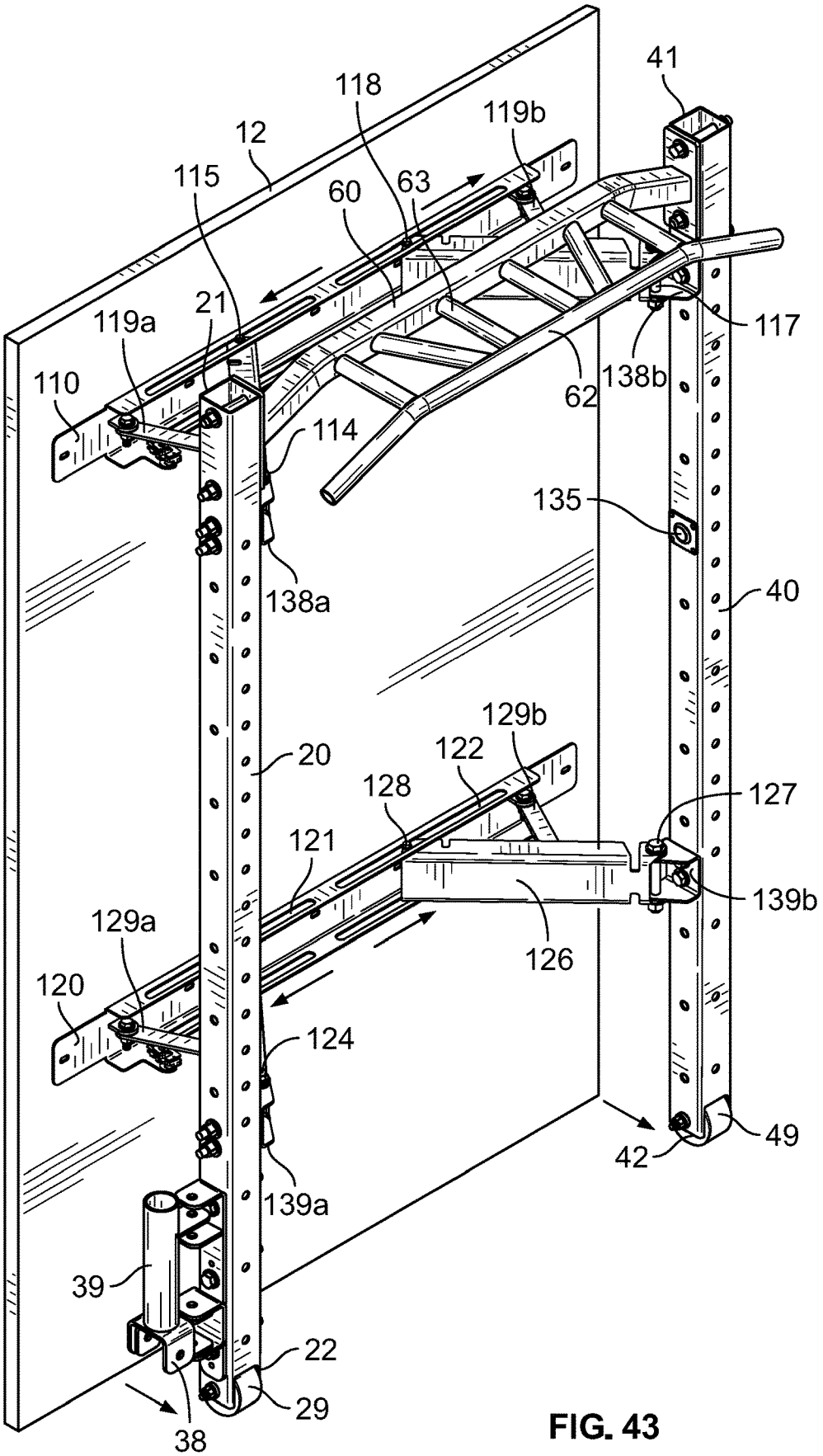
FIG. 43 is a perspective view of a retractable exercise rack system between positions in accordance with an example embodiment.
Figure 47:
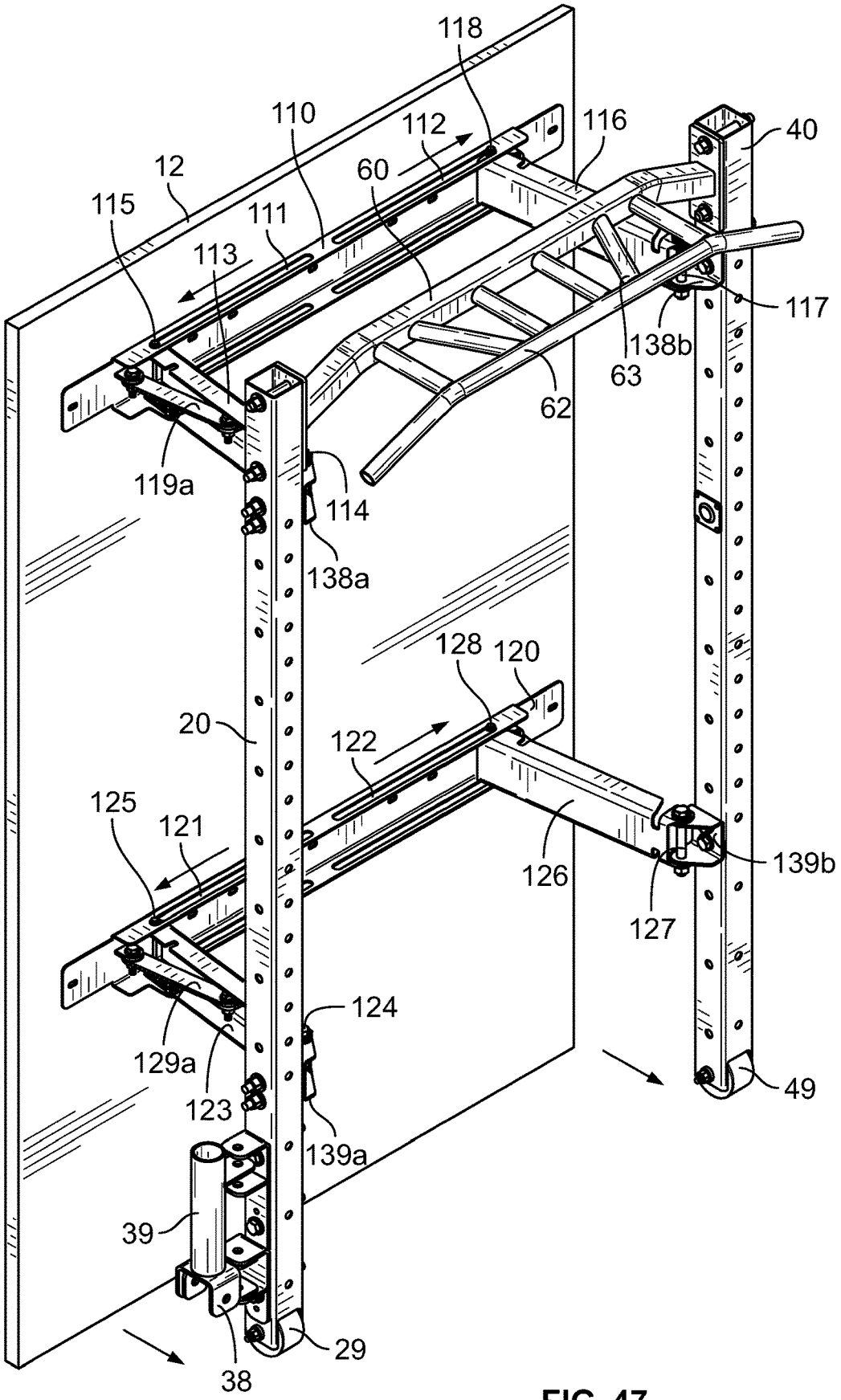
FIG. 47 is a perspective view of a retractable exercise rack system in an extended position in accordance with an example embodiment.

As best shown in FIGS. 39, 43, and 47, a first upper arm 113 may be pivotably connected between the upper wall mount 110 and the first support member 20. More specifically, it can be seen in the figures that the first upper arm 113 is slidably connected at its first end to the upper wall mount 110 and pivotably connected at its second end to the first support member 20. The first upper arm 113 will generally comprise an elongated arm member such as shown in the figures.

The first end of the first upper arm 113 will generally include a first upper slide pin 115 which is slidably engaged within the one or more first slots 111 of the upper wall mount 110. In embodiments in which the first upper arm 113 includes a pair of parallel, spaced-apart arm members such as shown in FIG. 47, the first upper slide pin 115 may extend between the distal ends of the pair of arm members.

When the first support member 20 is in the retracted position, the first upper slide pin 115 will be positioned at the second terminus of the one or more first slots 111 such as shown in FIG. 39. When the first support member 20 is transitioning between positions, the first upper slide pin 115 will be positioned between the first and second terminuses of the one or more first slots 111 such as shown in FIG. 43. When the first support member 20 is in the extended position, the first upper slide pin 115 will be positioned at the first terminus of the one or more first slots 111 such as shown in FIG. 47.

The second end of the first upper arm 113 will generally be pivotably connected to the first support member 20 near its upper end 21 by a first upper bracket **138*a*. A first upper pivot 114 such as a fastener, pin, rod, or the like may be utilized to pivotably connect the second end of the first upper arm 113 to the first upper bracket 138*a*. The first upper bracket 138*a* may be connected with fasteners which extend through openings 33 on the outer and/or inner sides 25, 26 of the first support member 20** as shown in the figures.

A first upper guide arm **119*a* may be connected between the upper wall mount 110 and the first upper arm 113. The first upper guide arm 119*a* may comprise an elongated member such as but not limited to a rod, bar, lever, pole, and the like. The first upper guide arm 119*a* may be utilized to control and guide movement of the first upper arm 113 as the first upper arm 113 is adjusted between positions. As shown in the figures, a first end of the first upper guide arm 119*a* may be pivotably connected at or near the first side of the upper wall mount 110. A second end of the first upper guide arm 119*a* may be pivotably connected to the first upper arm 113**.

A second upper arm 116 may be pivotably connected between the upper wall mount 110 and the second support member 40. More specifically, it can be seen in the figures that the second upper arm 116 is slidably connected at its first end to the upper wall mount 110 and pivotably connected at its second end to the second support member 40. The second upper arm 116 will generally comprise an elongated arm member such as shown in the figures.

The first end of the second upper arm 116 will generally include a second upper slide pin 118 which is slidably engaged within the one or more second slots 112 of the upper wall mount 110. In embodiments in which the second upper arm 116 includes a pair of parallel, spaced-apart arm members such as shown in FIG. 47, the second upper slide pin 118 may extend between the distal ends of the pair of arm members.

When the second support member 40 is in the retracted position, the second upper slide pin 118 will be positioned at the first terminus of the one or more second slots 112 such as shown in FIG. 39. When the second support member 40 is transitioning between positions, the second upper slide pin 118 will be positioned between the first and second terminuses of the one or more second slots 112 such as shown in FIG. 43. When the second support member 40 is in the extended position, the second upper slide pin 118 will be positioned at the second terminus of the one or more second slots 112 such as shown in FIG. 47.

The second end of the second upper arm 116 will generally be pivotably connected to the second support member 40 near its upper end 41 by a second upper bracket **138*b* such as shown in FIG. 39. A second upper pivot 117 such as a fastener, pin, rod, or the like may be utilized to pivotably connect the second end of the second upper arm 116 to the second upper bracket 138*b*. The second upper bracket 138*b* may be connected with fasteners which extend through openings 54 on the outer and/or inner sides 45, 46 of the second support member 40** as shown in the figures.

As shown in FIGS. 47, a second upper guide arm **119*b* may be connected between the upper wall mount 110 and the second upper arm 116. The second upper guide arm 119*b* may comprise an elongated member such as but not limited to a rod, bar, lever, pole, and the like. The second upper guide arm 119*b* may be utilized to control and guide movement of the second upper arm 116 as the second upper arm 116 is adjusted between positions. As shown in the figures, a first end of the second upper guide arm 119*b* may be pivotably connected at or near the second side of the upper wall mount 110. A second end of the second upper guide arm 119*b* may be pivotably connected to the second upper arm 116**.

As best shown in FIG. 47, a lower wall mount 120 may be connected to the wall 12 by various methods such as but not limited to fasteners, adhesives, magnets, and the like. The lower wall mount 120 will generally comprise an elongated member that is oriented horizontally along the wall 12, perpendicular the second support member 40 and parallel to and below the upper wall mount 110. The second support member 40 may be adapted to rest against the lower wall mount 120 when in the retracted position such as shown in FIG. 39. The lower wall mount 120 may be at least partially hollow such as shown in the figures.

As shown in the figures, the lower wall mount 120 may include one or more first slots 121 and one or more second slots 122. The one or more first slots 121 may be positioned along the first half of the lower wall mount 120 and the one or more second slots 122 may be positioned along the second half of the lower wall mount 120. In an exemplary embodiment, the lower wall mount 120 may include a pair of first slots 121 on the upper and lower ends of a first side of the lower wall mount 120 and a pair of second slots 122 on the upper and lower ends of a second side of the lower wall mount 120.

The one or more first slots 121 will generally be aligned horizontally with the one or more second slots 122 as shown in the figures. The length of the respective slots 121, 122 may vary in different embodiments and thus should not be construed as limited by the exemplary figures. Additionally, the distance between the respective slots 121, 122 (e.g., the distance between the second end of the first slot 121 and the first end of the second slot 122) may also vary in different embodiments.

As best shown in FIGS. 39-50, a first lower arm 123 may be pivotably connected between the lower wall mount 120 and the first support member 20. More specifically, it can be seen in the figures that the first lower arm 123 is slidably connected at its first end to the lower wall mount 120 and pivotably connected at its second end to the first support member 20. The first lower arm 123 will generally comprise an elongated arm member such as shown in the figures.

The first end of the first lower arm 123 will generally include a first lower slide pin 125 which is slidably engaged within the one or more first slots 121 of the lower wall mount 120. In embodiments in which the first lower arm 123 includes a pair of parallel, spaced-apart arm members such as shown in FIG. 47, the first lower slide pin 125 may extend between the distal ends of the pair of arm members.

When the first support member 20 is in the retracted position, the first lower slide pin 125 will be positioned at the second terminus of the one or more first slots 121 such as shown in FIG. 39. When the first support member 20 is transitioning between positions, the first lower slide pin 125 will be positioned between the first and second terminuses of the one or more first slots 121 such as shown in FIG. 43. When the first support member 20 is in the extended position, the first lower slide pin 125 will be positioned at the second terminus of the one or more first slots 121 such as shown in FIG. 47.

The second end of the first lower arm 123 will generally be pivotably connected to the first support member 20 near its lower end 22 by a first lower bracket **139*a* such as shown in FIG. 39. A first lower pivot 124 such as a fastener, pin, rod, or the like may be utilized to pivotably connect the second end of the first lower arm 123 to the first lower bracket 139*a*. The first lower bracket 139*a* may be connected with fasteners which extend through openings 33 on the outer and/or inner sides 25, 26 of the first support member 20** as shown in the figures.

As shown in FIGS. 39-50, a first lower guide arm **129*a* may be connected between the lower wall mount 120 and the first lower arm 123. The first lower guide arm 129*a* may comprise an elongated member such as but not limited to a rod, bar, lever, pole, and the like. The first lower guide arm 129*a* may be utilized to control and guide movement of the first lower arm 123 as the first lower arm 123 is adjusted between positions. As shown in the figures, a first end of the first lower guide arm 129*a* may be pivotably connected at or near the first side of the lower wall mount 120. A second end of the first lower guide arm 129*a* may be pivotably connected to the first lower arm 123**.

As best shown in FIGS. 39-50, a second lower arm 126 may be pivotably connected between the lower wall mount 120 and the second support member 40. More specifically, it can be seen in the figures that the second lower arm 126 is slidably connected at its first end to the lower wall mount 120 and pivotably connected at its second end to the second support member 40. The second lower arm 126 will generally comprise an elongated arm member such as shown in the figures.

The first end of the second lower arm 126 will generally include a second lower slide pin 128 which is slidably engaged within the one or more second slots 122 of the lower wall mount 120. In embodiments in which the second lower arm 126 includes a pair of parallel, spaced-apart arm members such as shown in FIG. 47, the second lower slide pin 128 may extend between the distal ends of the pair of arm members.

When the second support member 40 is in the retracted position, the second lower slide pin 128 will be positioned at the first terminus of the one or more second slots 122 such as shown in FIG. 39. When the second support member 40 is transitioning between positions, the second lower slide pin 128 will be positioned between the first and second terminuses of the one or more second slots 122 such as shown in FIG. 43. When the second support member 40 is in the extended position, the second lower slide pin 128 will be positioned at the second terminus of the one or more second slots 122 such as shown in FIG. 47.

The second end of the second lower arm 126 will generally be pivotably connected to the second support member 40 near its lower end 42 by a second lower bracket 139*b* such as shown in FIG. 39. A second lower pivot 127 such as a fastener, pin, rod, or the like may be utilized to pivotably connect the second end of the second lower arm 126 to the second lower bracket 139*b*. The second lower bracket 139*b* may be connected with fasteners which extend through openings 54 on the outer and/or inner sides 45, 46 of the second support member 40 as shown in the figures.

As shown in FIG. 43, a second lower guide arm 129*b* may be connected between the lower wall mount 120 and the second lower arm 126. The second lower guide arm 129*b* may comprise an elongated member such as but not limited to a rod, bar, lever, pole, and the like. The second lower guide arm 129*b* may be utilized to control and guide movement of the second lower arm 126 as the second lower arm 126 is adjusted between positions. As shown in the figures, a first end of the second lower guide arm 129*b* may be pivotably connected at or near the second side of the lower wall mount 120. A second end of the second lower guide arm 129*b* may be pivotably connected to the second lower arm 126.

Each of the arms 113, 116, 123, 126 may be releasably locked in the extended position and/or the retracted position. Each of the arms 113, 116, 123, 126 may thus include a latch 140 for releasably locking the arms 113, 116, 123, 126 in either or both positions.

An exemplary latch 140 is shown in FIG. 51. The latch 140 may be configured to selectively, lockably, and removably engage with a corresponding striker 142, with the latch 140 being locked when engaged with the striker 142. Each latch 140 may include a connector 144 which is pivotable to selectively release the latch 140 from engagement with the striker 142 to unlock the latch 140. One or more buttons 130, 135 may be operable to disengage the latch 140, with an out cable 134*a*, 134*b* that is interconnected with the one or more buttons 130, 135 being adapted to pull or push the latch 140 to disengage from the striker 142 when the one or more buttons 130, 135 are depressed. In other embodiments, however, the latches 140 may each be disengaged using other methods, such as but not limited to manual disengagement by-hand.

The first end of the upper arm 113 may include a latch 140, with a corresponding striker 142 attached to first end of the upper wall mount 110. Conversely, the upper wall mount 110 may include a latch 140 connected at its first end, with a corresponding striker 142 being connected to the first end of the upper arm 113. When the upper arm 113 is in the extended position, the striker 142 will engage within the latch 140 to lock the upper arm 113 in the extended position until such time as the latch 140 is disengaged by pivoting away from engagement with the striker 142.

The first end of the upper arm 116 may include a latch 140, with a corresponding striker 142 attached to a second end of the upper wall mount 110. Conversely, the upper wall mount 110 may include a latch 140 connected at its second end, with a corresponding striker 142 being connected to the first end of the upper arm 116. When the upper arm 116 is in the extended position, the striker will engage within the latch 140 to lock the upper arm 116 in the extended position until such time as the latch 140 is disengaged by pivoting away from engagement with the striker 142.

The first end of the lower arm 123 may include a latch 140, with a corresponding striker 142 being attached to a first end of the lower wall mount 120. Conversely, the lower wall mount 120 may include a latch 140 connected at its first end, with a corresponding striker 142 being connected to the first end of the lower arm 123. When the lower arm 123 is in the extended position, the striker 142 will engage within the latch 140 to lock the lower arm 123 in the extended position until such time as the latch 140 is disengaged by pivoting away from engagement with the striker 142.

The first end of the lower arm 126 may include a latch 140, with a corresponding striker 142 being attached to a second end of the lower wall mount 120. Conversely, the lower wall mount 120 may include a latch 140 connected at its second end, with a corresponding striker 142 being connected to the first end of the lower arm 126. When the lower arm 126 is in the extended position, the striker 142 will engage within the latch 140 to lock the lower arm 126 in the extended position until such time as the latch 140 is disengaged by pivoting away from engagement with the striker 142.

G. Operation of Preferred Embodiment

In use, the retractable exercise rack system may first be secured to the wall 12 (e.g., by fasteners, adhesives, and the like). In the embodiments shown in FIGS. 1-25, the wall mounts 70, 72, 74, 76 are secured to the wall 12 or other vertical surface. In the embodiment shown in FIGS. 26-38, the first and second wall mounts 90, 100 are secured to the wall 12 or other vertical surface. In the embodiment shown in FIGS. 39-51, the upper and lower wall mounts 110, 120 are secured to the wall 12 or other vertical surface.

Generally, the retractable exercise rack system will be installed and stored in the retracted position so as to maximize space when not in use. FIGS. 1-4 illustrate a first exemplary embodiment in the retracted position against a wall 12, FIGS. 13-16 illustrate a second exemplary embodiment in the retracted position against a wall 12, FIGS. 26-29 illustrate a third exemplary embodiment in the retracted position against a wall 12, and FIGS. 39-42 illustrate a fourth exemplary embodiment in the retracted position.

When ready for use, the support members 20, 40 will generally be adjusted from the retracted position to the extended position. The manner by which the support members 20, 40 are adjusted between the positions may vary in different embodiments. In one exemplary embodiment, an exerciser need only grasp one or both support members 20, 40 and pull outwardly. In other exemplary embodiments, an exerciser may grasp both support members 20, 40 simultaneously (e.g., by grasping the first support member 20 with a first hand and the second support member 40 with a second hand) and pull outwardly. In some embodiments, the support members 20, 40 may be adjusted automatically, such as by use of actuators. The wheels 29, 49 on the lower ends 22, 42 of the first and second support members 20, 40 will roll along the ground surface 14 until the first and second support members 20, 40 are fully extended.

In a first exemplary embodiment as shown in FIGS. 5-8, the linkages 78*a*, 78*b*, 79*a*, 79*b* will pivot downwardly, with the slide pins 32*a*, 32*b*, 52*a*, 52*b* sliding downwardly within the respective slots 30*a*, 30*b*, 50*a*, 50*b* until the linkages 78*a*, 78*b*, 79*a*, 79*b* are perpendicular to the support members 20, 40.

In a second exemplary embodiment as shown in FIGS. 17-20, the scissor connectors 80*a*, 80*b*, 85*a*, 85*b* will unfold and pivot until the first and second arms 81*a*, 81*b*, 83*a*, 83*b*, 86*a*, 86*b* are fully extended and linearly-aligned in a perpendicular orientation with respect to the support members 20, 40.

In a third exemplary embodiment as shown in FIGS. 30-33, the upper arms 93, 103 will pivot, with their respective slide pins 95, 105 sliding upwardly within the upper slots 91, 101 of the wall mounts 90, 100 until the upper arms 93, 103 are perpendicular with respect to the support members 20, 40. Similarly, the lower arms 96, 106 will slide downwardly within the lower slots 92, 102 of the wall mounts 90, 100 until the lower arms 96, 106 are perpendicular with respect to the support members 20, 40.

In a fourth exemplary embodiment shown in FIGS. 43-46, the first and second upper arms 113, 116 will pivot, with their respective slide pins 115, 118 sliding outwardly within the first and second slots 111, 112 of the upper wall mount 110 until the first and second upper arms 113, 116 are substantially perpendicular with respect to the support members 20, 40. Similarly, the first and second lower arms 123, 126 will pivot, with their respective slide pins 125, 128 sliding outwardly within the first and second slots 121, 122 of the lower wall mount 120 until the first and second lower arms 123, 126 are substantially perpendicular with respect to the support members 20, 40.

FIGS. 9-12 illustrate a first exemplary embodiment in an extended position. FIGS. 21-24 illustrate a second exemplary embodiment in an extended position. FIGS. 34-37 illustrate a third exemplary embodiment in an extended position. FIGS. 47-50 illustrate a fourth exemplary embodiment in an extended position.

Each of the exemplary embodiments may be releasably locked in the extended position by one or more latches 140. By way of example, a first exemplary embodiment as shown in FIGS. 1-12 may utilize latches 140 positioned at a distal end of the slots 30*a*, 30*b*, 50*a*, 50*b* which may releasably engage with a corresponding slide pin 32*a*, 32*b*, 52*a*, 52*b*.

As a further example, a second exemplary embodiment as shown in FIGS. 13-25 may utilize latches 140 positioned on the respective first arms 81*a*, 81*b*, 86*a*, 86*b* of the scissor connectors 80*a*, 80*b*, 85*a*, 85*b* which may engage with corresponding strikers 142 positioned on the respective second arms 83*a*, 83*b*, 88*a*, 88*b* of the scissor connectors 80*a*, 80*b*, 85*a*, 85*b*, or vice versa.

As yet another example, a third exemplary embodiment as shown in FIGS. 26-38 may utilize latches 140 positioned on the respective arms 93, 96, 103, 106 of which may engage with corresponding strikers 142 positioned on the respective first and second wall mounts 90, 100, or vice versa.

As another example, a fourth exemplary embodiment as shown in FIGS. 39-51 may utilize latches 140 positioned on the respective arms 113, 116, 123, 126 which may engage with corresponding strikers 142 positioned on the respective upper and lower wall mounts 110, 120, or vice versa.

With the first and second support members 20, 40 in the extended position, an exerciser may attach various exercise attachments to perform a wide range of exercise movements. The exerciser may, for example, perform pull-ups or other exercises using the exercise bar 62. The exerciser may attach brackets to support weightlifting equipment, or various other exercise attachments/accessories known in the art to be used in connection with an exercise rack. With the support members 20, 40 being locked in position, the first and second support members 20, 40 will remain locked in place so as not to move or release when exercises are being performed.

When completed with exercising, the latches 140 may be released from the strikers 142 so that the first and second support members 20, 40 may be returned to the retracted position for storage. In an exemplary embodiment as shown in FIGS. 52A and 52B, one or more buttons 130, 135 may be depressed which are operable to disengage the latches 140. As shown in FIG. 52B, depression of a button 130, 135 causes out cables 134*a*, 134*b* to be pulled inwardly, thus pivoting the latches into a disengaged position. In other embodiments, the latches 140 may be disengaged by other methods, such as but not limited to manual disengagement by-hand, or the use of actuators (e.g., with a remote control).

Once the latches 140 are disengaged, the first and second support members 20, 40 may be grasped and pushed inwardly towards the wall 12. In a first exemplary embodiment as shown in FIGS. 1-4, the linkages 78*a*, 78*b*, 79*a*, 79*b* will pivot upwardly, with the slide pins 32*a*, 32*b*, 52*a*, 52*b* sliding upwardly within the respective slots 30*a*, 30*b*, 50*a*, 50*b* until the linkages 78*a*, 78*b*, 79*a*, 79*b* are substantially parallel to the support members 20, 40.

In a second exemplary embodiment as shown in FIGS. 13-16, the scissor connectors 80*a*, 80*b*, 85*a*, 85*b* will fold together and pivot until the first and second arms 81*a*, 81*b*, 83*a*, 83*b*, 86*a*, 86*b* are retracted and folded onto teach other in a substantially parallel orientation with respect to the support members 20, 40.

In a third exemplary embodiment as shown in FIGS. 26-29, the upper arms 93, 103 will pivot, with their respective slide pins 95, 105 sliding downwardly within the upper slots 91, 101 of the wall mounts 90, 100 until the upper arms 93, 103 are substantially parallel with respect to the support members 20, 40. Similarly, the lower arms 96, 106 will slide upwardly within the lower slots 92, 102 of the wall mounts 90, 100 until the lower arms 96, 106 are substantially parallel with respect to the support members 20, 40.

In a fourth exemplary embodiment shown in FIGS. 39-42, the first and second upper arms 113, 116 will pivot, with their respective slide pins 115, 118 sliding inwardly within the first and second slots 111, 112 of the upper wall mount 110 until the first and second upper arms 113, 116 are substantially parallel with respect to the support members 20, 40. Similarly, the first and second lower arms 123, 126 will pivot, with their respective slide pins 125, 128 sliding inwardly within the first and second slots 121, 122 of the lower wall mount 120 until the first and second lower arms 123, 126 are substantially parallel with respect to the support members 20, 40.

In some embodiments, the first and second support members 20, 40 may be releasably locked into the retracted position. In other embodiments such as shown in the figures, the first and second support members 20, 40 will naturally remain in the retracted position until sufficient outward force (away from the wall 12) is applied to each of the support members 20, 40 to pull them back into the extended position. With the support members 20, 40 retracted, additional space will be available in the exercise area, and the risk of tripping over or otherwise bumping into the exercise rack will be minimized.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A retractable exercise rack system, comprising:

a first wall mount adapted to be connected to a wall;

a second wall mount adapted to be connected to the wall;

a first support member;

a second support member, wherein the second support member is distally-spaced and parallel with respect to the first support member;

a first arm connected between the first wall mount and the first support member; and a second arm connected between the second wall mount and the second support member;

wherein a first end of the first arm is slidable along a portion of a length of the first wall mount, and wherein a first end of the second arm is slidable along a portion of a length of the second wall mount;

wherein a second end of the first arm is pivotably connected to the first support member, and wherein a second end of the second arm is pivotably connected to the second support member;

wherein the first support member and the second support member are adjustable between a retracted position and an extended position, wherein in the retracted position the first support member and the second support member are positioned adjacent to the wall, and wherein in the extended position the first support member and the second support member are distally positioned away from the wall.

2. The retractable exercise rack system of claim 1, wherein the first wall mount and the second wall mount are vertically-oriented, and wherein the first wall mount is parallel to the second wall mount.

3. The retractable exercise rack system of claim 1, wherein the first wall mount includes a first slot, wherein the first arm is slidably connected to the first wall mount within the first slot, wherein the second wall mount includes a second slot, and wherein the second arm is slidably connected to the second wall mount within the second slot.

4. The retractable exercise rack system of claim 3, wherein the first end of the first arm includes a first slide pin adapted to slide within the first slot of the first wall mount, and wherein the first end of the second arm includes a second slide pin adapted to slide within the second slot of the second wall mount.

5. The retractable exercise rack system of claim 1, wherein the first arm includes a first latch for removably locking the first support member in the extended position, wherein the second arm includes a second latch for removably locking the second support member in the extended position, wherein the first wall mount includes a first striker adapted to engage with the first latch when the first support member is in the extended position, and wherein the second wall mount includes a second striker adapted to engage with the second latch when the second support member is in the extended position.

6. The retractable exercise rack system of claim 1, further comprising:

a third arm connected between the first wall mount and the first support member, wherein a first end of the third arm is slidably connected to the first wall mount; and a fourth arm connected between the second wall mount and the second support member, wherein a first end of the fourth arm is slidably connected to the second wall mount.

7. The retractable exercise rack system of claim 6, wherein a second end of the first arm is pivotably connected to the first support member, wherein a second end of the second arm is pivotably connected to the second support member, wherein a second end of the third arm is pivotably connected to the first support member, and wherein a second end of the fourth arm is pivotably connected to the second support member.

8. The retractable exercise rack system of claim 6, wherein the first arm is connected near an upper portion of the first support member, wherein the second arm is connected near an upper portion of the second support member, wherein the third arm is connected near a lower portion of the first support member, and wherein the fourth arm is connected near a lower portion of the second support member.

9. The retractable exercise rack system of claim 6, wherein the first end of the first arm and the first end of the third arm are slidably connected within at least one slot within the first wall mount, and wherein the first end of the second arm and the first end of the fourth arm are slidably connected within at least one slot within the second wall mount.

10. The retractable exercise rack system of claim 6, wherein the first wall mount includes a first upper slot and a first lower slot, wherein the first end of the first arm is slidably connected within the first upper slot, wherein the first end of the third arm is slidably connected within the first lower slot, wherein the second wall mount includes a second upper slot and a second lower slot, wherein the first end of the second arm is slidably connected within the second upper slot, and wherein the first end of the fourth arm is slidably connected within the second lower slot.

11. The retractable exercise rack system of claim 6, wherein the first arm is parallel with the third arm when the first support member is in the extended position, and wherein the second arm is parallel with the fourth arm when the second support member is in the extended position.

12. The retractable exercise rack system of claim 1, further comprising a first wheel connected to a lower portion of the first support member and a second wheel connected to a lower portion of the second support member.

13. The retractable exercise rack system of claim 1, wherein the first end of the first arm is adapted to slidably move in a vertical manner with respect to the first wall mount, and wherein the first end of the second arm is adapted to slidably move in a vertical manner with respect to the second wall mount.

14. A retractable exercise rack system, comprising:

a first wall mount adapted to be connected to a wall;

a second wall mount adapted to be connected to the wall;

wherein the first wall mount and the second wall mount are vertically-oriented, and wherein the first wall mount is parallel to the second wall mount;

a first support member;

a second support member, wherein the second support member is distally-spaced and parallel with respect to the first support member;

a first arm connected between the first wall mount and the first support member;

a second arm connected between the second wall mount and the second support member;

wherein a first end of the first arm is slidably connected to the first wall mount, and wherein a first end of the second arm is slidably connected to the second wall mount;

wherein the first end of the first arm is adapted to slidably move in a vertical manner with respect to the first wall mount, and wherein the first end of the second arm is adapted to slidably move in a vertical manner with respect to the second wall mount;

wherein a second end of the first arm is pivotably connected to the first support member, and wherein a second end of the second arm is pivotably connected to the second support member;

a third arm connected between the first wall mount and the first support member, wherein a first end of the third arm is slidably connected to the first wall mount; and a fourth arm connected between the second wall mount and the second support member, wherein a first end of the fourth arm is slidably connected to the second wall mount;

wherein a second end of the first arm is pivotably connected to the first support member, wherein a second end of the second arm is pivotably connected to the second support member, wherein a second end of the third arm is pivotably connected to the first support member, and wherein a second end of the fourth arm is pivotably connected to the second support member;

wherein the first support member and the second support member are adjustable between a retracted position and an extended position, wherein in the retracted position the first support member and the second support member are positioned adjacent to the wall, and wherein in the extended position the first support member and the second support member are distally positioned away from the wall.

15. The retractable exercise rack system of claim 14, wherein the first end of the first arm and the first end of the third arm are slidably connected within at least one slot within the first wall mount, and wherein the first end of the second arm and the first end of the fourth arm are slidably connected within at least one slot within the second wall mount.

16. The retractable exercise rack system of claim 14, wherein the first wall mount includes a first upper slot and a first lower slot, wherein the first end of the first arm is slidably connected within the first upper slot, wherein the first end of the third arm is slidably connected within the first lower slot, wherein the second wall mount includes a second upper slot and a second lower slot, wherein the first end of the third arm is slidably connected within the second upper slot, and wherein the first end of the fourth arm is slidably connected within the second lower slot.

17. The retractable exercise rack system of claim 16, wherein the first end of the first arm includes a first slide pin adapted to slide within the first upper slot of the first wall mount, wherein the first end of the second arm includes a second slide pin adapted to slide within the second upper slot of the second wall mount, wherein the first end of the third arm includes a third slide pin adapted to slide within the first lower slot of the first wall mount, and wherein the first end of the fourth arm includes a fourth slide pin adapted to slide within the second lower slot of the second wall mount.

18. The retractable exercise rack system of claim 14, wherein the first arm is connected near an upper portion of the first support member, wherein the second arm is connected near an upper portion of the second support member, wherein the third arm is connected near a lower portion of the first support member, and wherein the fourth arm is connected near a lower portion of the second support member.

19. The retractable exercise rack system of claim 14, further comprising a first wheel connected to a lower portion of the first support member and a second wheel connected to a lower portion of the second support member.

20. A retractable exercise rack system, comprising:

a first wall mount adapted to be connected to a wall;

a second wall mount adapted to be connected to the wall;

wherein the first wall mount and the second wall mount are vertically-oriented, and wherein the first wall mount is parallel to the second wall mount;

a first support member;

a second support member, wherein the second support member is distally-spaced and parallel with respect to the first support member;

a first wheel connected to a lower portion of the first support member;

a second wheel connected to a lower portion of the second support member;

an exercise bar connected between the first support member and the second support member; a first arm connected between the first wall mount and the first support member;

a second arm connected between the second wall mount and the second support member;

wherein a first end of the first arm is slidably connected to the first wall mount, and wherein a first end of the second arm is slidably connected to the second wall mount;

wherein the first end of the first arm is adapted to slidably move in a vertical manner with respect to the first wall mount, and wherein the first end of the second arm is adapted to slidably move in a vertical manner with respect to the second wall mount;

wherein a second end of the first arm is pivotably connected to the first support member, and wherein a second end of the second arm is pivotably connected to the second support member;

a third arm connected between the first wall mount and the first support member, wherein a first end of the third arm is slidably connected to the first wall mount; and a fourth arm connected between the second wall mount and the second support member, wherein a first end of the fourth arm is slidably connected to the second wall mount;

wherein a second end of the first arm is pivotably connected to the first support member, wherein a second end of the second arm is pivotably connected to the second support member, wherein a second end of the third arm is pivotably connected to the first support member, and wherein a second end of the fourth arm is pivotably connected to the second support member;

wherein the first wall mount includes a first upper slot and a first lower slot, wherein the first end of the first arm is slidably connected within the first upper slot, wherein the first end of the third arm is slidably connected within the first lower slot, wherein the second wall mount includes a second upper slot and a second lower slot, wherein the first end of the third arm is slidably connected within the second upper slot, and wherein the first end of the fourth arm is slidably connected within the second lower slot;

wherein the first arm is connected near an upper portion of the first support member, wherein the second arm is connected near an upper portion of the second support member, wherein the third arm is connected near a lower portion of the first support member, and wherein the fourth arm is connected near a lower portion of the second support member;

wherein the first support member and the second support member are adjustable between a retracted position and an extended position, wherein in the retracted position the first support member and the second support member are positioned adjacent to the wall, and wherein in the extended position the first support member and the second support member are distally positioned away from the wall.

* * * * *